US011174064B2

(12) United States Patent
Kearns et al.

(10) Patent No.: US 11,174,064 B2
(45) **Date of Patent: *Nov. 16, 2021**

(54) CARTON WITH IMPACT-RESISTANT FEATURES

(71) Applicant: Graphic Packaging International, LLC, Atlanta, GA (US)

(72) Inventors: Matthew R. Kearns, Woodstock, GA (US); Aaron Lee Bates, Kennesaw, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/701,564

(22) Filed: Dec. 3, 2019

(65) Prior Publication Data

US 2020/0102112 A1 Apr. 2, 2020

Related U.S. Application Data

(63) Continuation-in-part of application No. 15/938,011, filed on Mar. 28, 2018, now Pat. No. 11,001,407.

(Continued)

(51) Int. Cl.
*B65D 5/02* (2006.01)
*B65D 5/42* (2006.01)

(Continued)

(52) U.S. Cl.
CPC ..... *B65D 5/0245* (2013.01); *B31B 50/26* (2017.08); *B65D 5/4266* (2013.01);

(Continued)

(58) Field of Classification Search
CPC ..... B65D 5/0245; B65D 81/02; B65D 5/443; B65B 55/00

(Continued)

(56) References Cited

U.S. PATENT DOCUMENTS 881,785 A * 3/1908 Flora ..... B65D 5/006 229/198.1
1,254,692 A * 1/1918 Hofman ..... B65D 5/0227 229/160

(Continued)

FOREIGN PATENT DOCUMENTS

DE 2 320 190 11/1973
DE 299 17 276 U1 1/2000

(Continued)

OTHER PUBLICATIONS

International Search Report and Written Opinion for PCT/US2018/024717 dated Jul. 6, 2018.

(Continued)

*Primary Examiner* — Christopher R Demeree
(74) *Attorney, Agent, or Firm* — Womble Bond Dickinson (US) LLP

(57) ABSTRACT

A carton for holding one or more articles, the carton including a plurality of panels extending at least partially around an interior of the carton and at least partially forming a body portion of the carton, a plurality of impact-resistant panels foldably connected to a respective panel of the plurality of panels, and a plurality of end flaps for forming a closed end of the carton. The plurality of end flaps includes a first end flap foldably connected to an impact-resistant panel of the plurality of impact-resistant panels and a second end flap foldably connected to a panel of the plurality of panels, a lateral edge of the second end flap is a folding edge about which the first end flap is folded to at least partially form the closed end.

37 Claims, 41 Drawing Sheets

Related U.S. Application Data

(60) Provisional application No. 62/776,716, filed on Dec. 7, 2018, provisional application No. 62/477,641, filed on Mar. 28, 2017.

(51) Int. Cl.
*B31B 50/26* (2017.01)
*B31B 120/50* (2017.01)
*B31B 50/62* (2017.01)
*B31B 110/35* (2017.01)

(52) U.S. Cl.
CPC ..... *B31B 50/624* (2017.08); *B31B 2110/35* (2017.08); *B31B 2120/50* (2017.08)

(58) Field of Classification Search
USPC ..... 229/116.3, 163, 918, 919, 132; 206/521; 493/89
See application file for complete search history.

(56) References Cited

U.S. PATENT DOCUMENTS 1,656,919 A 1/1928 Marsh
1,901,483 A 3/1933 Ware, Jr.
1,925,102 A 9/1933 Levkoff
2,027,079 A 1/1936 Weiss
2,141,743 A 12/1938 Ethridge
2,145,430 A 1/1939 New
2,152,079 A 3/1939 Mott
2,684,178 A 7/1954 Keeler
2,704,617 A 3/1955 Stieve
3,002,613 A 10/1961 Merkel et al.
3,227,356 A * 1/1966 Lawrence ..... B65D 5/0245 206/424
3,258,152 A 6/1966 Cameron
3,276,665 A 10/1966 Rasmussen
3,280,968 A 10/1966 Craine
3,291,370 A 12/1966 Elias
3,402,875 A * 9/1968 Palmer ..... B65D 5/068 229/238
3,511,434 A 5/1970 Dews
3,525,465 A 8/1970 Hotz
3,532,263 A 10/1970 Ross
3,554,402 A 1/1971 Lock
3,578,238 A 5/1971 Schillinger et al.
3,653,495 A 4/1972 Gray
3,677,458 A 7/1972 Gosling
3,688,972 A 9/1972 Mahon
3,759,378 A 9/1973 Werth
3,786,914 A 1/1974 Beutler
3,833,116 A 9/1974 Howe
3,863,831 A 2/1975 Wozniacki et al.
3,884,348 A 5/1975 Ross
3,904,036 A 9/1975 Forrer
4,008,849 A 2/1977 Baber
4,039,120 A 8/1977 Herzog
4,058,206 A 11/1977 Morse et al.
4,113,100 A 9/1978 Soja et al.
4,134,497 A 1/1979 Dlugopolski
4,201,322 A 5/1980 Crawford
4,295,598 A 10/1981 Calvert
4,324,357 A 4/1982 Murkowski
4,327,829 A 5/1982 Hughes
4,533,052 A 8/1985 Fruchey et al.
4,550,834 A 11/1985 Fletcher et al.
4,558,785 A 12/1985 Gordon
4,742,917 A 5/1988 Bornwasser
4,773,541 A 9/1988 Riddell
4,815,609 A 3/1989 Kiedaisch
4,886,160 A 12/1989 Kligerman
5,029,698 A 7/1991 Stout
5,065,937 A 11/1991 Ritter
5,156,269 A 10/1992 Bakx
5,167,324 A 12/1992 Miller
5,181,650 A 1/1993 Hollander et al.
5,197,598 A 3/1993 Stout et al.
5,246,112 A 9/1993 Stout et al.
5,400,955 A 3/1995 Coalier et al.
5,582,345 A 12/1996 Lankhuijzen
5,588,585 A 12/1996 McClure
5,647,483 A 7/1997 Harris
5,699,957 A 12/1997 Blin et al.
5,704,470 A 1/1998 Sutherland
5,741,535 A 4/1998 Cope et al.
5,842,576 A 12/1998 Snow
5,857,570 A 1/1999 Brown
5,881,884 A 3/1999 Podosek
5,921,398 A 7/1999 Carroll
5,927,498 A 7/1999 Saam
5,941,377 A 8/1999 Hart et al.
5,979,749 A 11/1999 Bozich
6,041,920 A 3/2000 Hart et al.
6,105,853 A 8/2000 Lamare
6,129,211 A 10/2000 Prakken et al.
6,135,289 A 10/2000 Miller
6,227,367 B1 5/2001 Harrelson et al.
6,332,538 B1 12/2001 Pritchard
6,419,152 B1 7/2002 Tokarski
6,435,351 B1 8/2002 Gibb
6,478,159 B1 11/2002 Taylor et al.
6,510,982 B2 1/2003 White
6,523,692 B2 2/2003 Gregory
6,536,656 B2 3/2003 Auclair et al.
6,631,803 B2 10/2003 Rhodes et al.
6,695,137 B2 2/2004 Jones et al.
6,729,475 B2 5/2004 Yuhas et al.
6,869,009 B2 3/2005 Sutherland et al.
6,968,992 B2 11/2005 Schuster
6,981,632 B2 1/2006 Gardner et al.
7,118,023 B2 10/2006 Holdsworth
7,128,206 B2 10/2006 Kohler
7,152,777 B2 12/2006 McClure
7,201,714 B2 4/2007 Zoeckler et al.
7,225,930 B2 6/2007 Ford et al.
7,494,044 B2 2/2009 Walsh et al.
D590,710 S 4/2009 Mittelstaedt
7,552,820 B2 6/2009 Kohler
D597,834 S 8/2009 Mittelstaedt
7,959,063 B2 6/2011 McLeod
8,317,671 B1 11/2012 Zoeckler
8,403,819 B2 3/2013 Zoeckler
8,403,820 B2 3/2013 Zoeckler
8,672,822 B2 3/2014 Walsh et al.
8,740,054 B2 6/2014 Pinkstone
8,840,011 B2 9/2014 Kohler
8,978,889 B2 3/2015 Fitzwater et al.
9,022,217 B2 5/2015 Holley, Jr.
9,073,680 B2 7/2015 Kastanek
9,394,094 B2 7/2016 Holley, Jr. et al.
9,573,744 B2 2/2017 Schmal et al.
9,598,214 B2 3/2017 Holley, Jr.
2002/0043554 A1 4/2002 White
2002/0170845 A1 11/2002 Oliff
2003/0222131 A1 12/2003 Justice
2004/0124111 A1 7/2004 Bevier
2005/0103651 A1 5/2005 Lebras
2005/0211577 A1 9/2005 Bakx
2005/0230273 A1 10/2005 Kohler
2006/0006216 A1 1/2006 Moll et al.
2006/0138206 A1 6/2006 Keefe et al.
2006/0231603 A1 10/2006 McLeod
2008/0237322 A1 10/2008 Mittelstaedt
2009/0266873 A1 10/2009 Ledvina
2010/0308104 A1 12/2010 Kohler
2012/0091031 A1 4/2012 Pinkstone
2018/0282013 A1 10/2018 Kearns

FOREIGN PATENT DOCUMENTS

EP 0 704 386 4/1996
FR 1 379 931 11/1964
GB 920 579 A 3/1963
GB 1 218 016 1/1971

(56) References Cited

FOREIGN PATENT DOCUMENTS

| | | |
|---|---|---|
| WO | WO 99/31593 | 7/1998 |
| WO | WO 03/082686 | 10/2003 |
| WO | WO 2004/063031 | 7/2004 |

OTHER PUBLICATIONS

Office Action for U.S. Appl. No. 15/938,011 dated Feb. 6, 2019.
Response to Restriction Requirement for U.S. Appl. No. 15/938,011 dated Feb. 26, 2019.
Office Action for U.S. Appl. No. 15/938,011 dated Mar. 15, 2019.
Amendment A and Response to Office Action for U.S. Appl. No. 15/938,011 dated Jun. 13, 2019.
Office Action for U.S. Appl. No. 15/938,011 dated Oct. 2, 2019.
Amendment B and Response to Final Office Action for U.S. Appl. No. 15/938,011 dated Nov. 22, 2019.
Certification and Request for Consideration Under the After Final Consideration Pilot Program 2.0 for U.S. Appl. No. 15/938,011 dated Nov. 22, 2019.
Advisory Action Before the Filing of an Appeal Brief for U.S. Appl. No. 15/938,011 dated Dec. 3, 2019.
Request for Continued Examination (RCE) Transmittal for U.S. Appl. No. 15/938,011 dated Dec. 4, 2019.
Office Action for U.S. Appl. No. 15/938,011 dated Dec. 20, 2019.
European Search Report for EP 19 21 4061 dated Mar. 25, 2020.
Supplementary European Search Report for EP 18 77 7232 dated Nov. 12, 2020.

* cited by examiner

CARTON WITH IMPACT-RESISTANT FEATURES

CROSS-REFERENCE TO RELATED APPLICATION

This application claims the benefit of U.S. Provisional Patent Application No. 62/776,716, filed on Dec. 7, 2018, and is a continuation-in-part of U.S. patent application Ser. No. 15/938,011, filed on Mar. 28, 2018, which claims the benefit of U.S. Provisional Patent Application No. 62/477,641, filed on Mar. 28, 2017.

INCORPORATION BY REFERENCE

The disclosures of each U.S. Provisional Patent Application No. 62/477,641, filed on Mar. 28, 2017, U.S. patent application Ser. No. 15/938,011, filed on Mar. 28, 2018, and U.S. Provisional Patent Application No. 62/776,716, filed on Dec. 7, 2018, are hereby incorporated by reference for all purposes as if presented herein in their respective entirety.

BACKGROUND OF THE DISCLOSURE

The present disclosure generally relates to cartons for holding one or more articles, for example, shipping products or beverage containers. More specifically, the present disclosure relates to cartons having at least one impact-resistant feature.

SUMMARY OF THE DISCLOSURE

According to one aspect of the disclosure, a carton for holding one or more articles comprises a plurality of panels extending at least partially around an interior of the carton and at least partially forming a body portion of the carton, a plurality of impact-resistant panels foldably connected to a respective panel of the plurality of panels, and a plurality of end flaps for forming a closed end of the carton. The plurality of end flaps comprises a first end flap foldably connected to an impact-resistant panel of the plurality of impact-resistant panels and a second end flap foldably connected to a panel of the plurality of panels, a lateral edge of the second end flap is a folding edge about which the first end flap is folded to at least partially form the closed end.

According to another aspect of the disclosure, a blank for forming a carton for holding one or more articles comprises a plurality of panels for extending at least partially around an interior of the carton formed from the blank, the plurality of panels being for at least partially forming a body portion of the carton. The blank further comprises a plurality of impact-resistant panels foldably connected to a respective panel of the plurality of panels, and a plurality of end flaps for forming a closed end of the carton formed form the blank. The plurality of end flaps comprises a first end flap foldably connected to an impact-resistant panel of the plurality of impact-resistant panels and a second end flap foldably connected to a panel of the plurality of panels, a lateral edge of the second end flap is a folding edge about which the first end flap is for being folded to at least partially form the closed end of the carton formed from the blank.

According to another aspect of the disclosure, a method of forming a carton for holding one or more articles comprises obtaining a blank comprising a plurality of panels, a plurality of impact-resistant panels foldably connected to a respective panel of the plurality of panels, and a plurality of end flaps comprising a first end flap foldably connected to an impact-resistant panel of the plurality of impact-resistant panels and a second end flap foldably connected to a panel of the plurality of panels. The method further comprises folding the plurality of panels at least partially around an interior of the carton such that the plurality of panels at least partially forms a body portion of the carton, and folding the plurality of end flaps to at least partially form a closed end of the carton. A lateral edge of the second end flap is a folding edge about which the first end flap is folded to at least partially form the closed end.

Those skilled in the art will appreciate the above stated advantages and other advantages and benefits of various additional embodiments from reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain articles such as shipping items or products, for example, perishable or non-perishable food items, household goods, clothing, and/or electronics. In one embodiments, the articles can be used for packaging food and beverage products, for example, and the articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. In this specification, the terms "lower," "bottom," "upper" and "top" indicate orientations determined in relation to fully erected and upright cartons. As described herein, panels and/or end flaps may be designated in relative terms to one another, e.g., "first", "second", "third", etc., in sequential or non-sequential reference, without departing from the disclosure.

Figure 1:
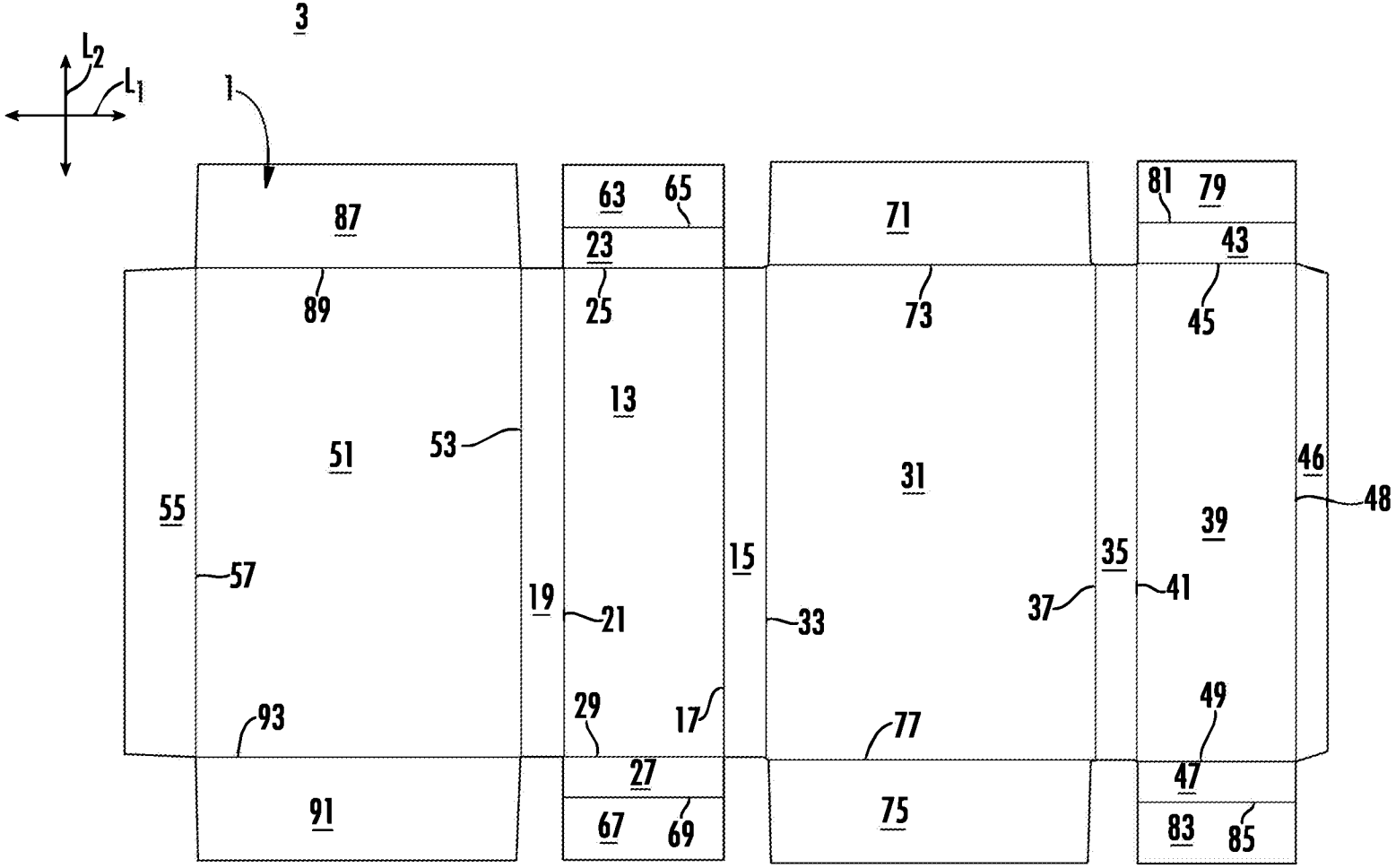
FIG. 1 is a plan view of an interior surface of a blank for forming a carton according to a first exemplary embodiment of the disclosure.
Figure 2:
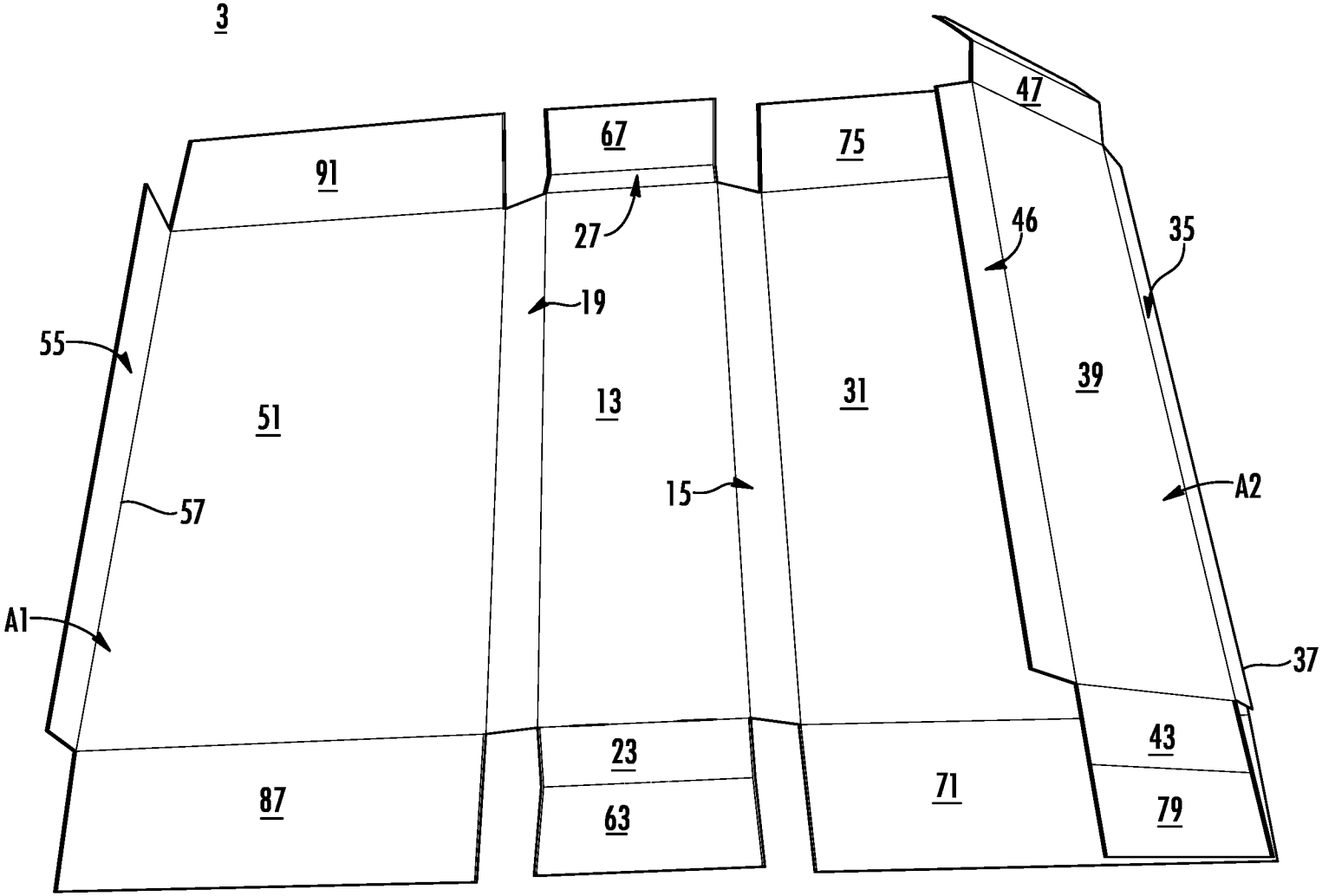
FIG. 2 is a first sequential perspective view of a folding of the blank of FIG. 1 according to an exemplary embodiment of the disclosure.
Figure 3:
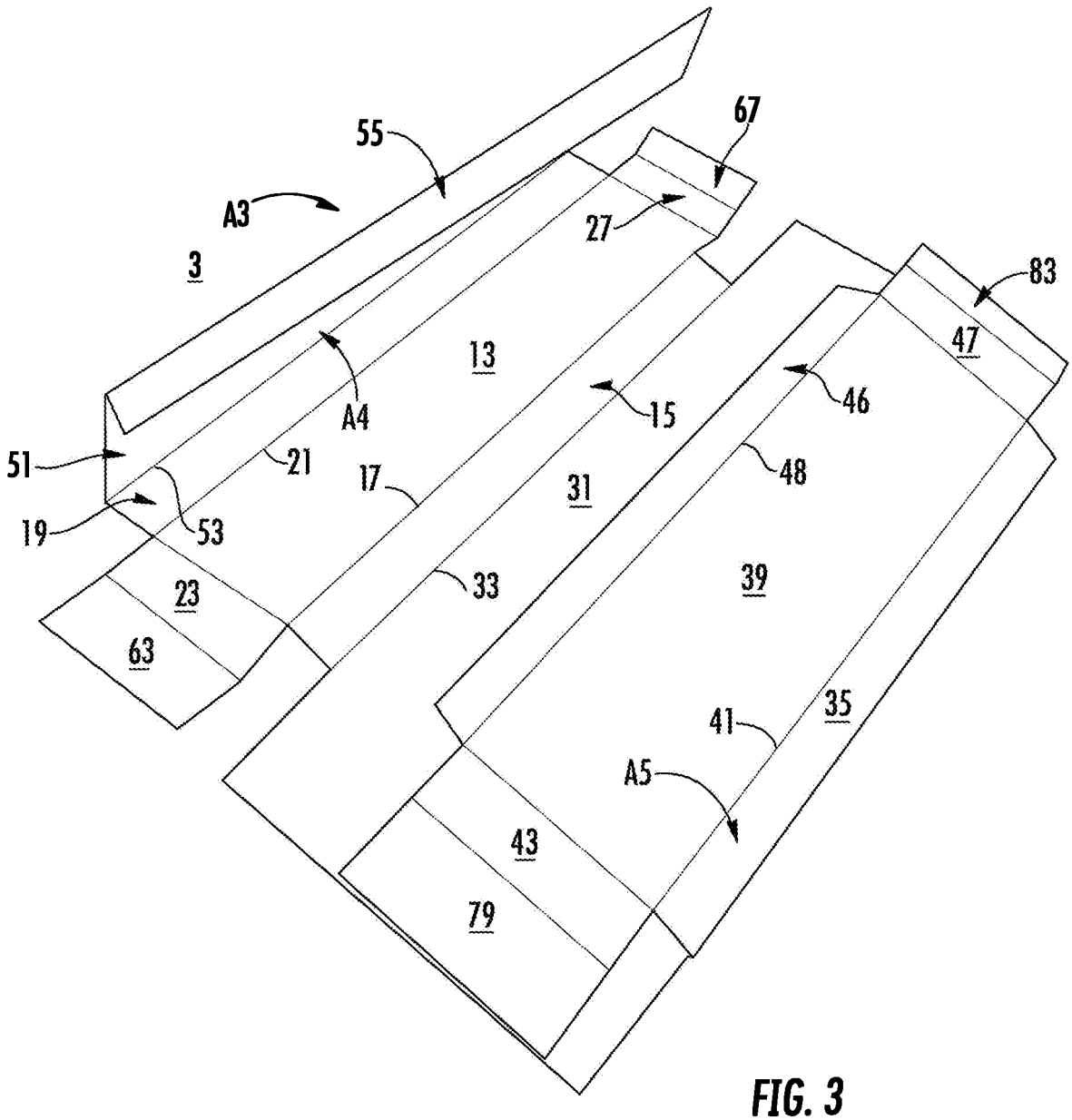
FIG. 3 is a second sequential perspective view of a folding of the blank of FIG. 1 according to an exemplary embodiment of the disclosure.

FIG. 1 is a plan view of the interior side 1 of a blank, generally indicated at 3, used to form a carton 5 (FIG. 7) for containing one or more articles according to a first exemplary embodiment of the disclosure. It will be understood that the carton 5 may be sized and shaped to hold articles items of a different or same quantity in more than one layer and/or in different row/column arrangements (e.g., 1×4, 1×6, 2×3, 3×6, 2×6×2, 3×3×2, 4×5, 3×5, 2×9, 2×6, 3×4, etc.).

As described herein, the carton 5 has a box-like configuration with impact-resistant features 7 extending from one or more ends thereof. As described herein, impact-resistant features 7 can include edges and corners that extend from a body portion 8, e.g., a portion defining an interior 9 for holding one or more items, of the carton 5. As will be discussed in further detail below, the impact-resistant features 7 are configured to deform, e.g., crumple, bend, fold, dent, warp, or otherwise reconfigure, upon impact such that impact forces are received on a portion of the carton 5 other than the body portion 8. The impact-resistant features 7 are also configured to receive impact forces of the carton 5 substantially without deformation or with minimal deformation, for example, through shock absorption and/or dissipation.

As shown in FIG. 1, the carton blank 3 has a longitudinal axis L1 and a lateral axis L2. The blank 3 comprises a first side panel 13 foldably connected to each of a first side impact-resistant panel 15 (broadly, "second impact-resistant panel") at a lateral fold line 17 and a second side impact-resistant panel 19 (broadly, "third impact-resistant panel") at a lateral fold line 21. The first side panel 13, as shown, is also foldably connected to a first top impact-resistant panel 23 (broadly, "first impact-resistant panel") at a longitudinal fold line 25 and a first bottom impact-resistant panel 27 (broadly, "fourth impact-resistant panel") at a longitudinal fold line 29, as described further herein.

As illustrated in FIG. 1, the carton blank 3 includes a second side panel 31 foldably connected to the first side impact-resistant panel 15 at a lateral fold line 33 and foldably connected to a third side impact-resistant panel 35 at a lateral fold line 37. A third side panel 39 is foldably connected to the third side impact-resistant panel 35 at a lateral fold line 41, as shown. The third side panel 39, as shown, is also foldably connected to a second top impact-resistant panel 43 (broadly, "third impact-resistant panel") at a longitudinal fold line 45 and a second bottom impact-resistant panel 47 at a longitudinal fold line 49. A first attachment panel 46, as shown, can be foldably connected to the third side panel 39 at a fold line 48. As shown, the blank 3 also includes a fourth side panel 51 foldably connected to the second side impact-resistant panel 19 at a lateral fold line 53, and foldably connected to a fourth side impact-resistant panel 55 at a lateral fold line 57. The blank 3 can have alternative panel arrangements without departing from the disclosure.

Still referring to FIG. 1, a first top end flap 63 is foldably connected to the first top impact-resistant panel 23 at a longitudinal fold line 65 and a first bottom end flap 67 is foldably connected to the first bottom impact-resistant panel 27 at a longitudinal fold line 69. A second top end flap 71 is foldably connected to the second side panel 31 at a longitudinal fold line 73 and a second bottom end flap 75 is foldably connected to the second side panel 31 at a longitudinal fold line 77, as shown. A third top end flap 79 is foldably connected to the second top impact-resistant panel 43 at a longitudinal fold line 81 and a third bottom end flap 83 is foldably connected to the second bottom impact-resistant panel 47 at a longitudinal fold line 85. As shown, a fourth top end flap 87 is foldably connected to the fourth side panel 51 at a longitudinal fold line 89 and a fourth bottom end flap 91 is foldably connected to the fourth side panel 51 at a longitudinal fold line 93. While the impact-resistant panels 23, 27, 43, 47 have been described as distinct from the respective foldably attached end flaps 63, 67, 79, 83, the impact-resistant panels 23, 27, 43, 47 can be portions of the respective end flaps 63, 67, 79, 83 without departing from the disclosure. The blank 3 can have alternative end flap arrangements without departing from the disclosure.

In the illustrated blank 3, the first top end flap 63 and the first top impact-resistant panel 23, the second top end flap 71, the third top end flap 79 and the second top impact-resistant panel 43, and the fourth top end flap 87 extend along a first marginal area of the blank 3, and the first bottom end flap 67 and the first bottom impact-resistant panel 27, the second top end flap 75, the third bottom end flap 83 and the second bottom impact-resistant panel 47, and the fourth bottom end flap 91 extend along a second marginal area of the blank 3, as shown. One or more of the longitudinal fold lines 65, 25, 73, 81, 45, 89, 29, 69, 77, 49, 85, 93 may be, for example, substantially straight, or offset at one or more locations to account for blank thickness, varying width of the blank panels and flaps, or for other factors. The blank 3 could be otherwise shaped, arranged, and/or configured without departing from the disclosure.

When the carton 5 (FIG. 7) is erected, at least a portion of the respective end flaps 63, 79, 71, 87 at least partially close a first end 11 of the carton 5, and at least a portion of the respective end flaps 67, 83, 75, 91 at least partially close a second end 12 of the carton 5. Different flap arrangements can be used for at least partially closing the ends 11, 12 of the carton 5 without departing from the disclosure.

Still referring to FIG. 1, and referring additionally to FIGS. 2-6, in one exemplary embodiment, the carton 5 can be assembled by placing the blank 3 with the exterior side 1 facing down and folding the impact-resistant panel 55 at the fold line 57 in the direction of the arrow A1 into at least partial face-to-face contact with the fourth side panel 51. As shown, the impact-resistant panel 35 can be folded at the fold line 37 in the direction of the arrow A2 into at least partial face-to-face contact with the second side panel 31, and the third side panel 39 and the attachment flap 46 can thus also be carried into at least partial face-to-face contact with the second side panel 31. The fourth side panel 51 can be folded at the fold line 53 in the direction of the arrow A3 into at least partial face-to-face contact with the impact-resistant panel 19, the first side panel 13, the impact-resistant panel 15, and the second side panel 31, and the impact-resistant panel 55 is thus carried to be disposed in at least partial face-to-face contact with the attachment flap 46. The impact-resistant panel 15 can also be folded at the fold line 33 into at least partial face-to-face contact with the second side panel 31 in the direction of the arrow A3. The impact-resistant panel 55 can be secured to the fourth side panel 51, the attachment flap 46 can be secured to the impact-resistant panel 55, the respective impact-resistant panels 19, 35 can be secured to the respective side panels 51, 31, and the impact-resistant panel 15 can be secured to the second side panel 31 with an adhesive such as glue. The impact-resistant panel 19 can then be folded at the fold line 21 in the direction of the arrow A4 and the third side panel 39 can be folded at the fold line 41 in the direction of the arrow A5 such that the first side panel 13 is in parallel spaced relation with the third side panel 39, and such that the second side panel 31, the impact-resistant panel 15, and the impact-resistant panel 35 are in parallel spaced relation with the fourth side panel 51, the impact-resistant panel 55, the impact-resistant panel 19, and the attachment flap 46 in an open-ended sleeve configuration of the carton 5 that extends at least partially around an interior 9 of the carton 5, as shown. In such an arrangement of the carton 5, the attachment flap 46 can be folded at the fold line 48 toward the interior 9 of the carton 5.

In such an arrangement, the impact-resistant panels 15, 35 are in at least partial face-to-face contact with the second side panel 31 such that the impact-resistant panel 15 and a portion of the second side panel 31 and the impact-resistant panel 35 and a portion of the second side panel 31 extend outwardly, e.g., away from the interior 9, from the carton 5 in a two-ply configuration. Similarly, the impact-resistant panels 55, 19 are each in at least partial face-to-face contact with the fourth side panel 51 such that the impact-resistant panel 55 and a portion of the fourth side panel 51 and the impact-resistant panel 19 and a portion of the fourth side panel 51 extend outwardly from the carton 5 in a two-ply configuration.

Figure 4:
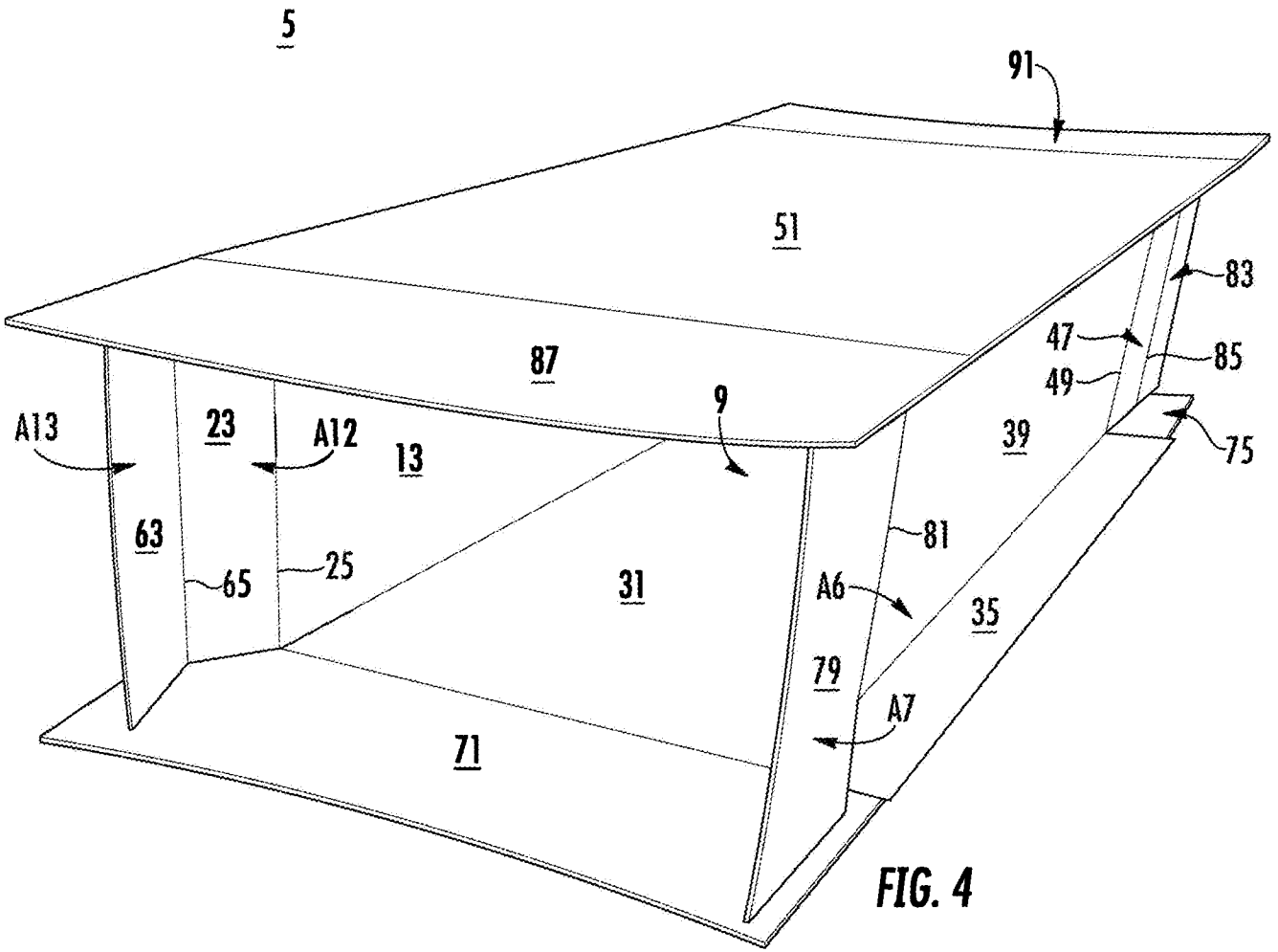
FIG. 4 is a third sequential perspective view of a folding of the blank of FIG. 1 according to an exemplary embodiment of the disclosure.
Figure 5:
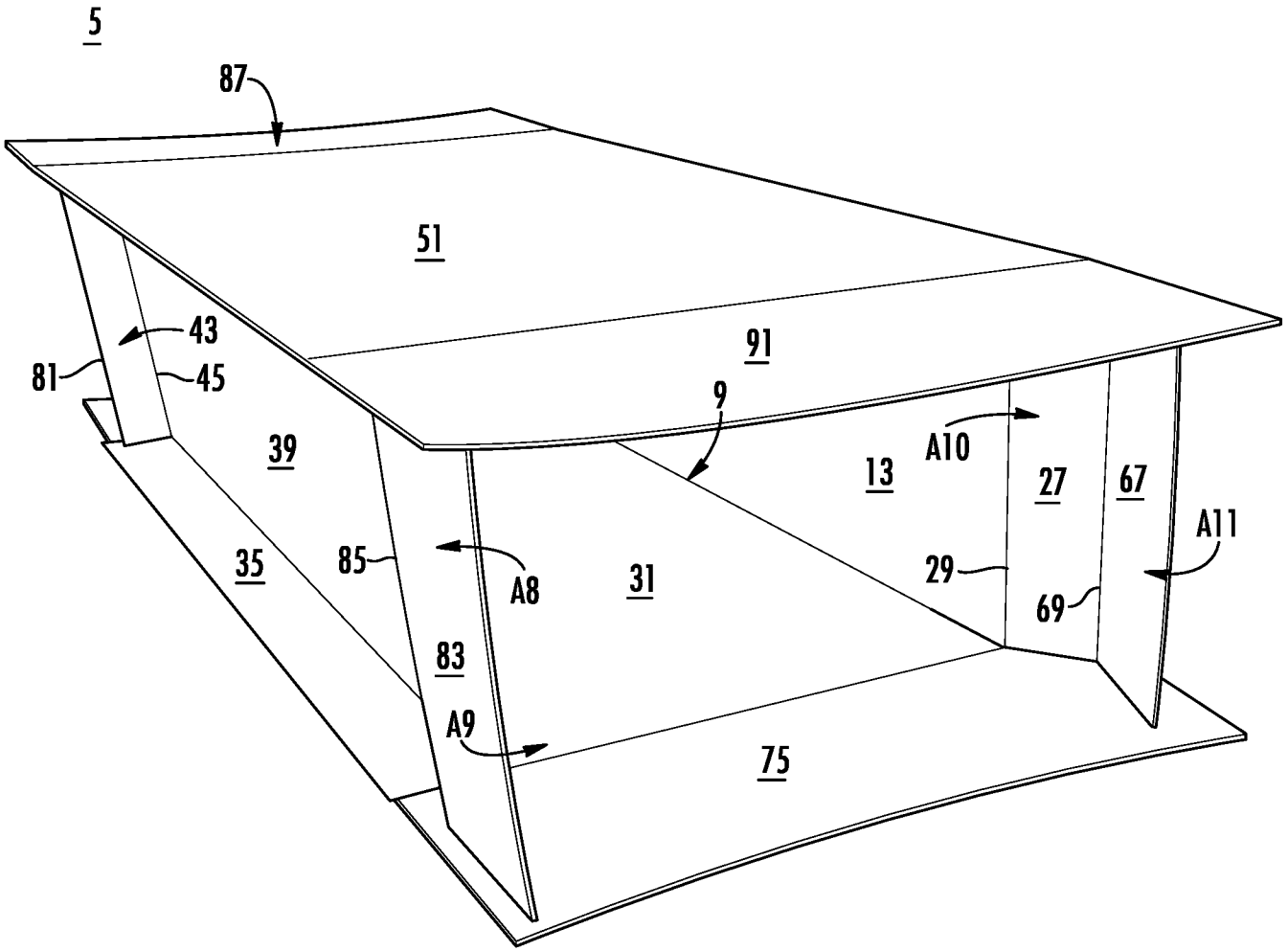
FIG. 5 is a fourth sequential perspective view of a folding of the blank of FIG. 1 according to an exemplary embodiment of the disclosure.

Still referring to FIG. 1, and as shown in FIGS. 4 and 5, the impact-resistant panel 43 can be folded outwardly, e.g., away from the interior 9, from the carton 5 at the fold line 45 in the direction of the arrow A6 with the end flap 79 folded inwardly, e.g., toward the interior 9, at the fold line 81 in the direction of the arrow A7 in at least partial face-to-face contact with the impact-resistant panel 43 and the impact-resistant panel 47 can similarly be folded outwardly from the carton 5 at the fold line 49 in the direction of the arrow A8 with the end flap 83 folded inwardly toward the carton 5 at the fold line 85 in the direction of the arrow A9 in at least partial face-to-face contact with the impact-resistant panel 47, and such that the impact-resistant panel 43 and a portion of the end flap 79, and the impact-resistant panel 47 and a portion of the end flap 83 extend away from the side panel 39 in a two-ply configuration, as shown. Similarly, the impact-resistant panel 27 can be folded outwardly from the carton 5 at the fold line 29 in the direction of the arrow A10 with the end flap 67 folded inwardly toward the carton 5 at the fold line 69 in the direction of the arrow A11 in at least partial face-to-face contact with the impact-resistant panel 27 and the impact-resistant panel 23 can folded outwardly from the carton 5 at the fold line 25 in the direction of the arrow A12 with the end flap 63 folded inwardly toward the carton 5 at the fold line 65 in the direction of the arrow A13 in at least partial face-to-face contact with the impact-resistant panel 23 such that the impact-resistant panel 23 and a portion of the end flap 63, and the impact-resistant panel 27 and a portion of the end flap 67 extend away from the side panel 13 in a two-ply configuration, as shown.

Figure 6:
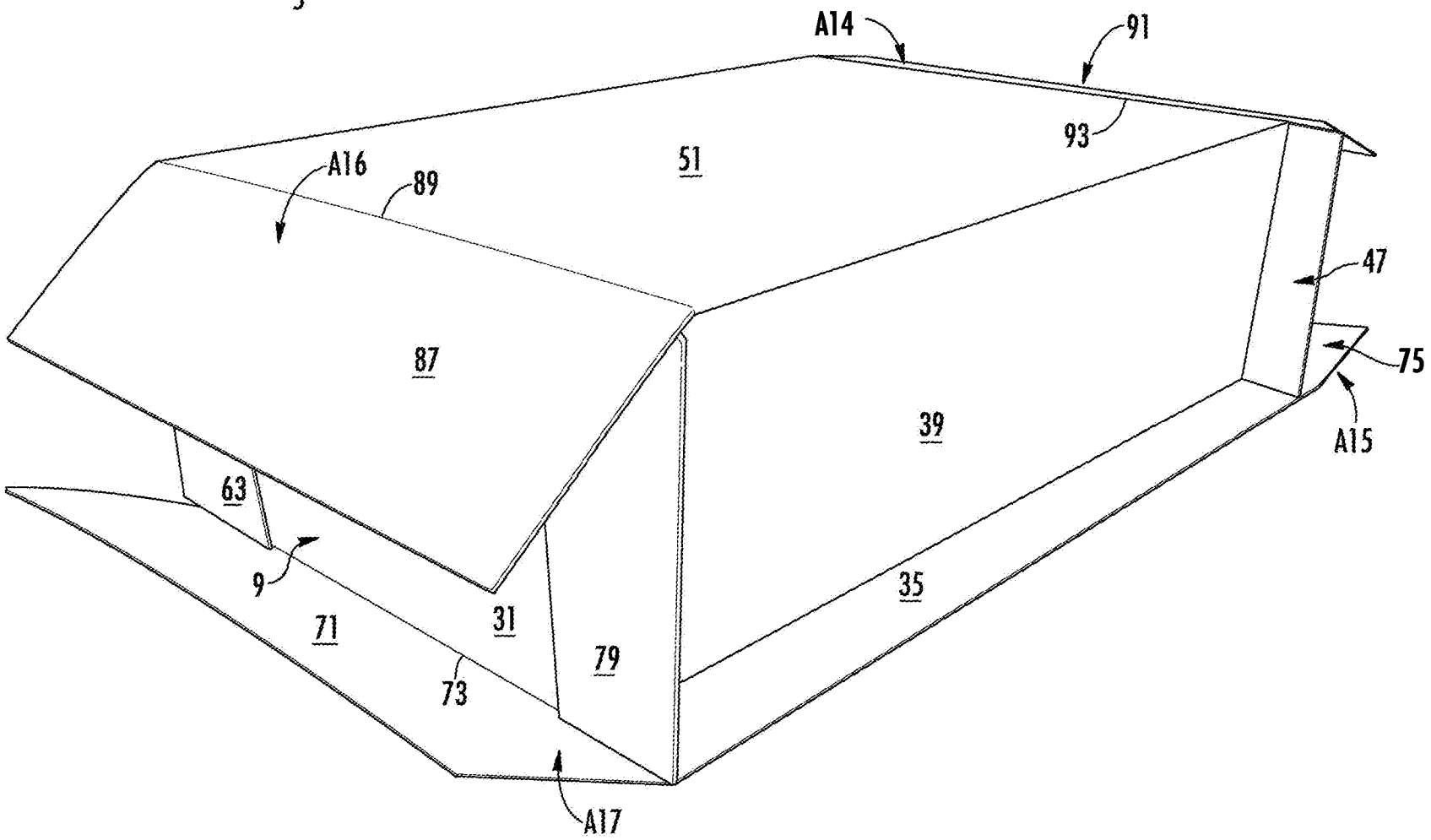
FIG. 6 is a fifth sequential perspective view of a folding of the blank of FIG. 1 according to an exemplary embodiment of the disclosure.
Figure 7:
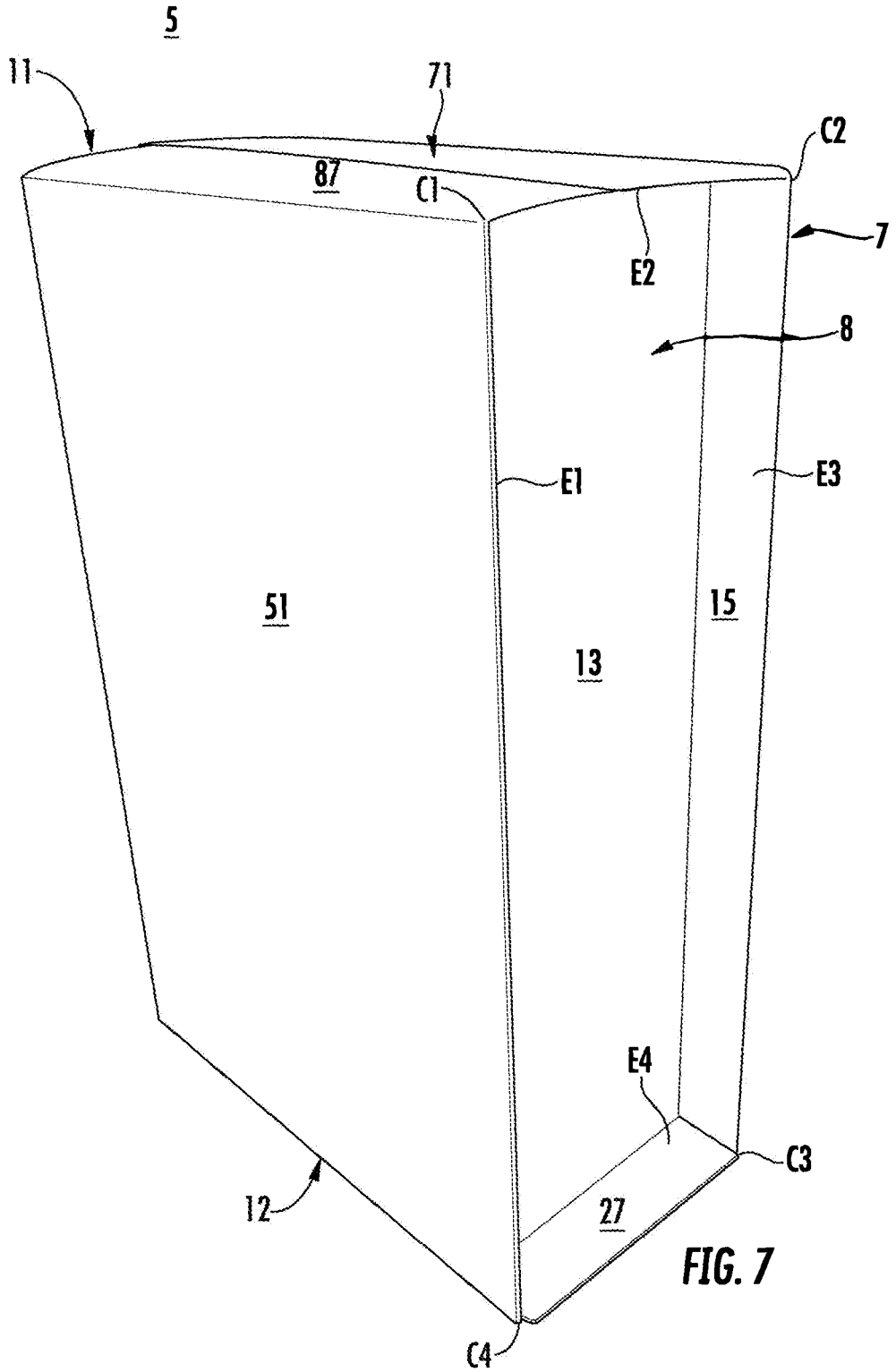
FIG. 7 is a perspective view of a carton formed from the blank of FIG. 1 according to an exemplary embodiment of the disclosure.
Figure 8:
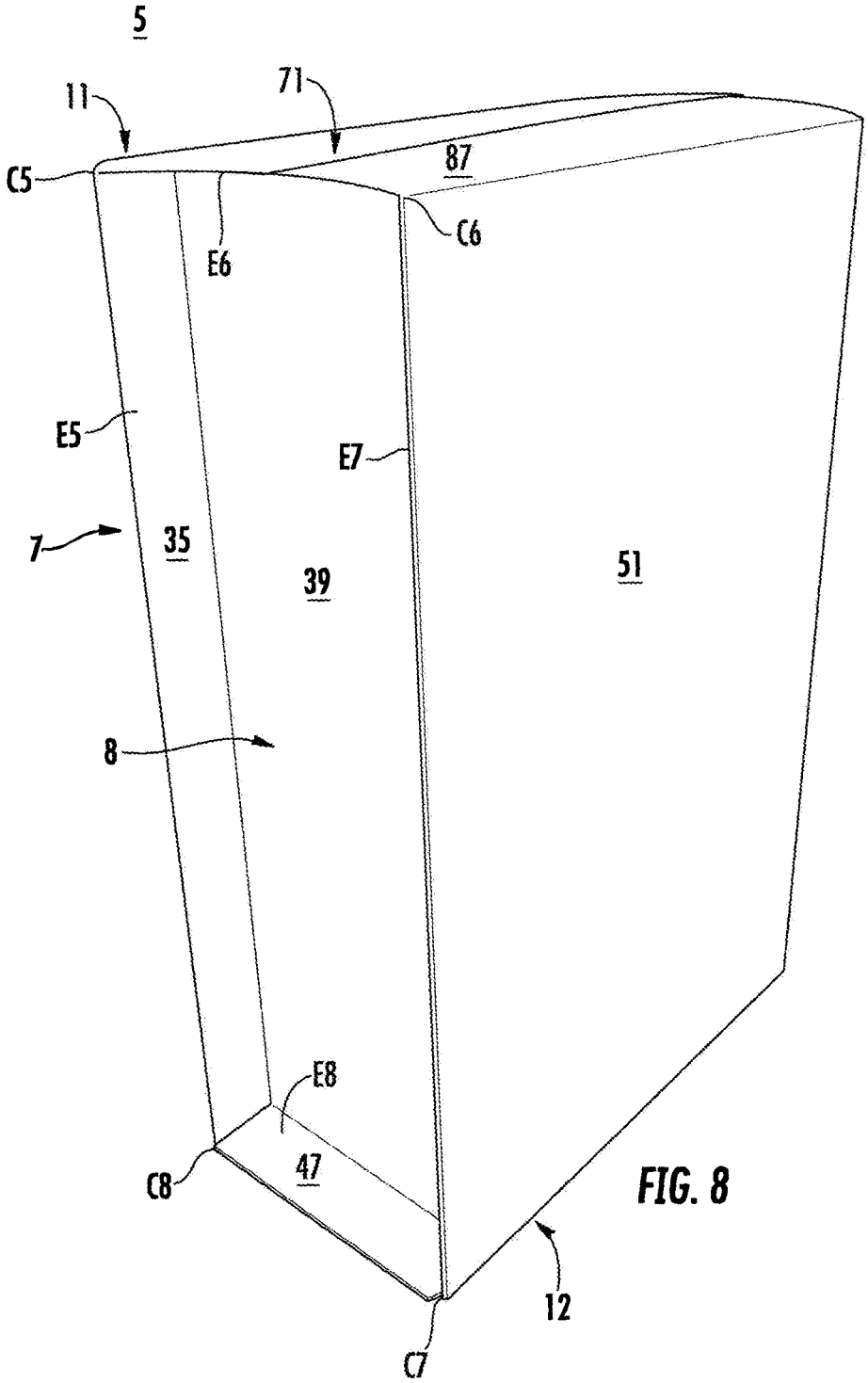
FIG. 8 is another perspective view of the carton of FIG. 7.

Turning additionally to FIGS. 6-8, the end flaps 91, 75 can be folded at respective fold lines 93, 77 in the direction of the respective arrows A14, A15 in at least partial face-to-face contact with a portion of the end flaps 67, 83 to form the second closed end 12 of the carton 5 and the end flaps 87, 71 can be folded at respective fold lines 89, 73 in the directions of the respective arrows A16, A17 in at least partial face-to-face contact with a portion of the end flaps 63, 79 to form the first closed end 11 of the carton 5.

In this regard, the carton 5 is provided with the respective impact-resistant panels 55, 19 and respective portions of the side panel 51, the respective impact-resistant panels 15, 35 and respective portions of the side panel 31, the impact-resistant panels 43, 47 and respective portions of the end flaps 79, 83, and the impact-resistant panels 23, 27 and respective portions of the end flaps 63, 67 each in a two-ply configuration and forming impact-resistant features 7 extending away from the body portion 8 of the carton 5 that is formed at least by portions of the side panels 13, 31, 39, 51 and which can also include portions of the end flaps 63, 67, 79, 83, 71, 75, 87, and 91. The impact-resistant features 7 proximate the panel 13, as shown, include a first extension E1 formed by the impact-resistant panel 19 in face-to-face contact with a portion of the panel 51, a second extension E2 formed by the impact-resistant panel 23 in face-to-face contact with a portion of the end flap 63, a third extension E3 formed by the impact-resistant panel 15 in face-to-face contact with a portion of the panel 31, and a fourth extension E4 formed by the impact-resistant panel 27 in face-to-face contact with a portion of the end flap 67, and with the first extension E1 and the second extension E2 intersecting at a first corner C1, the second extension E2 and the third extension E3 intersecting at a second corner C2, the third extension E3 and the fourth extension E4 intersecting at a third corner C3, and the fourth extension E4 and the first extension E1 intersecting at a fourth corner C4, as shown. As also shown, the impact-resistant features 7 proximate the panel 39 include a fifth extension E5 formed by the impact-resistant panel 35 in face-to-face contact with a portion of the panel 31, a sixth extension E6 formed by the impact-resistant panel 43 in face-to-face contact with a portion of the end flap 79, a seventh extension E7 formed by the impact-resistant panel 55 in face-to-face contact with a portion of the panel 51, and an eighth extension E8 formed by the impact-resistant panel 47 in face-to-face contact with a portion of the end flap 83, and with the fifth extension E5 and the sixth extension E6 intersecting at a fifth corner C5, the sixth extension E6 and the seventh extension E7 intersecting at a sixth corner C6, the seventh extension E7 and the eighth extension E8 intersecting at a seventh corner C7, and the eighth extension E8 and the fifth extension E5 intersecting at an eighth corner C8, as shown. Such extensions E1, E2, E3, E4, E5, E6, E7, and E8 and corners C1, C2, C3, C4, C5, C6, C7, and C8 and/or other portions of impact-resistant features 7 provide greater resistance to impacts, e.g., impacts with surfaces due to falling or shifting during transport and/or external loads such as adjacent stacked cartons, than other portions of the carton 5, for example, greater shock absorption. The impact-resistant features 7 are configured to deform such that the effect of impacts on the body portion 8 of the carton 5, e.g., the portion of the carton 5 containing articles therein, is reduced, minimized, and/or prevented. In this regard, one or more of the extensions E1, E2, E3, E4, E5, E6, E7, and E8 and the corners C1, C2, C3, C4, C5, C6, C7, and C8 is configured to deform, e.g., crumple, bend, fold, dent, warp, or otherwise reconfigure, upon impact such that impact forces are received on a portion of the carton 5 other than the body portion 8. The extensions E1, E2, E3, E4, E5, E6, E7, and E8 and the corners C1, C2, C3, C4, C5, C6, C7, and C8 can also absorb, buffer, and/or otherwise protect the body portion 8 of the carton 5 from one or more impact forces substantially without deformation.

Figure 9:
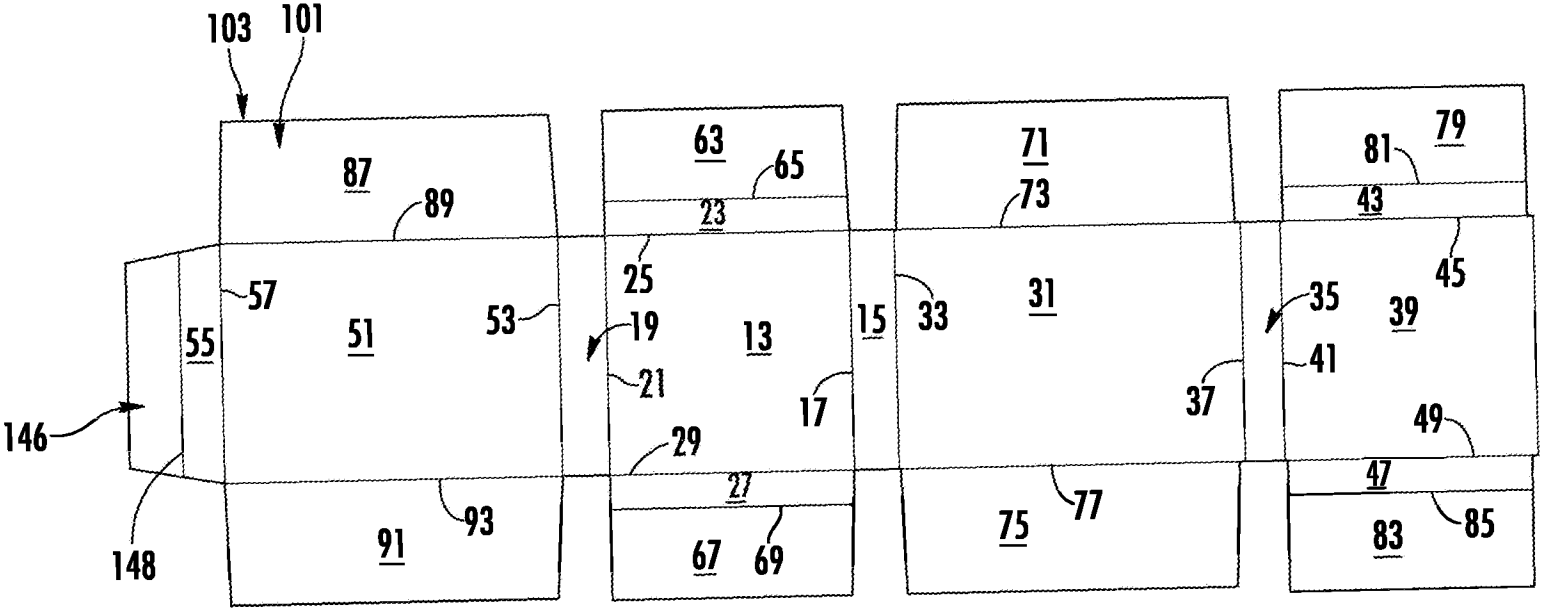
FIG. 9 is a plan view of an interior surface of a blank for forming a carton according to a second exemplary embodiment of the disclosure.
Figure 10:
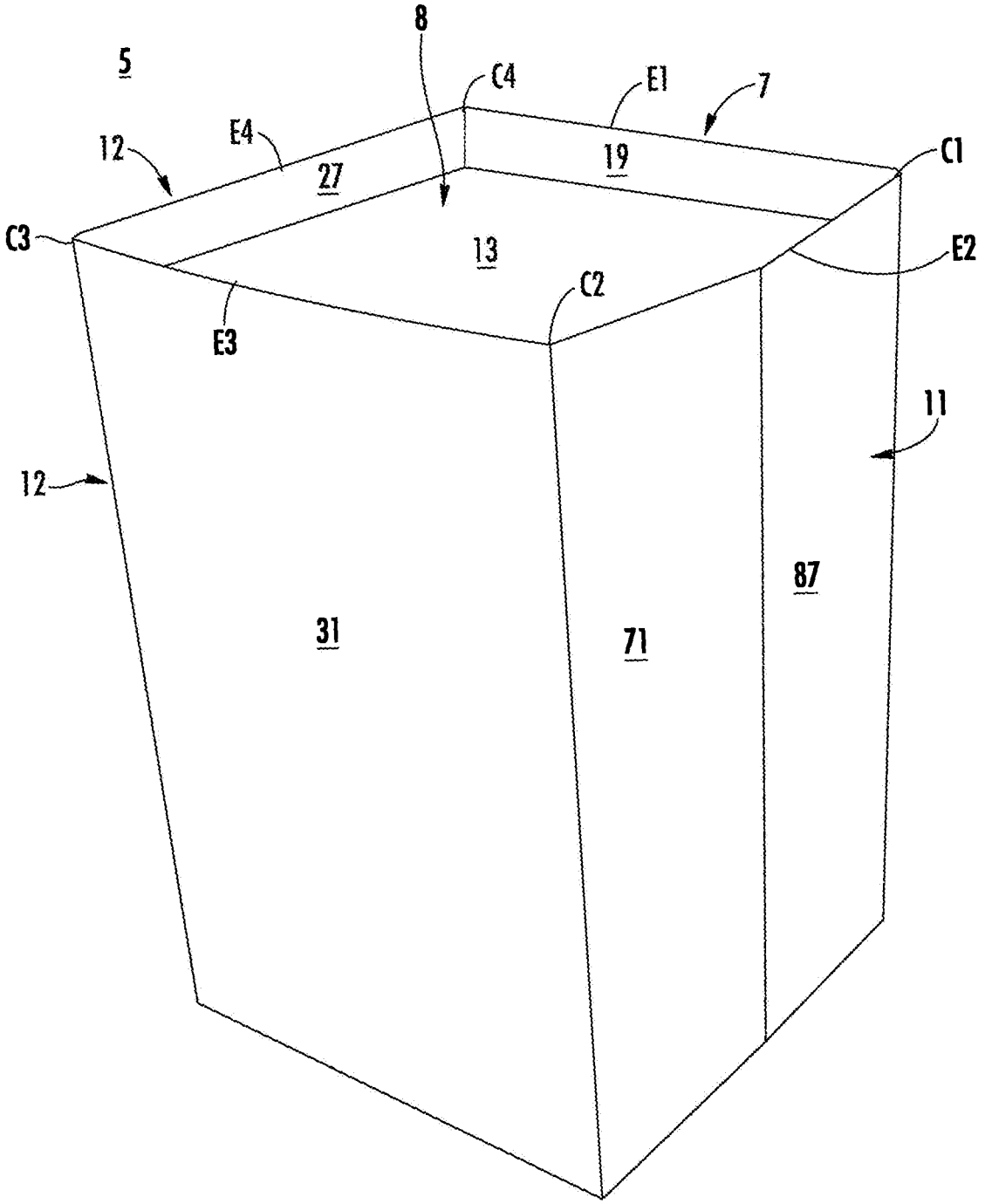
FIG. 10 is a perspective view of a carton formed from the blank of FIG. 9 according to an exemplary embodiment of the disclosure.
Figure 11:
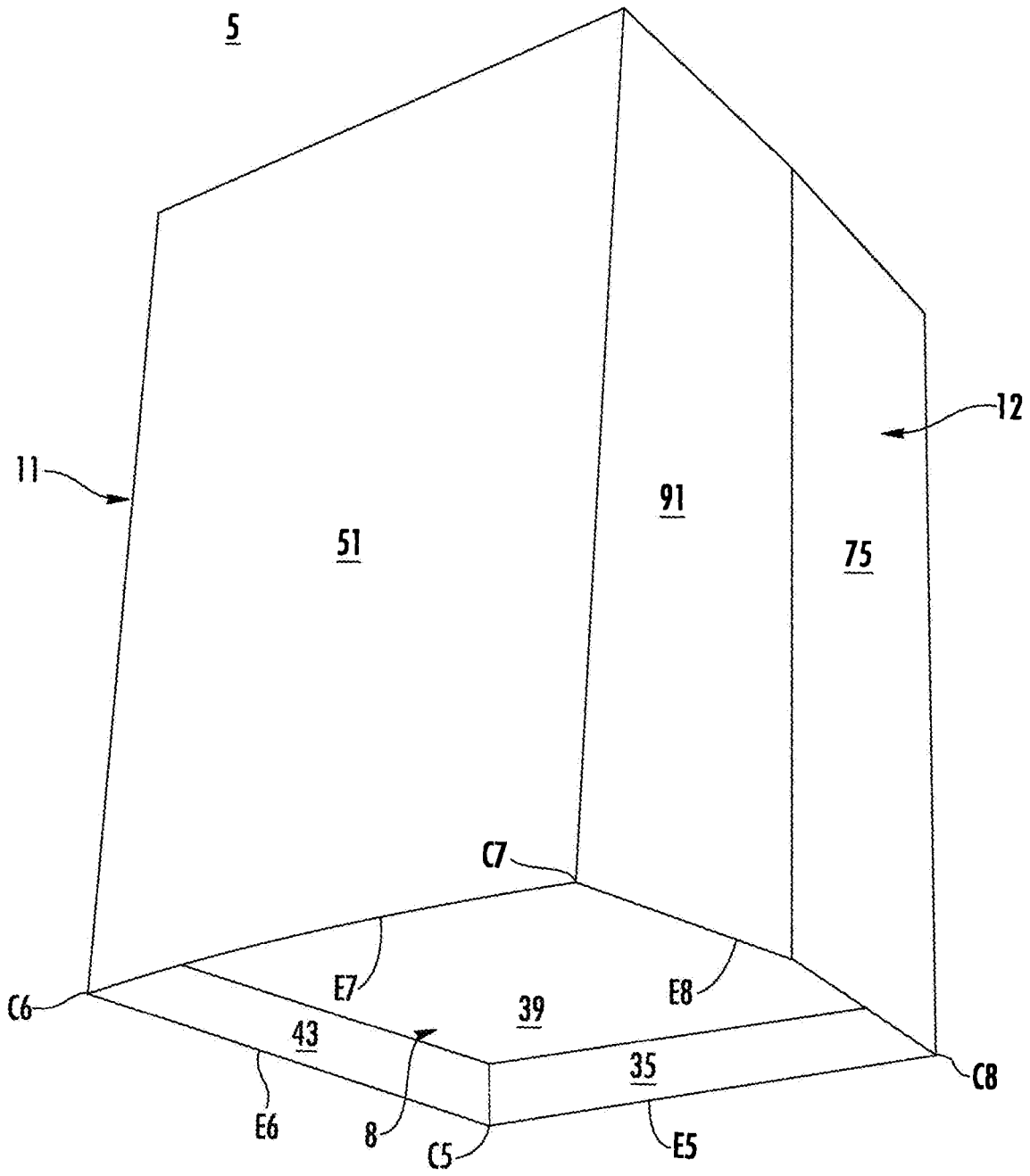
FIG. 11 is another perspective view of a carton of FIG. 10.

Turning to FIGS. 9-11, an interior surface 101 of a blank 103 and a carton 105 formed therefrom are illustrated according to a second exemplary embodiment of the disclosure. The blank 103 and the carton 105 can have one or more substantially similar features to the blank 3 (FIG. 1) and carton 5 (FIG. 7) of the first exemplary embodiment of the disclosure, and like or similar components are referenced with like or similar reference numbers. As shown, the blank 103 includes an attachment flap 146 foldably connected to the impact-resistant panel 55 at a lateral fold line 148 for facilitating formation of the carton 105 upon folding of the blank 103, as opposed to an attachment flap connected to the side panel 39. In the blank 103, the first side panel 13 can be a top panel and the third side panel 39 can be a bottom panel. It will be understood that the blank 103 can be differently-arranged without departing from the disclosure.

As shown, the blank 103 is folded into the carton 105 such that the body portion 8 is formed with the impact-resistant features 7 extending away from the body portion 8 of the carton 105 that is formed at least by the panels 13, 31, 39, 51 and which can also include the end flaps 63, 67, 79, 83, 71, 75, 87, and 91. The impact-resistant features 7, as shown, include the extensions E1, E2, E3, and E4 intersecting at the corners C1, C2, C3, and C4 proximate the panel 13, and the extensions E5, E6, E7, and E8 intersecting at the corners C5, C6, C7, and C8 proximate the panel 39. Such extensions E1, E2, E3, E4, E5, E6, E7, and E8 and corners C1, C2, C3, C4, C5, C6, C7, and C8 and/or other portions of impact-resistant features 7 provide resistance to impacts as described above with respect to the carton 5 (FIG. 7).

Figure 12:
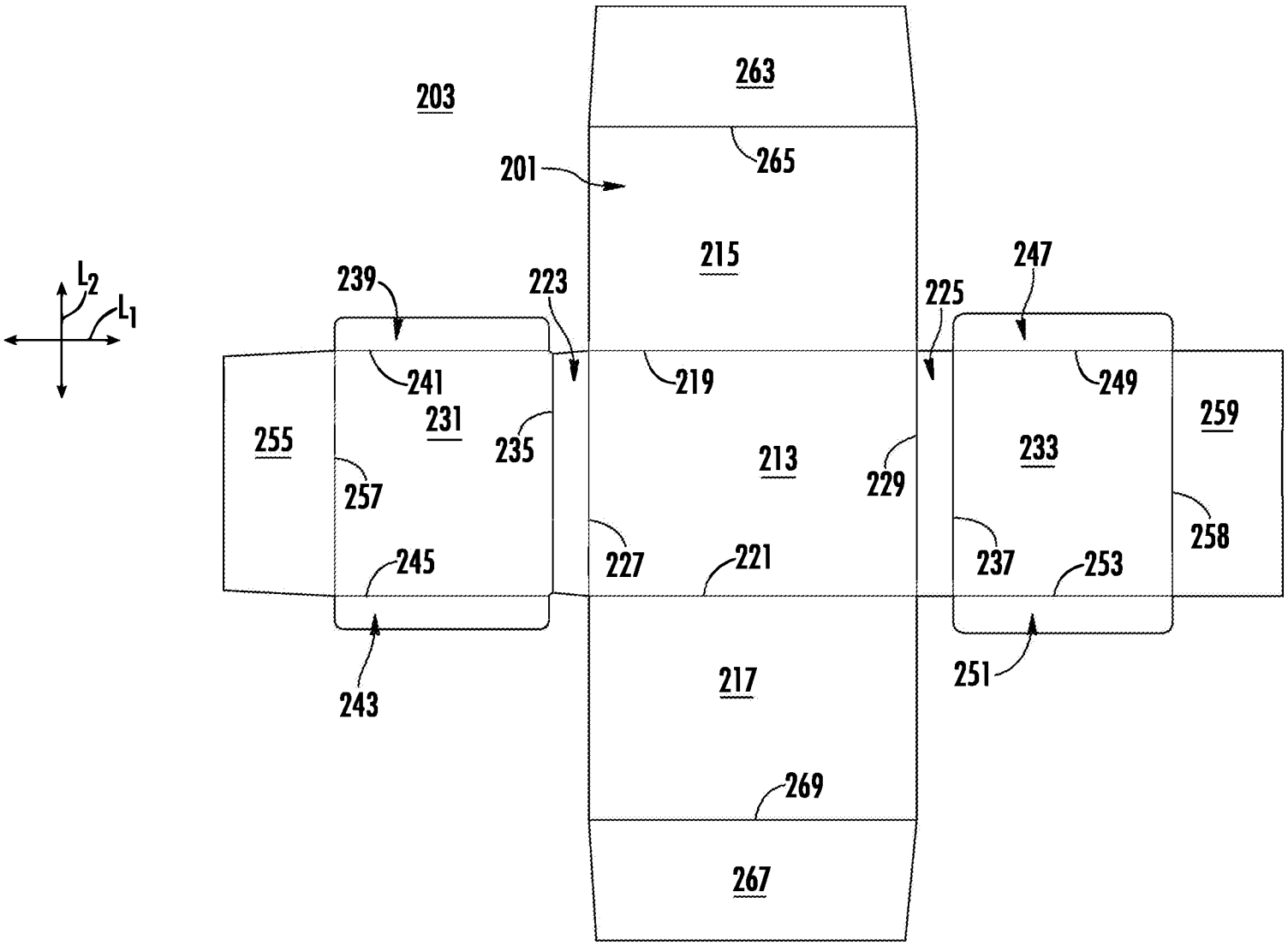
FIG. 12 is a plan view of an interior surface of a blank for forming a carton according to a third exemplary embodiment of the disclosure.
Figure 13:
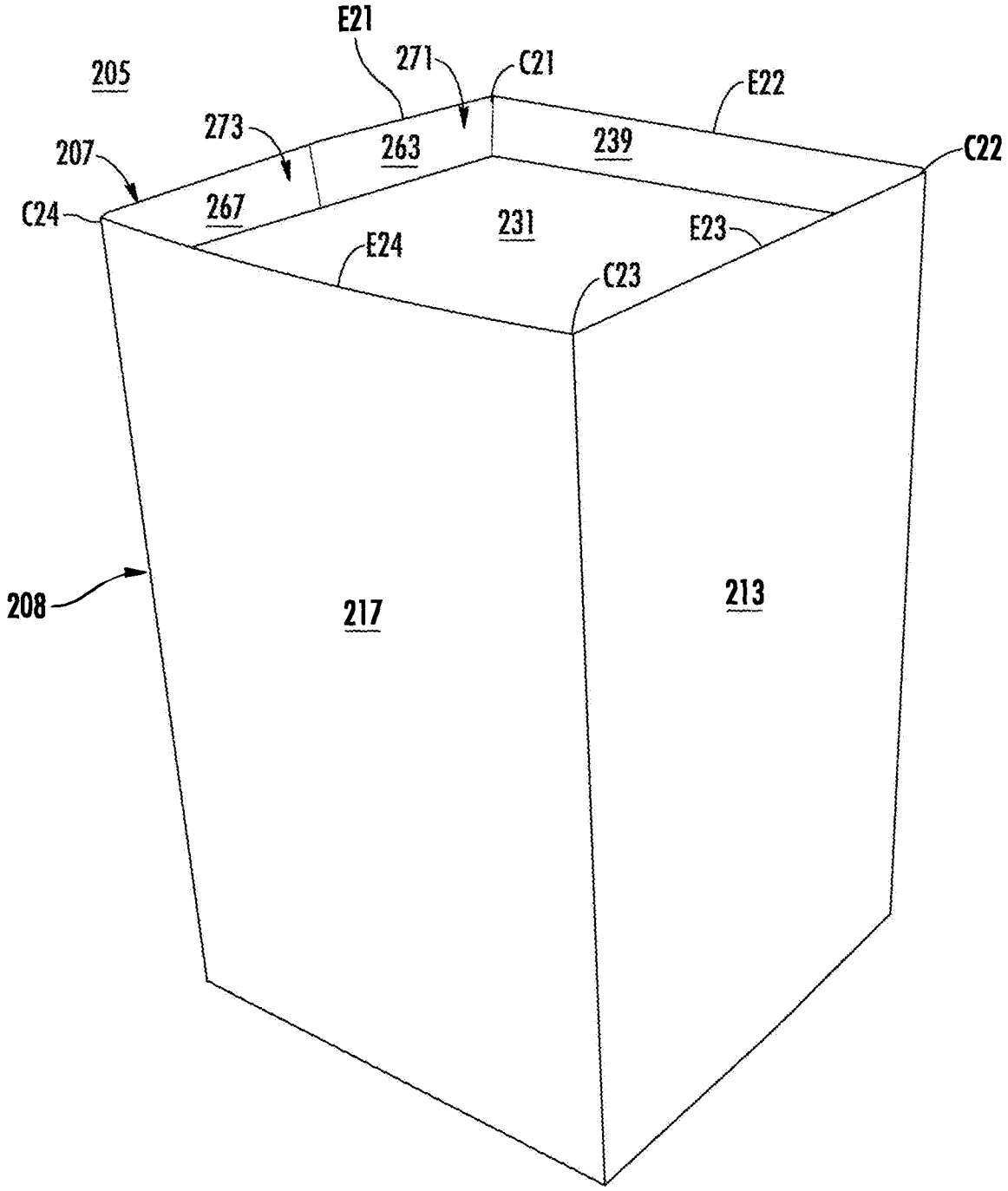
FIG. 13 is a perspective view of a carton formed from the blank of FIG. 12 according to an exemplary embodiment of the disclosure.
Figure 14:
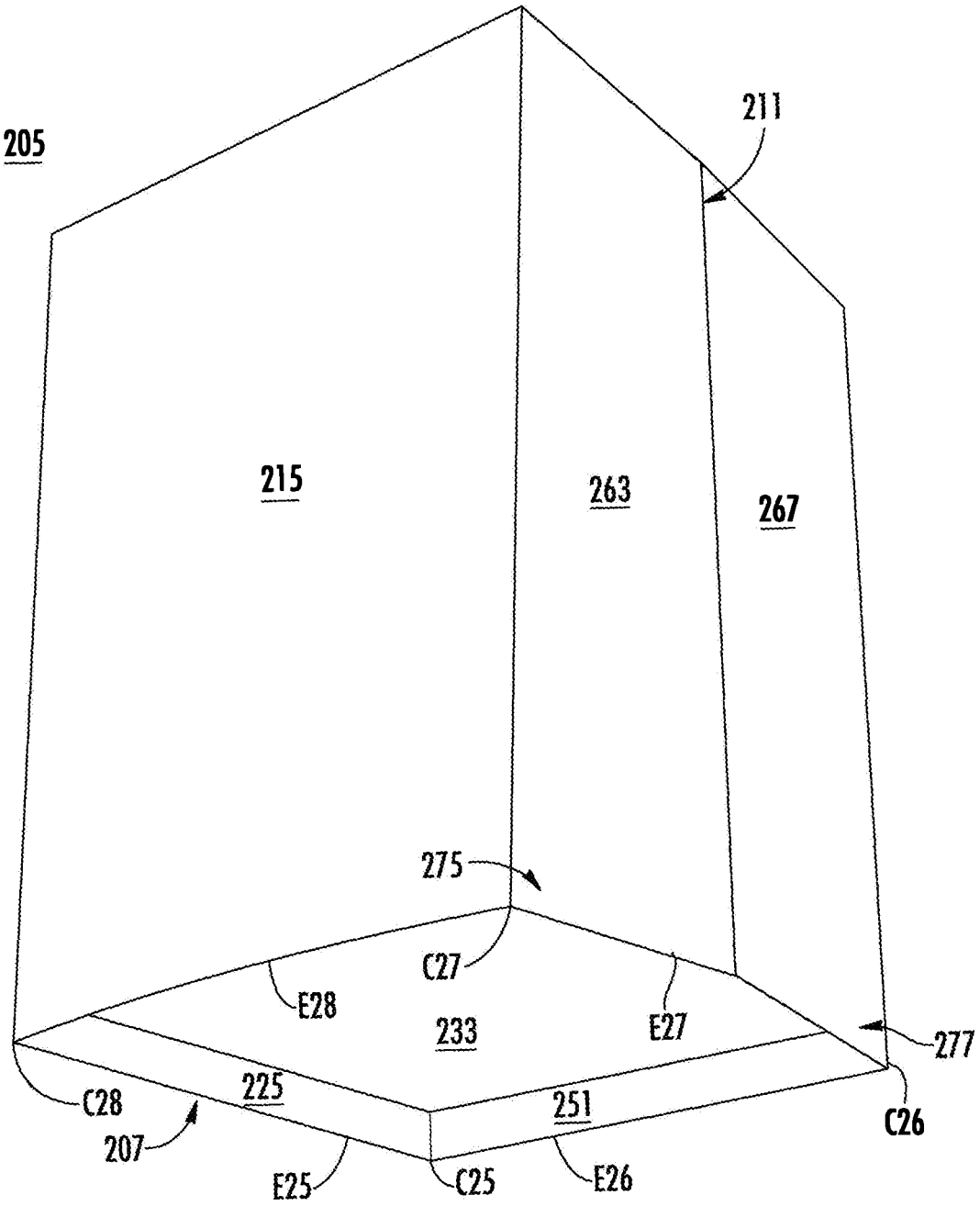
FIG. 14 is another perspective view of the carton of FIG. 13.

Turning to FIGS. 12-14, a blank 203 and a carton 205 formed therefrom are illustrated according to a third exemplary embodiment of the disclosure. The blank 203 and the carton 205 can have one or more substantially similar features to the blanks 3, 103 (FIGS. 1 and 9) and the cartons 5, 105 (FIGS. 7 and 10) of the first and second exemplary embodiments of the disclosure, and like or similar components are referenced with like or similar reference numbers. As shown, the blank 203 includes a bottom panel 213 foldably connected to a first side panel 215 and to a second side panel 217 at respective longitudinal fold lines 219, 221. The bottom panel 213, as shown, is also foldably connected to each of a first impact-resistant panel 223 and a second impact-resistant panel 225 at respective lateral fold lines 227, 229. Respective first and second end panels 231, 233, as shown, are foldably connected to the respective first and second impact-resistant panel 223, 225 at respective lateral fold lines 235, 237. As also shown, a third impact-resistant panel 239 is foldably connected to the first end panel 231 at a longitudinal fold line 241 and a fourth impact-resistant panel 243 is foldably connected to the first end panel 231 at a longitudinal fold line 245. Similarly, a fifth impact-resistant panel 247 is foldably connected to the second end panel 233 at a longitudinal fold line 249 and a sixth impact-resistant panel 251 is foldably connected to the second end panel 233 at a longitudinal fold line 253. It will be understood that the blank 203 can be differently-arranged without departing from the disclosure.

Still referring to FIG. 12, a first end flap 255 is foldably connected to the first end panel 231 at a lateral fold line 257 and a second end flap 259 is foldably connected to the second end panel 233 at a lateral fold line 258. As shown, a third end flap 263 is foldably connected to the first side panel 215 at a longitudinal fold line 265 and a fourth end flap 267 is foldably connected to the second side panel 217 at a longitudinal fold line 269.

Still referring to FIGS. 12-14, the blank 203 is folded such that the respective impact-resistant panels 223, 225 are folded at respective fold lines 227, 229 into at least partial face-to-face contact with the bottom panel 213 and the respective end panels 231, 233 are folded at the respective fold lines 235, 237 to be substantially upright, e.g., perpendicular, relative to the bottom panel 213 and to be in spaced planar parallel relation with one another. The respective impact-resistant panels 239, 243, 247, 251 can also be folded away from the interior of the blank 203 at respective fold lines 241, 245, 249, 253 to each extend in perpendicular relation to both the end panels 231, 233 and the bottom panel 213. The respective side panels 215, 217 can be folded upwardly relative to the bottom panel 213 at the respective fold lines 219, 221 to be in spaced parallel planar relation to one another and such that the impact-resistant panels 239, 247 are in at least partial face-to-face contact with the side panel 215 and such that the impact-resistant panels 243, 251 are in at least partial face-to-face contact with the side panel 217. Thereafter, the respective end flaps 255, 259 can be folded toward the interior of the blank 203 at the respective fold lines 257, 258 and the respective end flaps 263, 267 can be folded at the respective fold lines 265, 269 into at least partial face-to-face contact with the respective end flaps 255, 259 to form a closed end of the carton 205 and such that the end flaps 255, 259, 263, 267 are in planar parallel spaced relation with the bottom panel 213 and at least partially forming a closed end 211 of the carton 205.

In this regard, and as shown, the blank 203 is folded into the carton 205 such that the body portion 208 is formed at least partially by the panels 213, 231, 233, 215, 217, and can also be at least partially formed by portions of the end flaps 263, 267, 255, 259, and with the impact-resistant features 207 extending away from the body portion 208 of the carton 205. The impact-resistant features 207 include the impact-resistant panels 223, 225 in face-to-face contact with portions of the bottom panel 213 in a two-ply configuration, the impact-resistant panels 239, 247 in face-to-face contact with portions of the side panel 215 in a two-ply configuration, and the impact-resistant panels 243, 251 in face-to-face contact with portions of the side panel 217 in a two-ply configuration, respective upper portions 271, 273 of the respective end flaps 263, 267 that extend above the end panel 231 in the assembled carton 205 in a single-ply configuration, and respective lower portions 275, 277 of the respective end flaps 263, 267 that extend below the end panel 233 in the assembled carton 205 in a single-ply configuration. The impact-resistant features 207 proximate the panel 231, as shown, include a first extension E21 formed by the respective upper portions 271, 273 of the respective end flaps 263, 267, a second extension E22 formed by the impact-resistant panel 239 in face-to-face contact with a portion of the panel 215, a third extension E23 formed by the impact-resistant panel 223 in face-to-face contact with a portion of the panel 213, and a fourth extension E24 formed by the impact-resistant panel 243 in face-to-face contact with a portion of the panel 217, and with the first extension E21 and the second extension E22 intersecting at a first corner C21, the second extension E22 and the third extension E23 intersecting at a second corner C22, the third extension E23 and the fourth extension E24 intersecting at a third corner C23, and the fourth extension E24 and the first extension E21 intersecting at a fourth corner C24, as shown. The impact-resistant features 207 proximate the panel 233, as shown, include a fifth extension E25 formed by the impact-resistant panel 225 and a portion of the panel 213, a sixth extension E26 formed by the impact-resistant panel 251 in face-to-face contact with a portion of the panel 217, a seventh extension E27 formed by respective lower portions 275, 277 of the respective end flaps 263, 267, and an eighth extension E28 formed by the impact-resistant panel 247 in face-to-face contact with a portion of the panel 215, and with the fifth extension E25 and the sixth extension E26 intersecting at a fifth corner C25, the sixth extension E26 and the seventh extension E27 intersecting at a sixth corner C26, the seventh extension E27 and the eighth extension E28 intersecting at a seventh corner C27, and the eighth extension E28 and the fifth extension E25 intersecting at an eighth corner C28, as shown. Such extensions E21, E22, E23, E24, E25, E26, E27, and E28 and corners C21, C22, C23, C24, C25, C26, C27, and C28 and/or other portions of impact-resistant features 207 provide resistance to impacts as described above with respect to the cartons 5, 105 (FIGS. 7 and 10).

Figure 15:
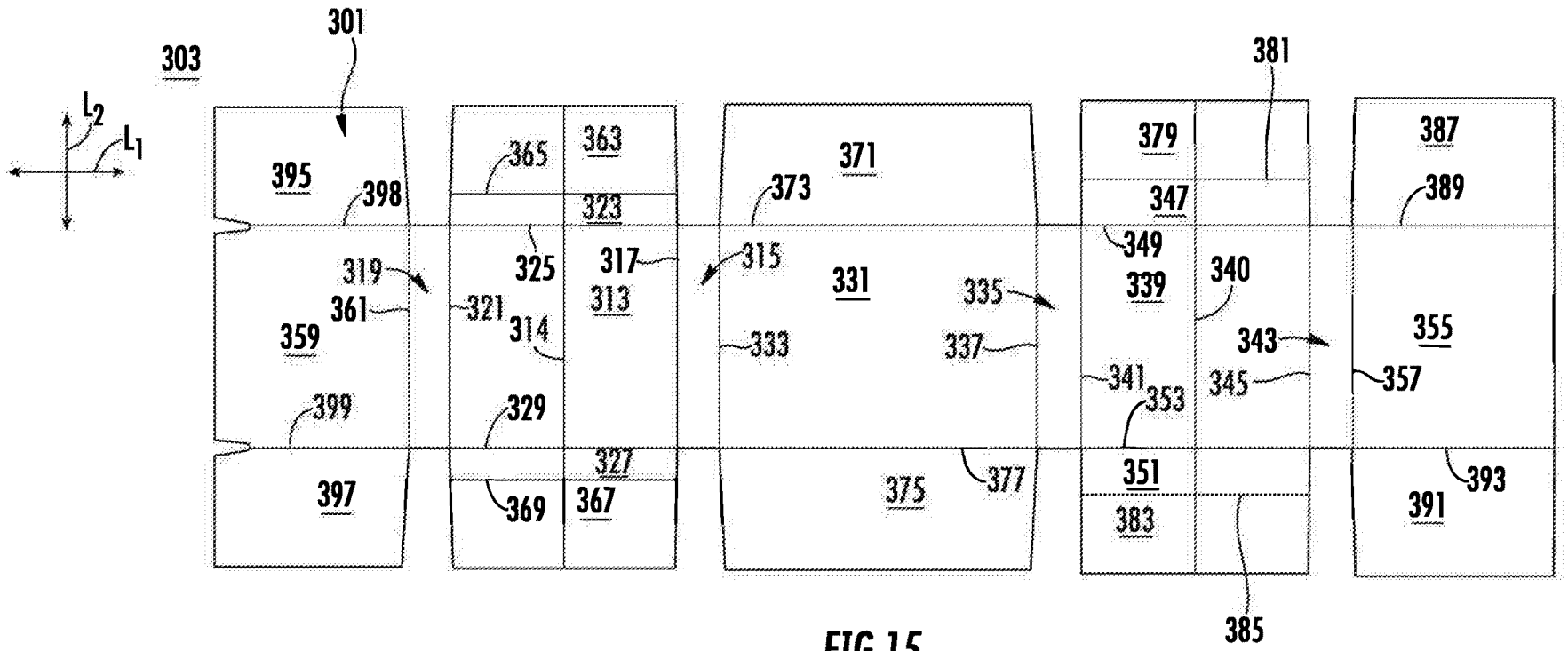
FIG. 15 is a plan view of an interior surface of a blank for forming a carton according to a fourth exemplary embodiment of the disclosure.

FIG. 15 is a plan view of the interior side 301 of a blank, generally indicated at 303, used to form a carton 305 (FIG. 16), according to a fourth exemplary embodiment of the disclosure. The blank 303 and the carton 305 can have one or more substantially similar features to the blanks 3, 103, 203 (FIGS. 1, 9, and 12) and the cartons 5, 105, 205 (FIGS. 7, 10, and 13) of the first, second, and third exemplary embodiments of the disclosure, and like or similar components are referenced with like or similar reference numbers. As shown, the carton blank 303 has the longitudinal axis L1 and the lateral axis L2. The blank 303 comprises a top panel 313 having an intermediate lateral fold line 314, e.g., a backfold or relief fold line, and the top panel 313 is foldably connected to a first top impact-resistant panel 315 at a lateral fold line 317 and a second top impact-resistant panel 319 at a lateral fold line 321. The top panel 313, as shown, is also foldably connected to a third top impact-resistant panel 323 at a longitudinal fold line 325 and a fourth top impact-resistant panel 327 at a longitudinal fold line 329, as described further herein.

Figure 16:
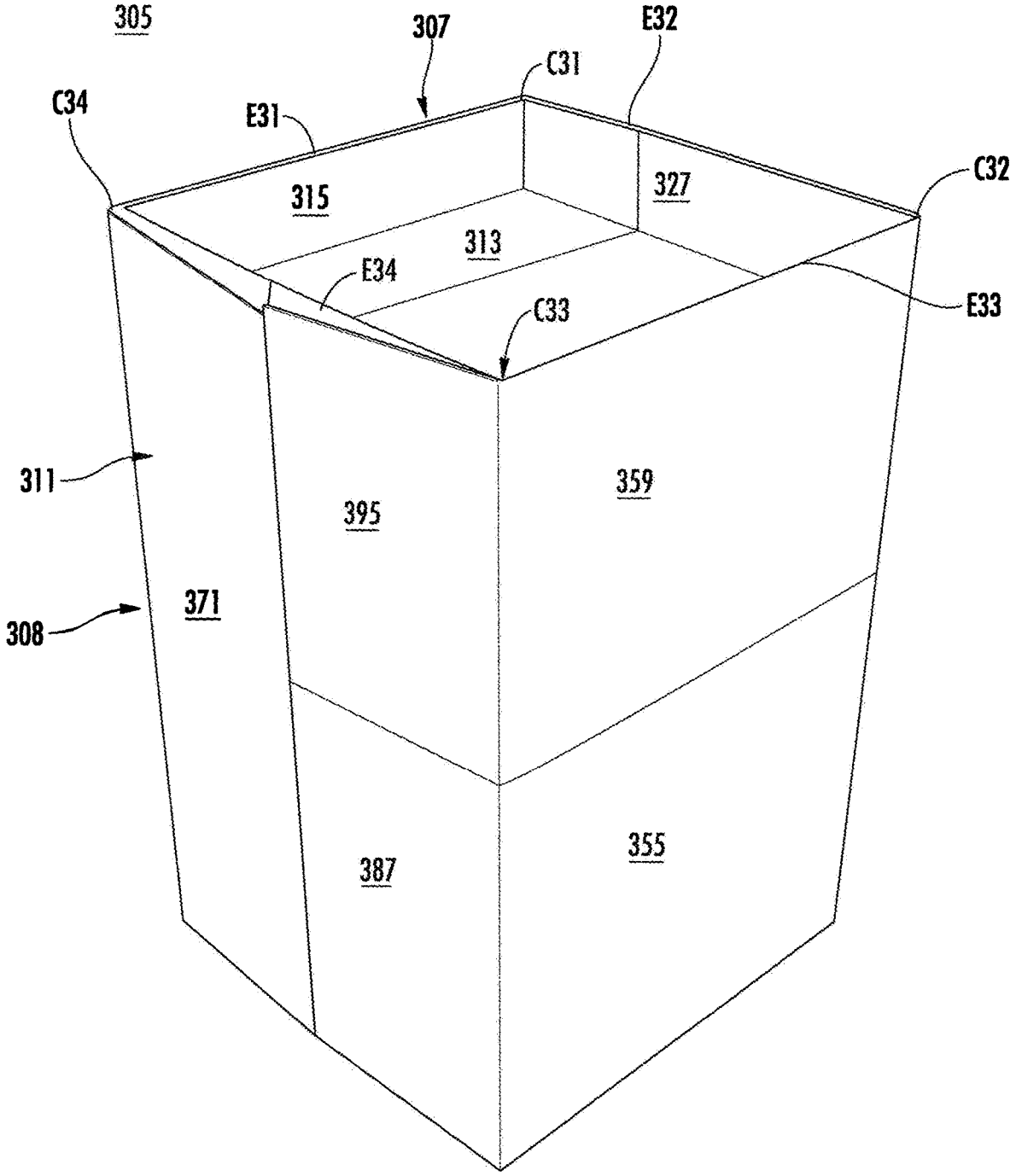
FIG. 16 is a perspective view of a carton formed from the blank of FIG. 15 according to an exemplary embodiment of the disclosure.

As shown, the carton blank 303 includes a first side panel 331 foldably connected to the first top impact-resistant panel 315 at a lateral fold line 333 and foldably connected to a first bottom impact-resistant panel 335 at a lateral fold line 337. A bottom panel 339, as shown, includes an intermediate fold line 340 and is foldably connected to the first bottom impact-resistant panel 335 at a lateral fold line 341. The bottom panel 339, as shown, is also foldably connected to a second bottom impact-resistant panel 343 at a longitudinal fold line 345, a third bottom impact-resistant panel 347 at a longitudinal fold line 349, and a fourth bottom impact-resistant panel 351 at a longitudinal fold line 353. As shown, the blank 303 also includes a second side panel 355 foldably connected to the second bottom impact-resistant panel 343 at a lateral fold line 357. A third side panel 359, as shown, is foldably connected to the second top impact-resistant panel 319 at a lateral fold line 361. As described herein, the second and third side panels 355, 359 may at least partially overlap to form a side of the carton 305 (FIG. 16). In alternative embodiments, the blank 303 can have alternative panel and flap arrangements without departing from the disclosure.

Still referring to FIG. 15, a first end flap 363 is foldably connected to the third top impact-resistant panel 323 at a longitudinal fold line 365 and a second end flap 367 is foldably connected to the fourth top impact-resistant panel 327 at a longitudinal fold line 369. A third end flap 371 is foldably connected to the first side panel 331 at a longitudinal fold line 373 and a fourth end flap 375 is foldably connected to the first side panel 331 at a longitudinal fold line 377. A fifth end flap 379 is foldably connected to the third bottom impact-resistant panel 347 at a longitudinal fold line 381 and a sixth end flap 383 is foldably connected to the fourth bottom impact-resistant panel 351 at a longitudinal fold line 385. As shown, a seventh end flap 387 is foldably connected to the second side panel 355 at a longitudinal fold line 389 and an eighth end flap 391 is foldably connected to the second side panel 355 at a longitudinal fold line 393. A ninth end flap 395 is foldably connected to the third side panel 359 at a longitudinal fold line 398 and a tenth end flap 397 is foldably connected to the third side panel 397 at a longitudinal fold line 399. While the third top impact-resistant panel 323, the fourth top impact-resistant panel 327, the third bottom impact-resistant panel 347, and the fourth bottom impact-resistant panel 351 have been described as distinct from the respective foldably attached end flaps 363, 367, 379, 383, in embodiments, the impact-resistant panels 323, 327, 347, 351 may be portions of the respective end flaps 363, 367, 379, 383. The blank 303 can have alternative panel and flap arrangements without departing from the disclosure.

The end flap 363 and the third top impact-resistant panel 323, the end flap 371, the end flap 379 and the third top impact-resistant panel 347, the end flap 387, and the end flap 395 extend along a first marginal area of the blank 303, and the end flap 367 and the fourth top impact-resistant panel 327, the end flap 375, the end flap 383 and the fourth bottom impact-resistant panel 351, the end flap 391, and the end flap 397 extend along a second marginal area of the blank 303, as shown. The longitudinal fold lines 365, 325, 373, 381, 349, 389, 329, 369, 377, 353, 385, 393, 398, and 399 may be, for example, substantially straight, or offset at one or more locations to account for blank thickness, varying width of the blank panels and flaps, or for other factors. The blank 303 could be otherwise shaped, arranged, and/or configured without departing from the disclosure.

When the carton 305 is erected, at least a portion of the end flap 363, the end flap 379, and the end flaps 371, 387, 395 at least partially close a first end 311 of the carton 305, and at least a portion of the end flap 367, the end flap 383, and the end flaps 375, 391, 397 at least partially close a second end 312 of the carton 305. Different flap arrangements can be used for at least partially closing the ends 311, 312 of the carton 305 without departing from the disclosure.

Figure 17:
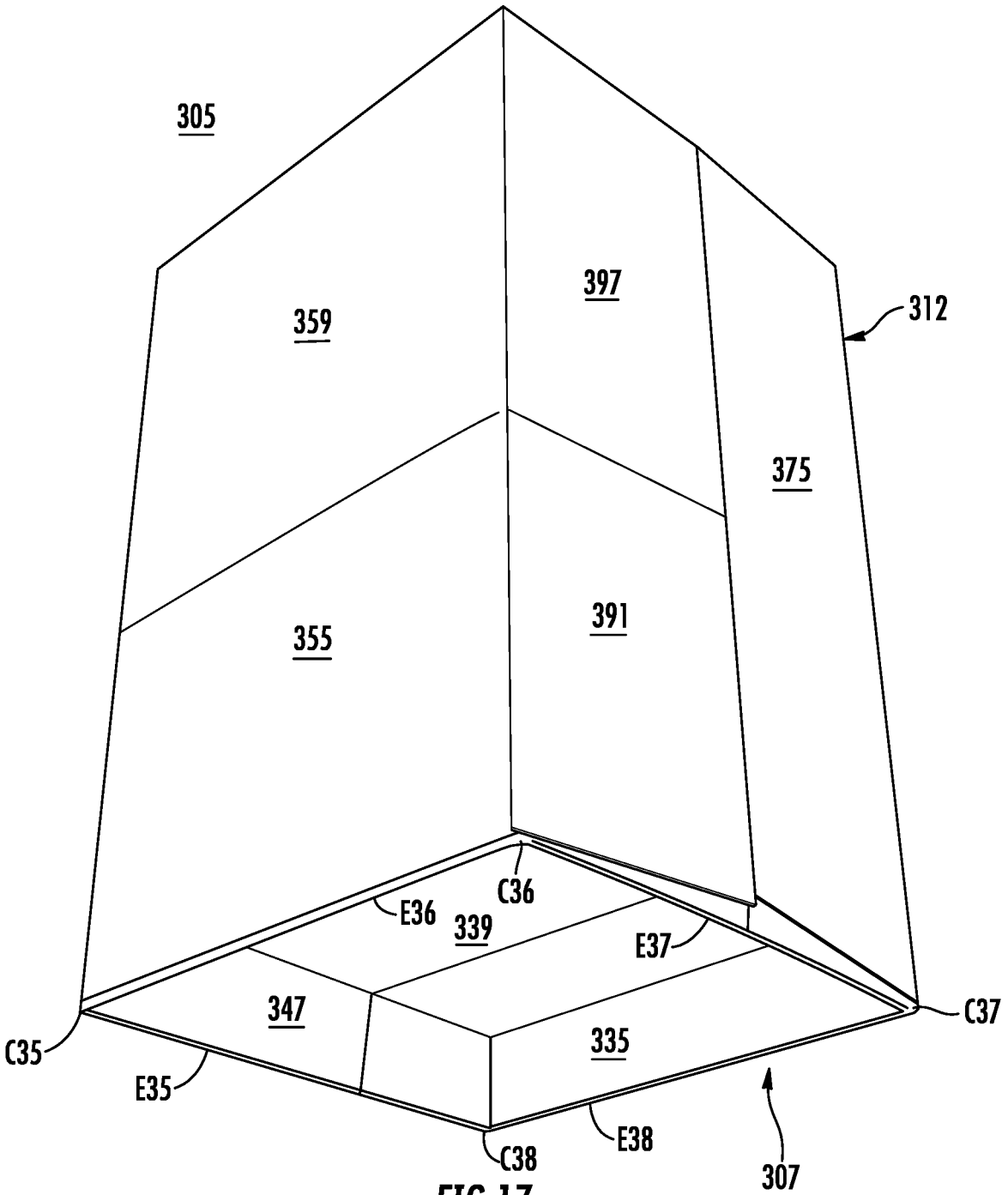
FIG. 17 is another perspective view of the carton of FIG. 16.

Referring additionally to FIGS. 16 and 17, in one embodiment, the carton 305 can be formed from the blank 303 by folding the respective impact-resistant panels 315, 335 at respective fold lines 333, 337 into at least partial face-to-face contact with the panel 313 and the respective panels 313, 339 can be folded at the respective fold lines 317, 341 to be substantially upright, e.g., perpendicular, relative to the panel 313 and to be in spaced planar parallel relation with one another. The respective impact-resistant panels 323, 327, 347, 351 can also be folded away from the interior of the blank 303 at respective fold lines 325, 329, 349, 353 to each extend in perpendicular relation to both the panels 313, 339 and the panel 331. The respective end flaps 363, 367, 379, 383 can be folded toward the interior of the blank 303 at the respective fold lines 365, 369, 381, 385 into at least partial face-to-face contact with the respective impact-resistant panels 323, 327, 347, 351. The end flaps 371, 375 can be folded upwardly relative to the panel 331 at the respective fold lines 373, 377 to be in spaced parallel planar relation to one another and such that the end flap 371 is in at least partial face-to-face contact with each of the end flaps 363, 379 and such that the end flap 375 is in at least partial face-to-face contact with each of the end flaps 367, 383. The respective impact-resistant panels 319, 343 can be folded outwardly at the respective fold lines 321, 345, and the respective panels 359, 355 can be folded at the respective fold lines 361, 357 toward one another such that the impact-resistant panel 319 is in at least partial face-to-face contact with the panel 359, the impact-resistant panel 343 is in at least partial face-to-face contact with the panel 355, and the panels 359, 355 are in at least partial face-to-face contact with each other. Such positioning of the panels 359, 355 also causes the end flaps 395, 387 to be overlapped in at least partial face-to-face contact and the end flaps 367, 391 to be overlapped in at least partial face-to-face contact. The end flaps 395, 387 can then together be folded downwardly at the fold lines 398, 389 to close the first end 311 of the carton 305 and the end flaps 397, 391 can be together folded downwardly at the fold lines 399, 393 to close the second end 312 of the carton 305.

In this regard, the carton 305 is provided with the impact-resistant panel 319 and a portion of the panel 359, the impact-resistant panel 323 and a portion of the end flap 363, the impact-resistant panel 315 and a portion of the panel 331, and the impact-resistant panel 327 and a portion of the end flap 367 extending away from the top panel 313 in a two-ply configuration and forming impact-resistant features 307 extending away from the body portion 308 of the carton 305 proximate the top panel 313 of the carton 305, the body portion 308 of the carton 305 being formed at least partially by the panels 313, 331, 339, 355, 359, and can also be formed by portions of the end flaps 363, 367, 371, 375, 379, 383, 387, 391. Similarly, the impact-resistant panel 335 and a portion of the panel 331, the impact-resistant panel 347 and a portion of the end flap 379, the impact-resistant panel 343 and a portion of the panel 355, and the impact-resistant panel 351 and a portion of the end flap 383 extend away from the bottom panel 339 in a two-ply configuration and also form the impact-resistant features 307 extending away from the body portion 308 of the carton 305 proximate the bottom panel 339 of the carton 305, as shown. The impact-resistant features 307 proximate the panel 313, as shown, include a first extension E31 formed by the impact-resistant panel 315 in face-to-face contact with a portion of the panel 331, a second extension E32 formed by the impact-resistant panel 327 in face-to-face contact with a portion of the end flap 367, a third extension E33 formed by the impact-resistant panel 319 in face-to-face contact with a portion of the panel 359, and a fourth extension E34 formed by the impact-resistant panel 323 in face-to-face contact with a portion of the end flap 363, and with the first extension E31 and the second extension E32 intersecting at a first corner C31, the second extension E32 and the third extension E33 intersecting at a second corner C32, the third extension E33 and the fourth extension E34 intersecting at a third corner C33, and the fourth extension E34 and the first extension E31 intersecting at a fourth corner C34, as shown. As also shown, the impact-resistant features 307 proximate the panel 339 include a fifth extension E35 formed by the impact-resistant panel 347 in face-to-face contact with a portion of the end flap 379, a sixth extension E36 formed by the impact-resistant panel 343 in face-to-face contact with a portion of the panel 355, a seventh extension E37 formed by the impact-resistant panel 351 in face-to-face contact with a portion of the end flap 383, and an eighth extension E38 formed by the impact-resistant panel 335 in face-to-face contact with a portion of the panel 331, and with the fifth extension E35 and the sixth extension E36 intersecting at a fifth corner C35, the sixth extension E36 and the seventh extension E37 intersecting at a sixth corner C36, the seventh extension E37 and the eighth extension E38 intersecting at a seventh corner C37, and the eighth extension E38 and the fifth extension E35 intersecting at an eighth corner C38, as shown. Such extensions and corners E31, E32, E33, E34, E35, E36, E37, and E38 and C31, C32, C33, C34, C35, C36, C37, and C38 and/or other portions of impact-resistant features 307 provide resistance to impacts as described above with respect to the cartons 5, 105, 205 (FIGS. 7, 10, and 13).

Figure 18:
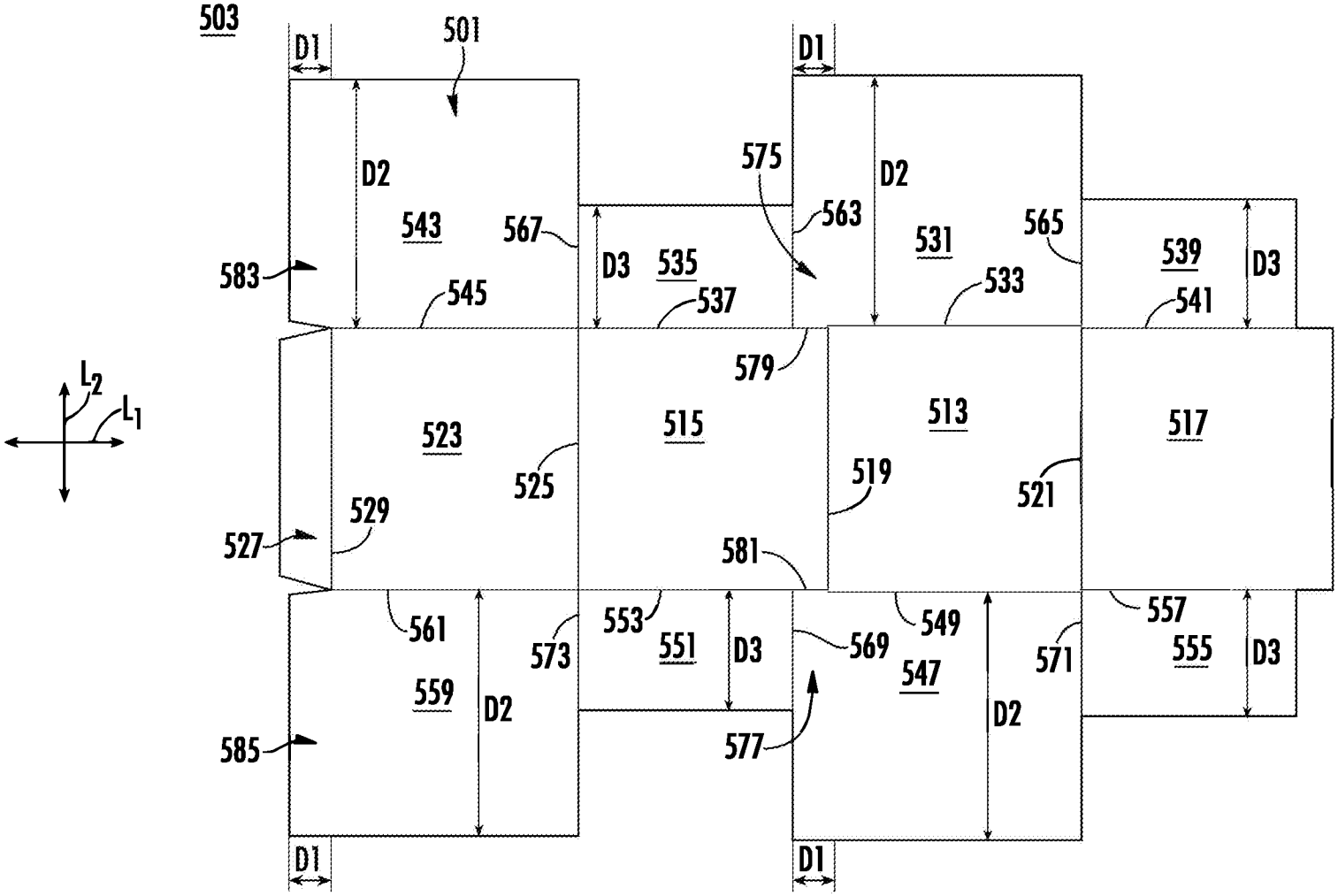
FIG. 18 is a plan view of an interior surface of a blank for forming a carton according to a fifth exemplary embodiment of the disclosure.

Turning to FIG. 18, a plan view of the interior side 501 of a blank, generally indicated at 503, used to form a carton 505 (FIG. 19), according to a fifth exemplary embodiment of the disclosure. The blank 503 and the carton 505 can have one or more substantially similar features to the blanks 3, 103, 203, 303 (FIGS. 1, 9, 12, 15) and the cartons 5, 105, 205, 305 (FIGS. 7, 10, 13, 16) of the first, second, third, and fourth exemplary embodiments of the disclosure, and like or similar components are referenced with like or similar reference numbers. As shown, the carton blank 503 has the longitudinal axis L1 and the lateral axis L2. The blank 503 includes a first side panel 513 that is foldably connected to a second side panel 515 and a third side panel 517 at respective lateral fold lines 519, 521. A fourth side panel 523, as shown, is foldably connected to the second side panel 515 at a lateral fold line 525, and an attachment flap 527 is foldably connected to the fourth side panel 523 at a lateral fold line 529.

As shown, a first impact-resistant end flap 531 is foldably connected to the first side panel 513 at a longitudinal fold line 533, a first minor end flap 535 is foldably connected to the second side panel 515 at a longitudinal fold line 537, a second minor end flap 539 is foldably connected to the third side panel 517 at a longitudinal fold line 541, and a second impact-resistant end flap 543 is foldably connected to the fourth side panel 523 at a longitudinal fold line 545 such that the end flaps 531, 535, 539, 543 extend along a first marginal area of the blank 503. Similarly, a third impact-resistant end flap 547 is foldably connected to the first side panel 513 at a longitudinal fold line 549, a third minor end flap 551 is foldably connected to the second side panel 515 at a longitudinal fold line 553, a fourth minor end flap 555 is foldably connected to the third side panel 517 at a longitudinal fold line 557, and a fourth impact-resistant end flap 559 is foldably connected to the fourth side panel 523 at a longitudinal fold line 561 such that the end flaps 547, 551, 555, 559 extend along a second marginal area of the blank 503. As also shown, the impact-resistant end flap 531 is separated from the respective minor end flaps 535, 539 at respective lateral cuts 563, 565, the impact-resistant end flap 543 is separated from the minor end flap 535 at a lateral cut 567, the impact-resistant end flap 547 is separated from the respective minor end flaps 551, 555 at respective lateral cuts 569, 571, and the impact-resistant end flap 559 is separated from the minor end flap 551 at a lateral cut 573. When the carton 505 is erected, the impact-resistant end flaps 531, 543 and the minor end flaps 535, 539 close a first end 511 of the carton 505, and the impact-resistant end flaps 547, 559 and the minor flaps 551, 555 close a second end 512 of the carton 505. In accordance with alternative embodiments of the present disclosure, different flap arrangements can be used for at least partially closing the ends 511, 512 of the carton 505.

Still referring to FIG. 18, respective impact-resistant portions 575, 577 of the respective impact-resistant end flaps 531, 547 extend longitudinally into alignment with a portion of the side panel 515 a distance D1 and are separated from the side panel 515 at respective longitudinal cuts 579, 581. Similarly, respective impact-resistant portions 583, 585 of the respective impact-resistant end flaps 543, 559 are defined along a distance D1 at respective free edge portions thereof, and extend longitudinally into alignment with a portion of the attachment flap 527. As also shown, the impact-resistant end flaps 531, 543, 547, 559 are defined along a lateral distance D2 that is greater than a lateral distance D3 along which the minor end flaps 535, 539, 551, 555 are defined. The blank 503 could be otherwise shaped, arranged, and/or configured without departing from the disclosure.

Figure 19:
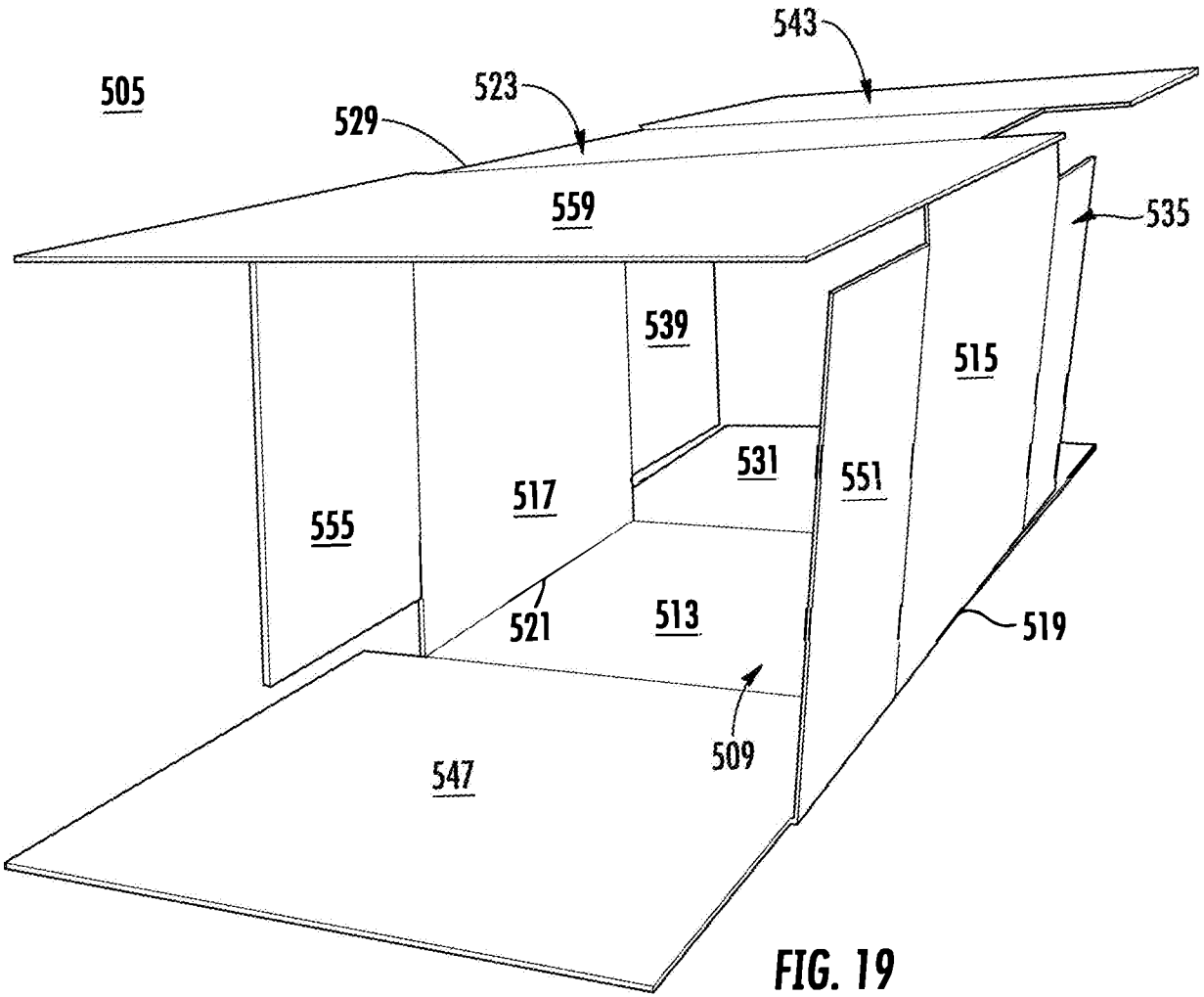
FIG. 19 is a first sequential perspective view of a folding of the blank of FIG. 18 according to an exemplary embodiment of the disclosure.
Figure 20:
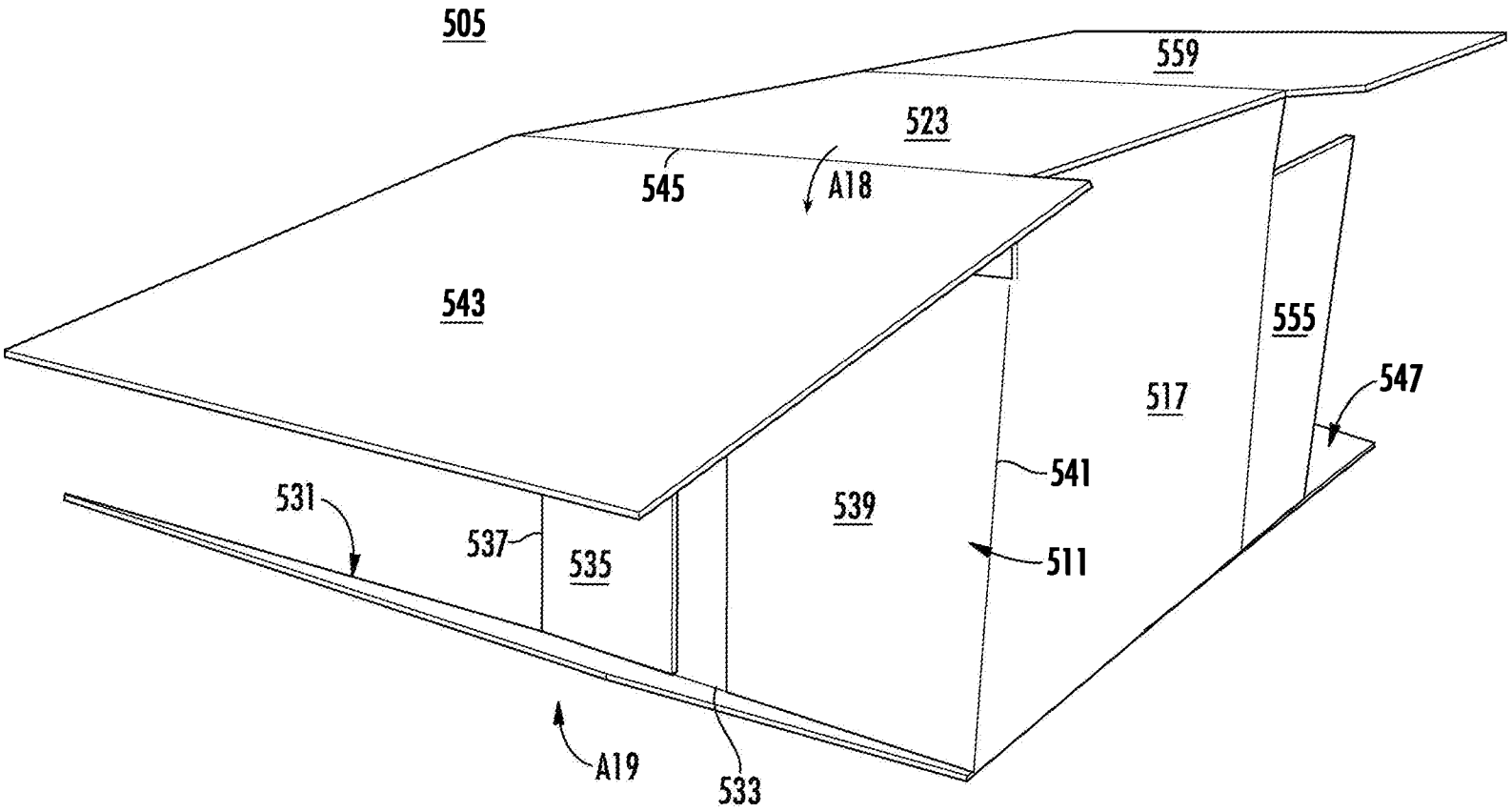
FIG. 20 is a second sequential perspective view of a folding of the blank of FIG. 18 according to an exemplary embodiment of the disclosure.
Figure 21:
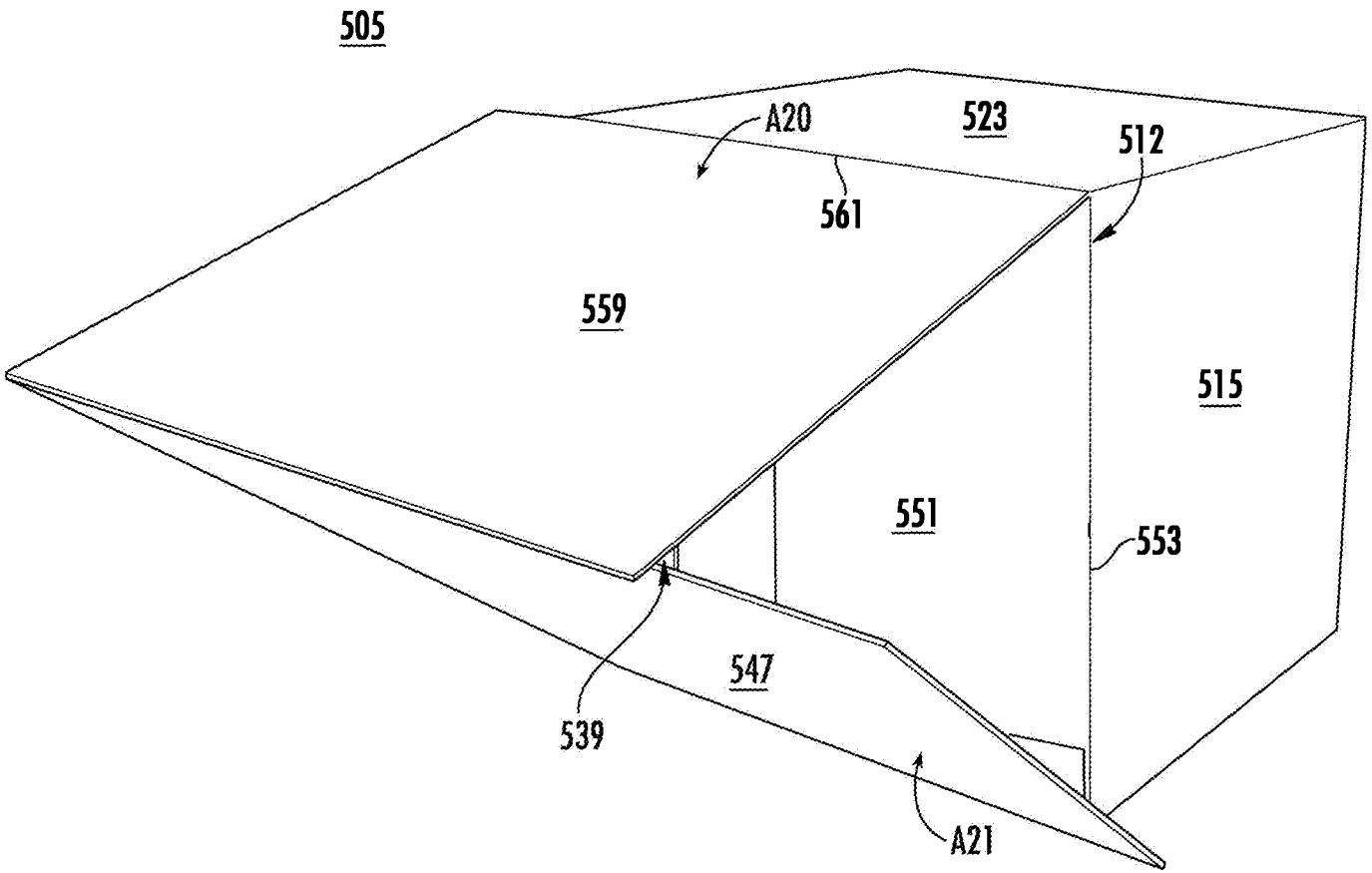
FIG. 21 is a third sequential perspective view of a folding of the blank of FIG. 18 according to an exemplary embodiment of the disclosure.

Referring additionally to FIG. 19, in one embodiment, the carton 505 can be formed from the blank 503 by folding the side panels 515, 513, 517, 523 at the fold lines 519, 521, 525 such that the side panels 515, 517 are arranged in planar parallel spaced relation and the side panels 513, 523 are arranged in parallel planar spaced relation and perpendicular to each of the side panels 515, 517. The attachment flap 527 can be folded at the fold line 529 into at least partial face-to-face contact with the panel 517 and secures thereto with an adhesive such as glue to provide the illustrated sleeve-like configuration of the carton 505 that extends around an interior 509 of the carton 505. With additional reference to FIGS. 20 and 21, to effect closure of the first end 511 of the carton 505, the minor end flaps 539, 535 can be folded toward one another at respective fold lines 541, 537 and the impact-resistant end flaps 543, 531 can be folded toward one another at the respective fold lines 545, 533 in the direction of the arrows A18, A19 into at least partial face-to-face contact to close the first end 511 of the carton 505. Similarly, to effect closure of the second end 512 of the carton 505, the minor end flaps 555, 551 can be folded toward one another at respective fold lines 557, 553 and the impact-resistant end flaps 559, 547 can be folded toward one another at the respective fold lines 561, 549 in the direction of the arrows A20, A21 into at least partial face-to-face contact to close the second end 512 of the carton 505.

Figure 22:
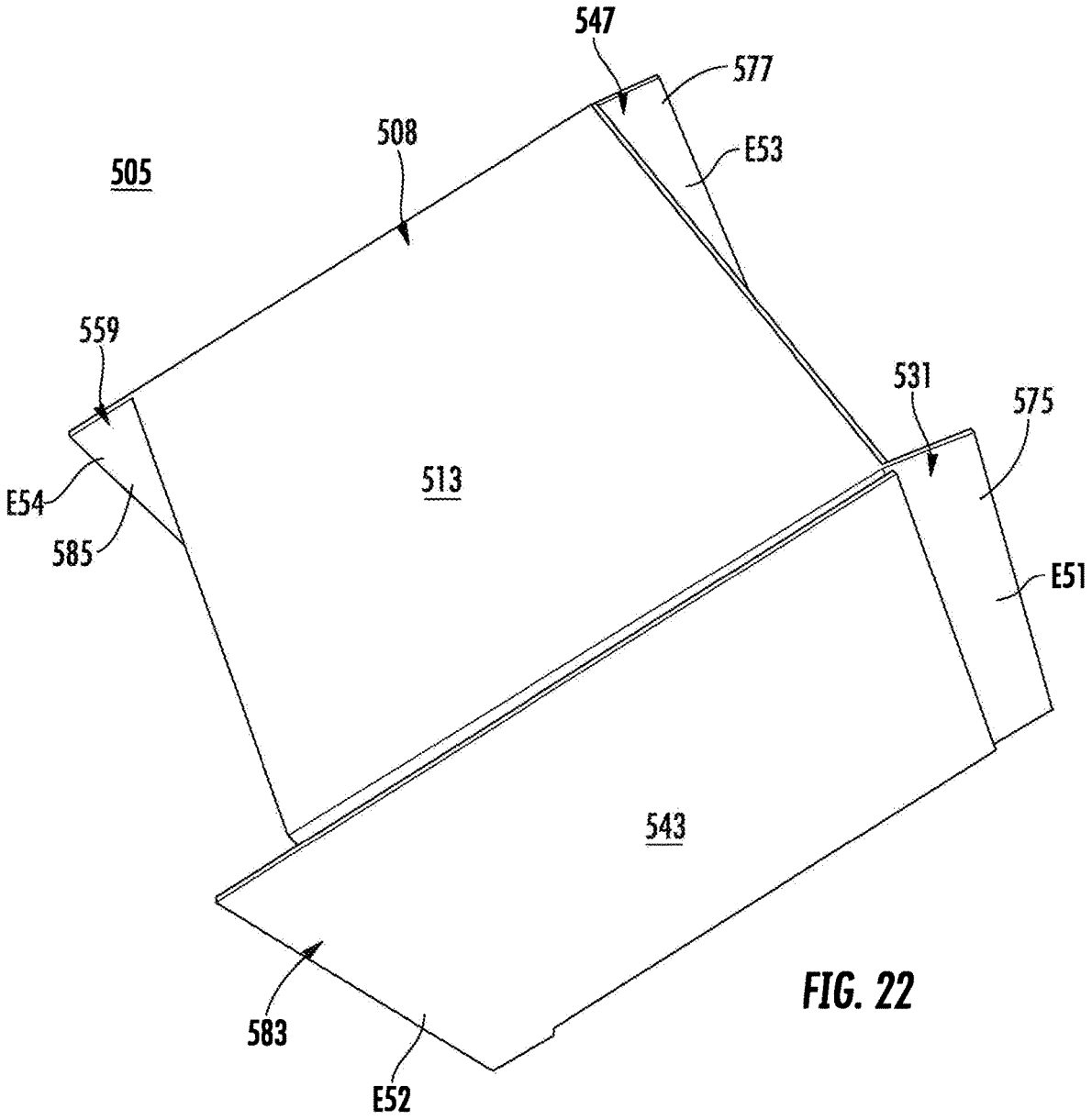
FIG. 22 is a perspective view of a carton formed from the blank of FIG. 18 according to an exemplary embodiment of the disclosure.

Referring additionally to FIG. 22, the impact-resistant portions 575, 583, 577, 585 of the respective impact-resistant end flaps 531, 543, 547, 559 form impact-resistant features 507 that extend away from a body portion 508 of the carton 505 that is formed at least by portions of the side panels 513, 515, 517, 523 and can include portions of the impact-resistant end flaps 531, 543, 547, 559 and the minor end flaps 535, 539, 551, 555. The impact-resistant features 507, as shown, include a first extension E51 formed by the impact-resistant portion 575 of the impact-resistant end flap 531, a second extension E52 formed by the impact-resistant portion 583 of the second impact-resistant end flap 543, a third extension E53 formed by the impact-resistant portion 577 of the impact-resistant end flap 547, and a fourth extension E54 formed by the impact-resistant portion 585 of the impact-resistant end flap 559. The extensions E51, E52, E53, E54 each have a single-ply configuration and extend away from the body portion 508 to provide resistance to impacts as described above with respect to the cartons 5, 105, 205, 305 (FIG. 7, 10, 13, 16).

Figure 23:
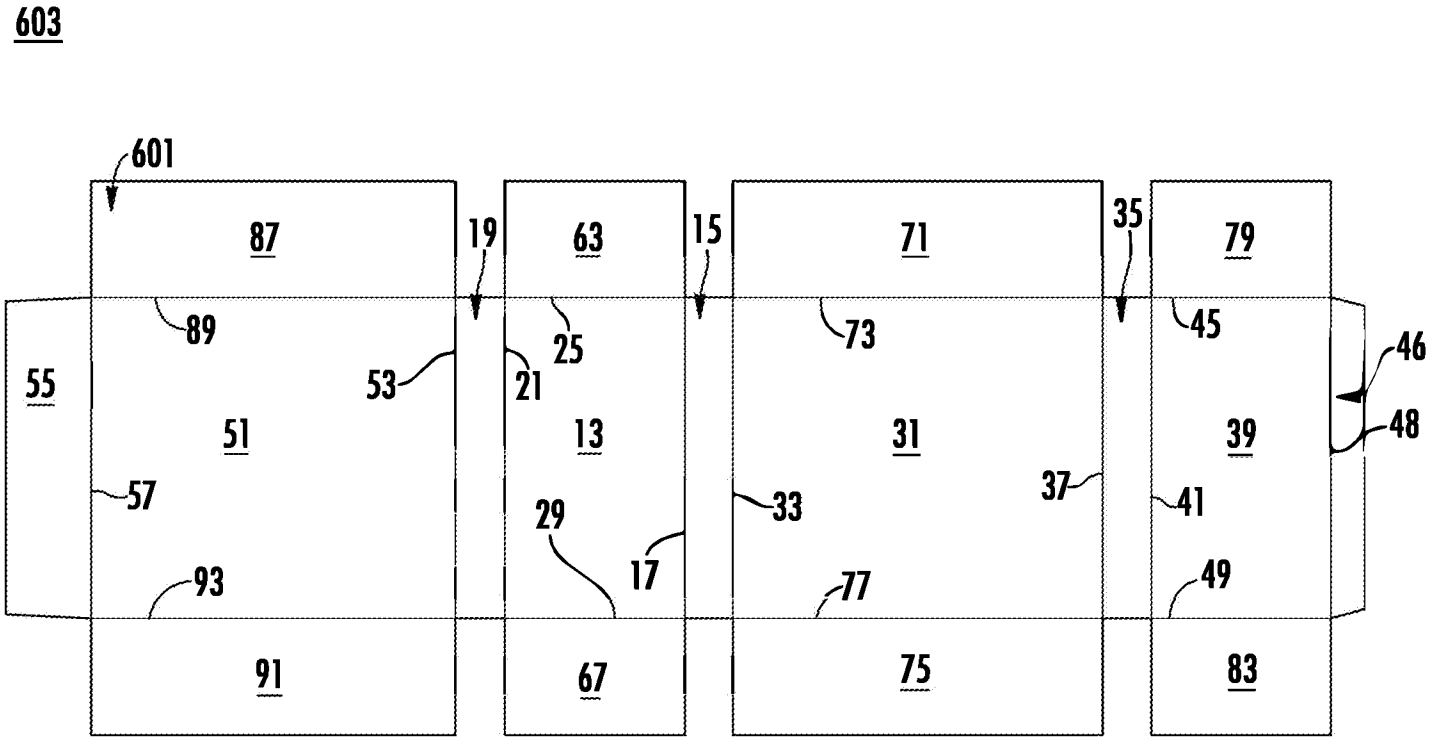
FIG. 23 is a plan view of an interior surface of a blank for forming a carton according to a sixth exemplary embodiment of the disclosure.
Figure 24:
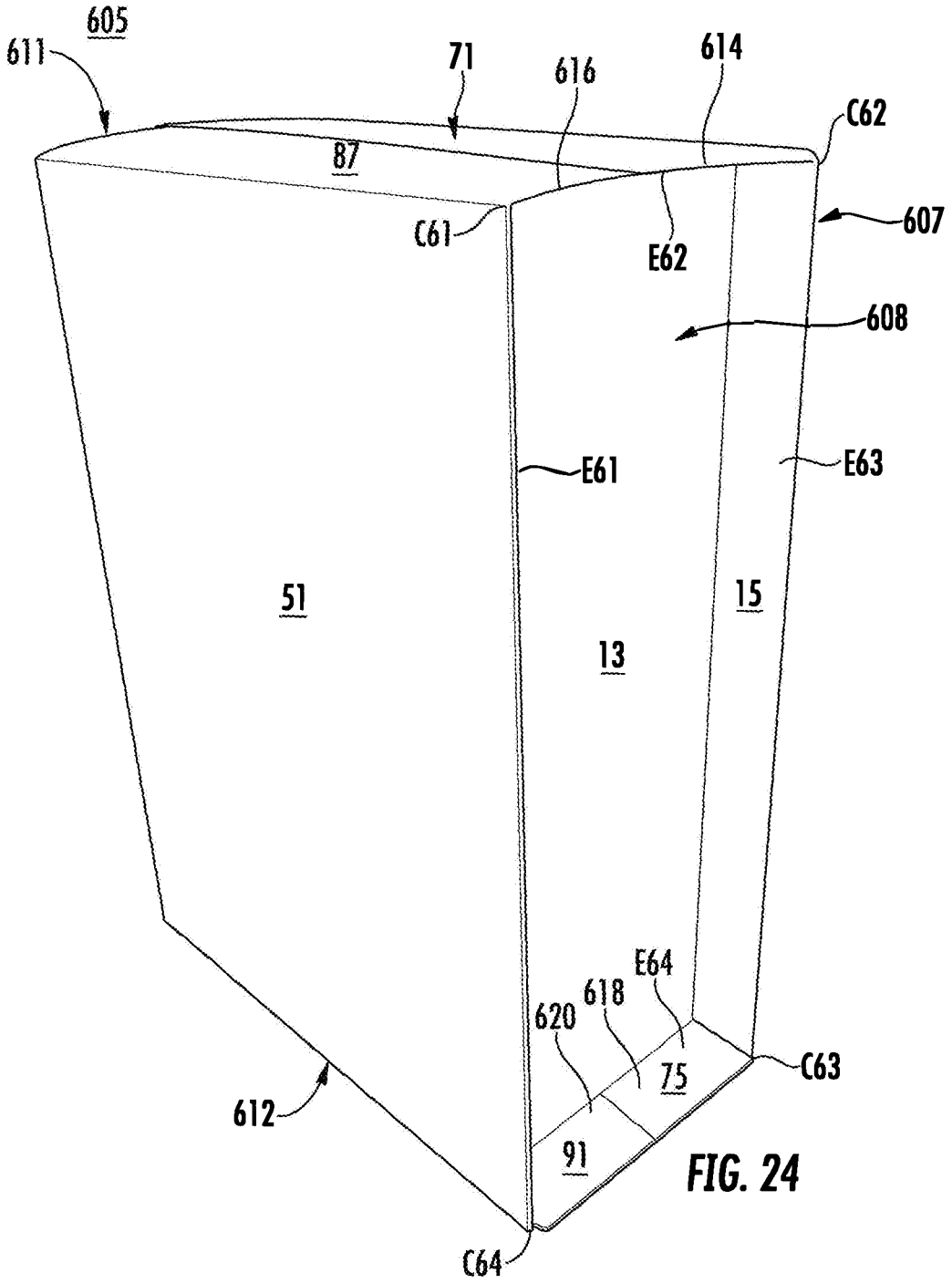
FIG. 24 is a perspective view of a carton formed from the blank of FIG. 23 according to an exemplary embodiment of the disclosure.
Figure 25:
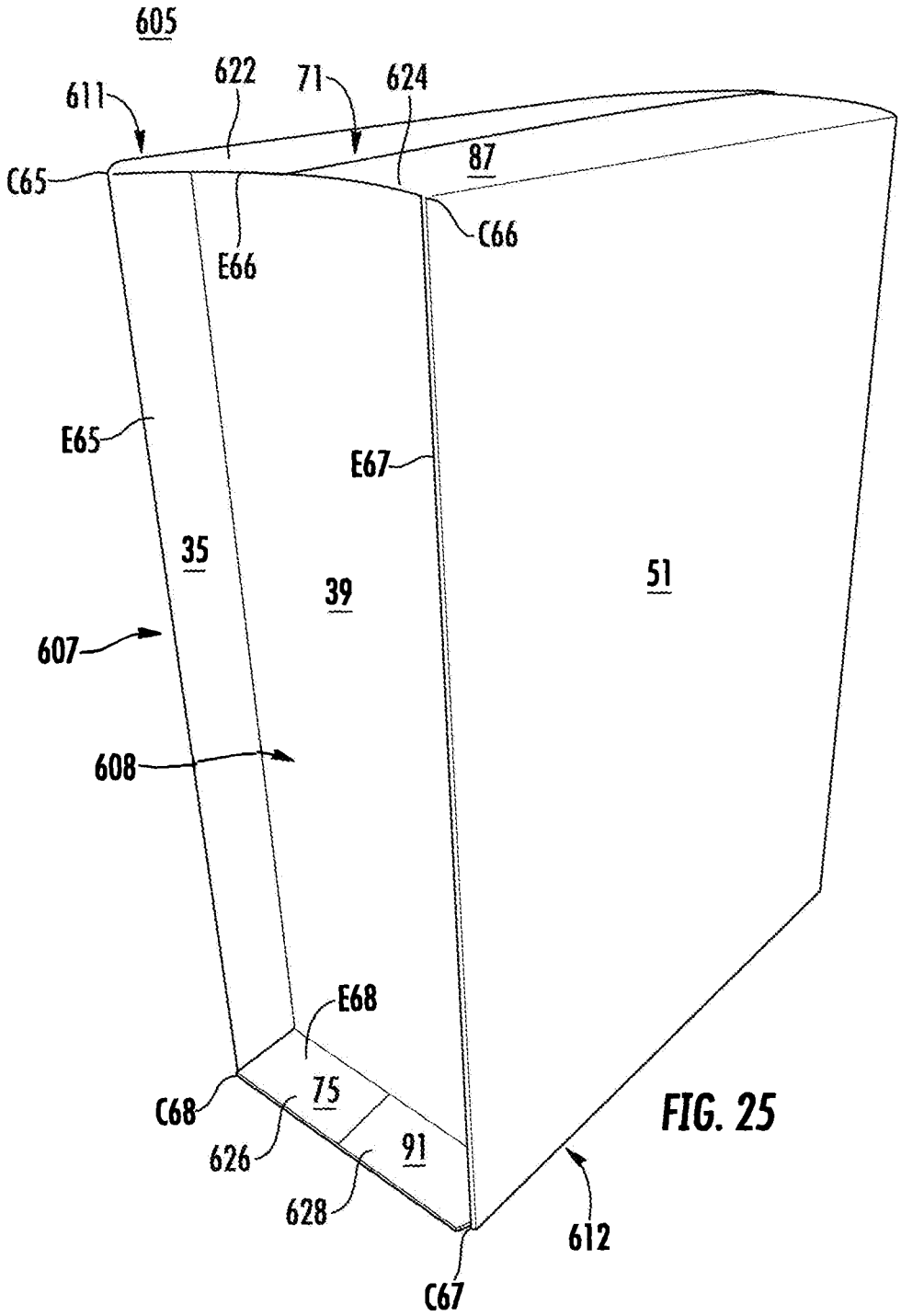
FIG. 25 is another perspective view of a carton formed from the blank of FIG. 23 according to an exemplary embodiment of the disclosure.

Turning to FIGS. 23-25, a blank 603 and a carton 605 formed therefrom are illustrated according to a sixth exemplary embodiment of the disclosure. The blank 603 and the carton 605 can have one or more substantially similar features to the blanks 3, 103, 203, 303, 503 (FIGS. 1, 9, 12, 15, 18) and the cartons 5, 105, 205, 305, 505 (FIGS. 7, 10, 13, 16, 19) of the first, second, third, fourth, and fifth exemplary embodiments of the disclosure, and like or similar components are referenced with like or similar reference numbers. As shown, the blank 603 is similar to the blank 3 (FIG. 1) of the first exemplary embodiment of the disclosure, however, the end flaps 87, 63, 71, 79, 91, 67, 75, 83 are not presented with any fold lines or other lines of weakening such that and/or no impact-resistant panels are directly foldably connected thereto. In this regard, the respective end flaps 63, 67 are foldably connected to the side panel 13 at the respective fold lines 25, 29, the respective end flaps 71, 75 are foldably connected to the side panel 31 at the respective fold lines 73, 77, the respective end flaps 79, 83 are foldably connected to the side panel 39 at the respective fold lines 45, 49, and the respective end flaps 87, 93 are foldably connected to the side panel 51 at the respective fold lines 89, 93. It will be understood that the blank 603 can be differently-arranged without departing from the disclosure.

Still referring to FIGS. 23-25, the blank 603 is folded such that the respective impact-resistant panels 15, 35 are folded at respective fold lines 33, 37 into at least partial face-to-face contact with the side panel 31 and the respective side panels 13, 39 are folded at the respective fold lines 17, 41 to be substantially upright, e.g., perpendicular, relative to the side panel 31 and to be in spaced planar parallel relation with one another. The impact-resistant panel 19 can be folded outwardly at the fold line 21 and the side panel 51 can be folded inwardly at the fold line 53 into at least partial face-to-face contact with the impact-resistant panel 19 to extend in spaced parallel relation with the side panel 31. The impact-resistant panel 55 can be folded at the fold line 57 into at least partial face-to-face contact with the side panel 51, and the attachment flap 46 can be folded at the fold line 48 into at least partial face-to-face contact with the impact-resistant panel 55 and secured thereto, for example, with an adhesive such as glue. Thereafter, the respective end flaps 63, 79 can be folded toward the interior of the carton 605 at the respective fold lines 25, 45 and the respective end flaps 71, 87 can be folded at the respective fold lines 73, 89 into at least partial face-to-face contact with the end flaps 63, 79 to form a closed end 611 of the carton 605. Similarly, the respective end flaps 67, 83 can be folded toward the interior of the carton 605 at the respective fold lines 29, 49 and the respective end flaps 75, 91 can be folded at the respective fold lines 77, 93 into at least partial face-to-face contact with the end flaps 67, 83 to form a closed end 612 of the carton 605.

In this regard, and as shown, the blank 603 is folded into the carton 605 such that the body portion 608 is formed at least partially by the panels 13, 31, 39, 51, and can also be at least partially formed by portions of one or more of the end flaps 63, 71, 79, 87, 67, 75, 83, 91 and with the impact-resistant features 607 extending away from the body portion 608 of the carton 605. The impact-resistant features 607 include the impact-resistant panels 15, 35 in face-to-face contact with portions of the side panel 31 in a two-ply configuration, the impact-resistant panels 19, 55 in face-to-face contact with portions of the side panel 51 in a two-ply configuration, respective portions 614, 616 of the respective end flaps 71, 87 and respective portions 618, 620 of the respective end flaps 75, 91 that extend past the end panel 13 in the assembled carton 605 in a single-ply configuration, and respective portions 622, 624 of the respective end flaps 71, 87 and respective portions 626, 628 of the respective end flaps 75, 91 that extend past the end panel 39 in the assembled carton 605 in a single-ply configuration.

The impact-resistant features 607 proximate the panel 13, as shown, include a first extension E61 formed by the impact-resistant panel 19 in face-to-face contact with a portion of the panel 51, a second extension E62 formed by the respective portions 614, 616 of the respective end flaps 71, 87, a third extension E63 formed by the impact-resistant panel 15 in face-to-face contact with a portion of the panel 31, and a fourth extension E64 formed by the respective portions 618, 620 of the respective end flaps 75, 91, and with the first extension E61 and the second extension E62 intersecting at a first corner C61, the second extension E62 and the third extension E63 intersecting at a second corner C62, the third extension E63 and the fourth extension E64 intersecting at a third corner C63, and the fourth extension E64 and the first extension E61 intersecting at a fourth corner C64, as shown. As also shown, the impact-resistant features 607 proximate the panel 39 include a fifth extension E65 formed by the impact-resistant panel 35 in face-to-face contact with a portion of the panel 31, a sixth extension E66 formed by the respective portions 622, 624 of the respective end flaps 71, 87, a seventh extension E67 formed by the impact-resistant panel 55 in face-to-face contact with a portion of the panel 51, and an eighth extension E68 formed by the respective portions 626, 628 of the respective end flaps 75, 91, and with the fifth extension E65 and the sixth extension E66 intersecting at a fifth corner C65, the sixth extension E66 and the seventh extension E67 intersecting at a sixth corner C66, the seventh extension E67 and the eighth extension E68 intersecting at a seventh corner C67, and the eighth extension E68 and the fifth extension E65 intersecting at an eighth corner C68, as shown. Such extensions and corners E61, E62, E63, E64, E65, E66, E67, and E68 and C61, C62, C63, C64, C65, C66, C67, and C68 and/or other portions of impact-resistant features 607 provide resistance to impacts as described above with respect to the cartons 5, 105, 205, 305, 505 (FIG. 7, 10, 13, 16, 19).

Figure 26:
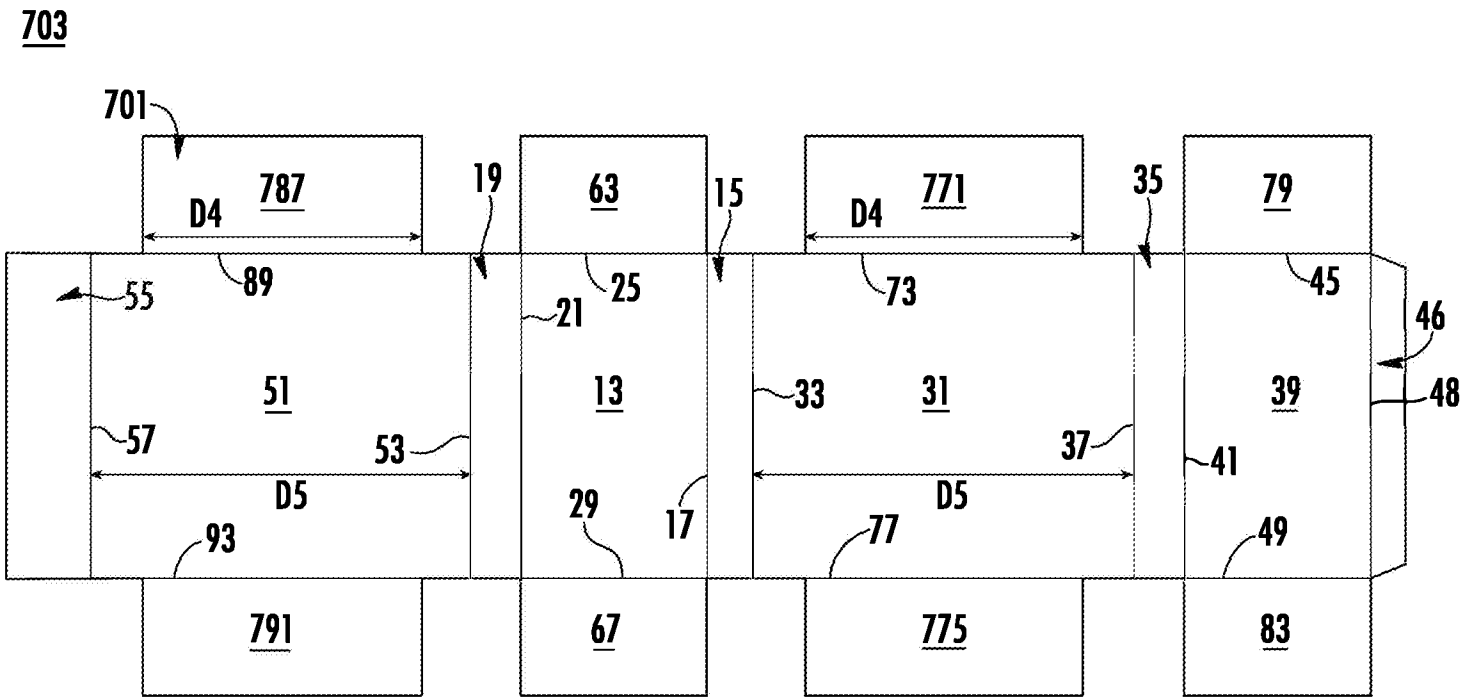
FIG. 26 is a plan view of an interior surface of a blank for forming a carton according to a seventh exemplary embodiment of the disclosure.
Figure 27:
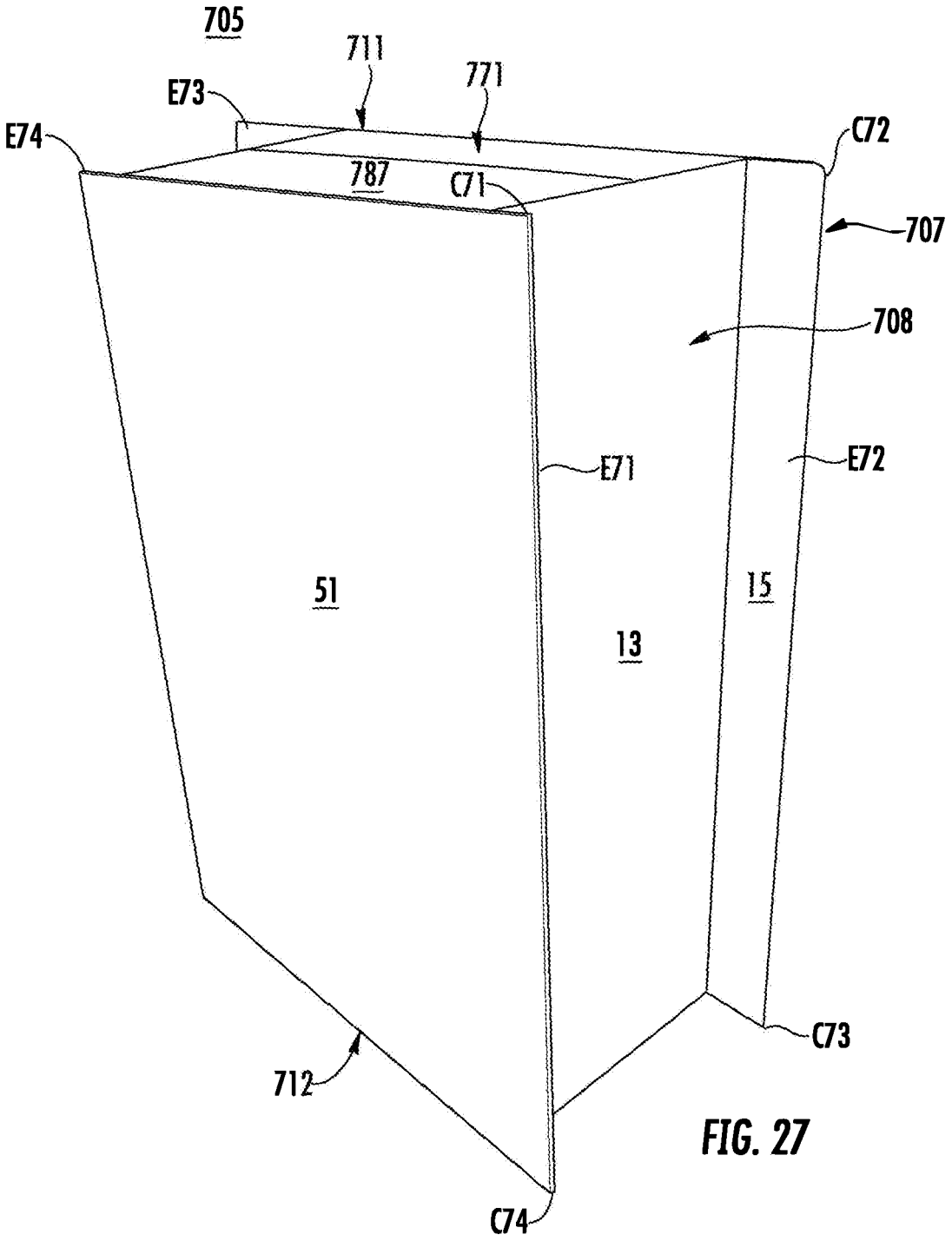
FIG. 27 is a perspective view of a carton formed from the blank of FIG. 26 according to an exemplary embodiment of the disclosure.
Figure 28:
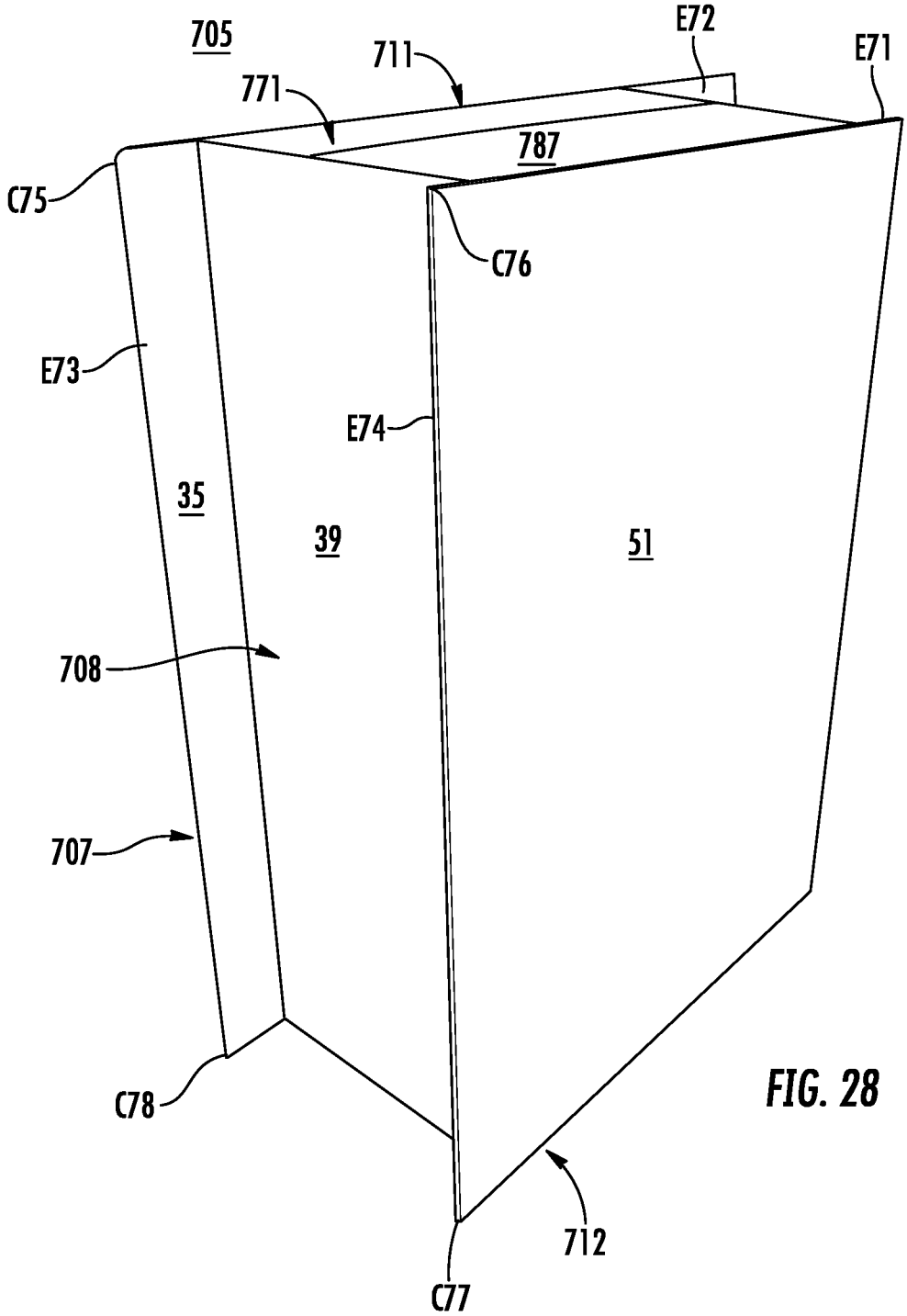
FIG. 28 is another perspective view of a carton formed from the blank of FIG. 26 according to an exemplary embodiment of the disclosure.

Turning to FIGS. 26-28, a blank 703 and a carton 705 formed therefrom are illustrated according to a seventh exemplary embodiment of the disclosure. The blank 703 and the carton 705 can have one or more substantially similar features to the blanks 3, 103, 203, 303, 503, 603 (FIGS. 1, 9, 12, 15, 18, 23) and the cartons 5, 105, 205, 305, 505, 605 (FIGS. 7, 10, 13, 16, 19, 24) of the first, second, third, fourth, fifth, and sixth exemplary embodiments of the disclosure, and like or similar components are referenced with like or similar reference numbers. As shown, the blank 703 is similar to the blank 3 (FIG. 1) of the first exemplary embodiment of the disclosure, however, respective end flaps 771, 775 are foldably connected to the side panel 31 at the respective fold lines 73, 77 and respective end flaps 787, 791 are foldably connected to the side panel 51 at the respective fold lines 89, 93. Each of the end flaps 771, 775, 787, 791, as shown, has a longitudinal width D4 that is less than a longitudinal width D5 of each of the side panels 31, 51. It will be understood that the blank 703 can be differently-arranged without departing from the disclosure.

Still referring to FIGS. 26-28, the blank 703 is folded such that the respective impact-resistant panels 15, 35 are folded at respective fold lines 33, 37 into at least partial face-to-face contact with the side panel 31 and the respective side panels 13, 39 are folded at the respective fold lines 17, 41 to be substantially upright, e.g., perpendicular, relative to the side panel 31 and to be in spaced planar parallel relation with one another. The impact-resistant panel 19 can be folded outwardly at the fold line 21 and the side panel 51 can be folded inwardly at the fold line 53 into at least partial face-to-face contact with the impact-resistant panel 19 to extend in spaced parallel relation with the side panel 31. The impact-resistant panel 55 can be folded at the fold line 57 into at least partial face-to-face contact with the side panel 51, and the attachment flap 46 can be folded at the fold line 48 into at least partial face-to-face contact with the impact-resistant panel 55 and secured thereto, for example, with an adhesive such as glue. Thereafter, the respective end flaps 63, 79 can be folded toward the interior of the carton 705 at the respective fold lines 25, 45 and the respective end flaps 771, 787 can be folded at the respective fold lines 73, 89 into at least partial face-to-face contact with the end flaps 63, 79 to form a closed end 711 of the carton 705. Similarly, the respective end flaps 67, 83 can be folded toward the interior of the carton 705 at the respective fold lines 29, 49 and the respective end flaps 775, 791 can be folded at the respective fold lines 77, 93 into at least partial face-to-face contact with the end flaps 67, 83 to form a closed end 712 of the carton 705.

In this regard, and as shown, the blank 703 is folded into the carton 705 such that the body portion 708 is formed at least partially by the panels 13, 31, 39, 51, and can also be at least partially formed by portions of one or more of the end flaps 63, 771, 79, 787, 67, 775, 83, 791 and with the impact-resistant features 707 extending away from the body portion 708 of the carton 705. The impact-resistant features 707 include the impact-resistant panels 15, 35 in face-to-face contact with portions of the side panel 31 in a two-ply configuration, and the impact-resistant panels 19, 55 in face-to-face contact with portions of the side panel 51 in a two-ply configuration.

The impact-resistant features 707 proximate the panel 13, as shown, include a first extension E71 formed by the impact-resistant panel 19 in face-to-face contact with a portion of the panel 51 and a second extension E72 formed by the impact-resistant panel 15 in face-to-face contact with a portion of the panel 31, with the first extension E71 forming a first corner C71 and a fourth corner C74 and the second extension E72 forming a second corner C72 and a third corner C73. As also shown, the impact-resistant features 707 proximate the panel 39 include a third extension E73 formed by the impact-resistant panel 35 in face-to-face contact with a portion of the panel 31 and a fourth extension E74 formed by the impact-resistant panel 55 in face-to-face contact with a portion of the panel 51, with the third extension E73 forming a fifth corner C75 and an eighth corner C78 and the fourth extension E74 forming a sixth corner C76 and a seventh corner C77, as shown. Such extensions and corners E71, E72, E73, E74, and C71, C72, C73, C74, C75, C76, C77, and C78 and/or other portions of impact-resistant features 707 provide resistance to impacts as described above with respect to the cartons 5, 105, 205, 305, 505, 605 (FIG. 7, 10, 13, 16, 19, 24).

Figure 29:
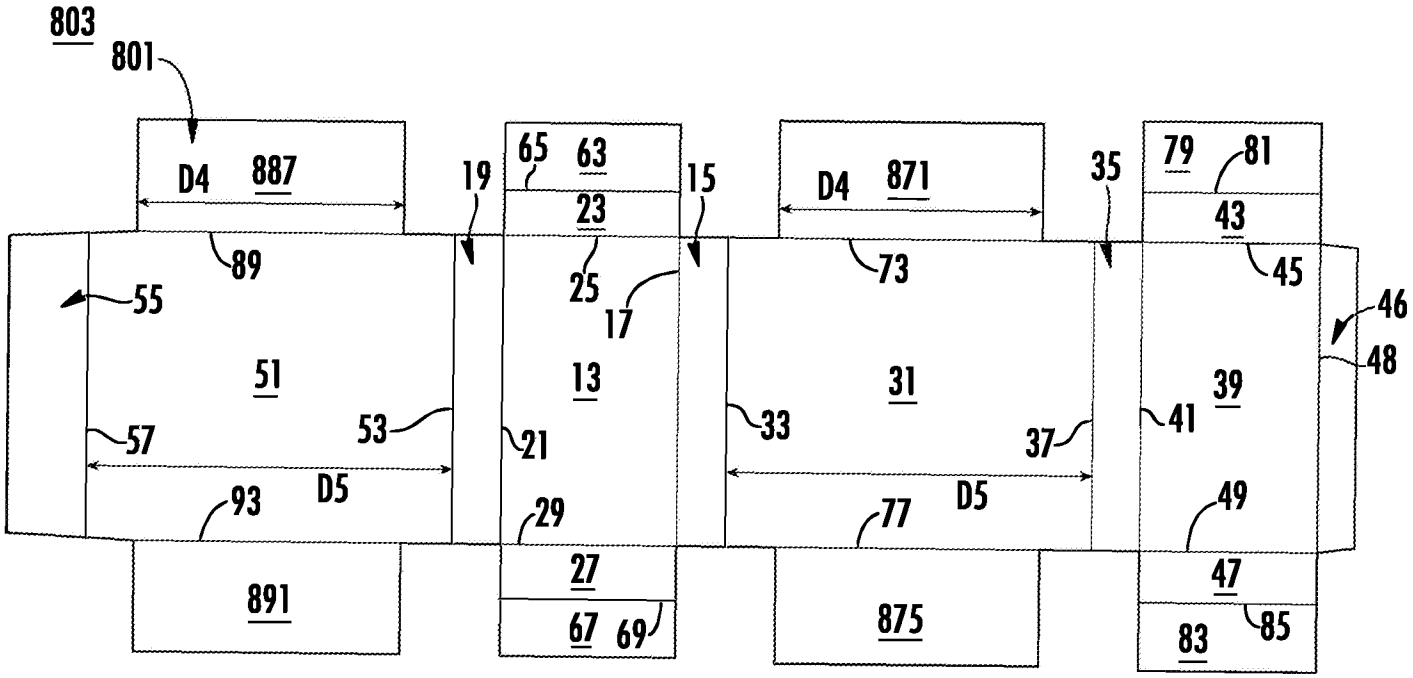
FIG. 29 is a plan view of an interior surface of a blank for forming a carton according to an eighth exemplary embodiment of the disclosure.
Figure 30:
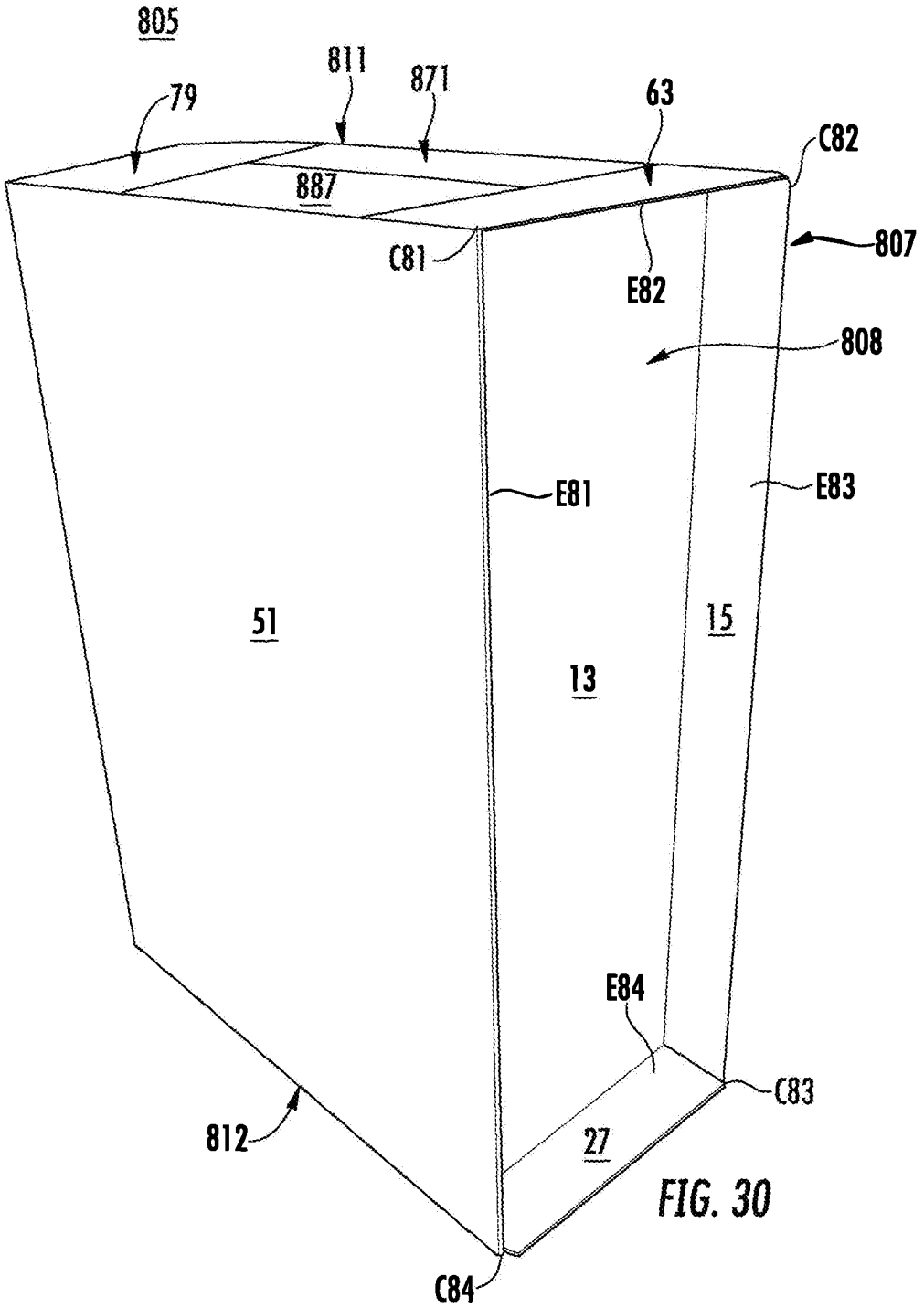
FIG. 30 is a perspective view of a carton formed from the blank of FIG. 29 according to an exemplary embodiment of the disclosure.
Figure 31:
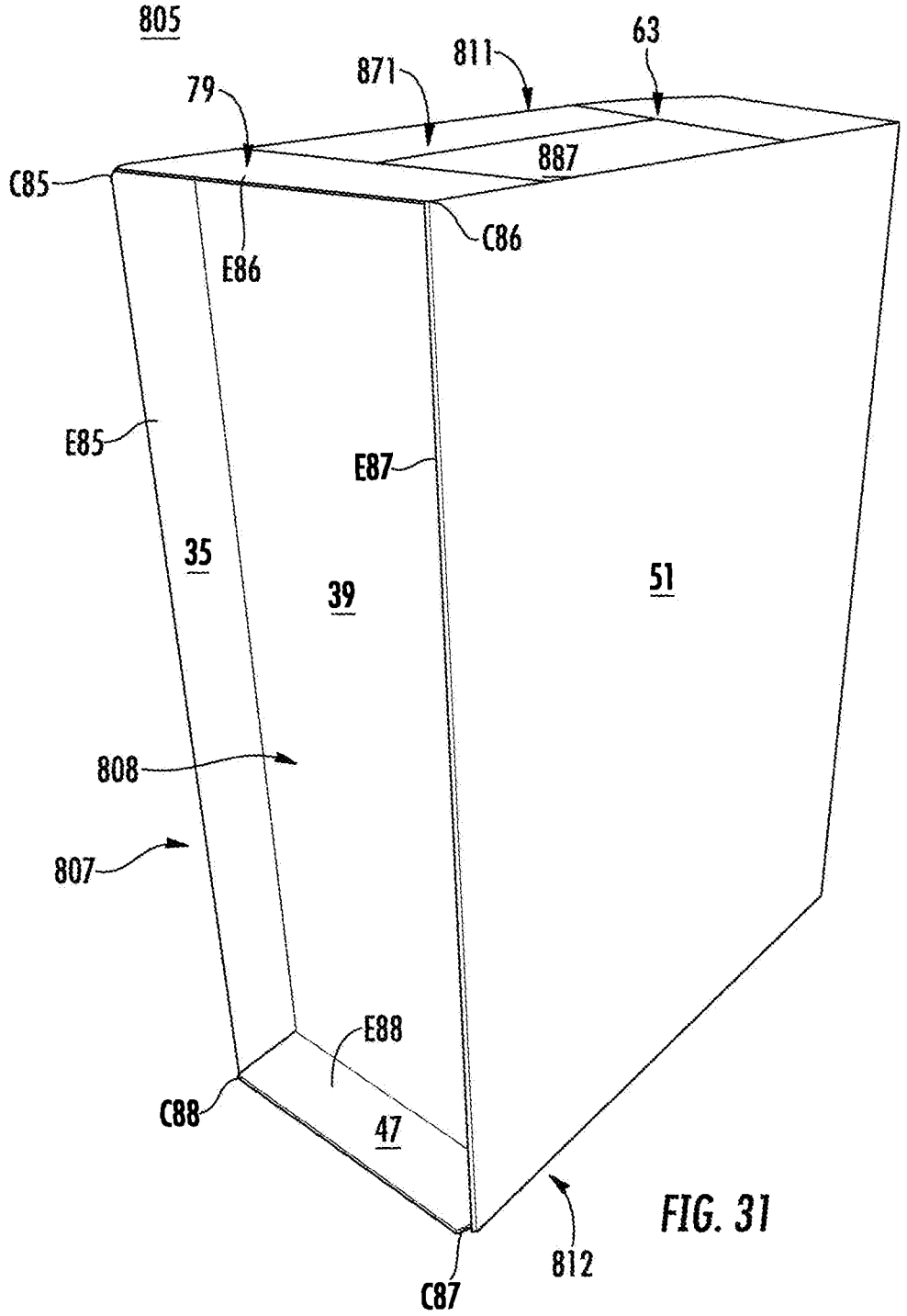
FIG. 31 is another perspective view of a carton formed from the blank of FIG. 29 according to an exemplary embodiment of the disclosure.

Turning to FIGS. 29-31, a blank 803 and a carton 805 formed therefrom are illustrated according to an eighth exemplary embodiment of the disclosure. The blank 803 and the carton 805 can have one or more substantially similar features to the blanks 3, 103, 203, 303, 503, 603, 703 (FIGS. 1, 9, 12, 15, 18, 23, 26) and the cartons 5, 105, 205, 305, 505, 605, 705 (FIGS. 7, 10, 13, 16, 19, 24, 27) of the first, second, third, fourth, fifth, sixth, and seventh exemplary embodiments of the disclosure, and like or similar components are referenced with like or similar reference numbers. As shown, the blank 803 is similar to the blank 3 (FIG. 1) of the first exemplary embodiment of the disclosure, however, respective end flaps 871, 875 are foldably connected to the side panel 31 at the respective fold lines 73, 77 and respective end flaps 887, 891 are foldably connected to the side panel 51 at the respective fold lines 89, 93. Each of the end flaps 871, 875, 887, 891, as shown, has the longitudinal width D4 that is less than the longitudinal width D5 of each of the side panels 31, 51. It will be understood that the blank 803 can be differently-arranged without departing from the disclosure.

Still referring to FIGS. 29-31, the blank 803 is folded such that the respective impact-resistant panels 15, 35 are folded at respective fold lines 33, 37 into at least partial face-to-face contact with the side panel 31 and the respective side panels 13, 39 are folded at the respective fold lines 17, 41 to be substantially upright, e.g., perpendicular, relative to the side panel 31 and to be in spaced planar parallel relation with one another. The impact-resistant panel 19 can be folded outwardly at the fold line 21 and the side panel 51 can be folded inwardly at the fold line 53 into at least partial face-to-face contact with the impact-resistant panel 19 to extend in spaced parallel relation with the side panel 31. The impact-resistant panel 55 can be folded at the fold line 57 into at least partial face-to-face contact with the side panel 51, and the attachment flap 46 can be folded at the fold line 48 into at least partial face-to-face contact with the impact-resistant panel 55 and secured thereto, for example, with an adhesive such as glue. Thereafter, the respective impact-resistant panels 23, 43 can be folded outwardly from the carton 805 at the respective fold lines 25, 45, and the end flaps 63, 79 can be folded toward the interior of the carton 805 at the respective fold lines 65, 81 and into at least partial face-to-face contact with the respective impact-resistant panels 23, 43. The respective end flaps 871, 887 can be folded at the respective fold lines 73, 89 into at least partial face-to-face contact with the end flaps 63, 79 to form a closed end 811 of the carton 705. Similarly, the respective impact-resistant panels 27, 47 can be folded at the respective fold lines 29, 49 outwardly from the carton 805 and the end flaps 67, 83 can be folded toward the interior of the carton 805 at the respective fold lines 69, 85 and into at least partial face-to-face contact with the respective impact-resistant panels 27, 47. The respective end flaps 875, 891 can be folded at the respective fold lines 77, 93 into at least partial face-to-face contact with the end flaps 67, 83 to form a closed end 812 of the carton 805.

In this regard, and as shown, the blank 803 is folded into the carton 805 such that the body portion 808 is formed at least partially by the panels 13, 31, 39, 51, and can also be at least partially formed by portions of one or more of the end flaps 63, 871, 79, 887, 67, 875, 83, 891 and with the impact-resistant features 807 extending away from the body portion 808 of the carton 805. The impact-resistant features 807 include the impact-resistant panels 15, 35 in face-to-face contact with portions of the side panel 31 in a two-ply configuration, the impact-resistant panels 19, 55 in face-to-face contact with portions of the side panel 51 in a two-ply configuration, the impact-resistant panel 23 in face-to-face contact with a portion of the end flap 63, the impact-resistant panel 43 in face-to-face contact with a portion of the end flap 79, the impact-resistant panel 27 in face-to-face contact with a portion of the end flap 67, and the impact-resistant panel 47 in face-to-face contact with a portion of the end flap 83.

The impact-resistant features 807 proximate the panel 13, as shown, include a first extension E81 formed by the impact-resistant panel 19 in face-to-face contact with a portion of the panel 51, a second extension E82 formed by the impact-resistant panel 23 in face-to-face contact with a portion of the end flap 63, a third second extension E83 formed by the impact-resistant panel 15 in face-to-face contact with a portion of the panel 31, and a fourth extension E84 formed by the impact-resistant panel 27 in face-to-face contact with a portion of the end flap 67, with the first extension E81 and the second extension E82 intersecting at a first corner C81, the second extension E82 and the third extension E83 intersecting at a second corner C82, the third extension E83 and the fourth extension E84 intersecting at a third corner C83, and the fourth extension E84 and the first extension E81 intersecting at a fourth corner C84. As also shown, the impact-resistant features 807 proximate the panel 39 include a fifth extension E85 formed by the impact-resistant panel 35 in face-to-face contact with a portion of the panel 31, a sixth extension E86 formed by the impact-resistant panel 43 in face-to-face contact with a portion of the end flap 79, a seventh extension E87 formed by the impact-resistant panel 55 in face-to-face contact with a portion of the panel 51, and an eighth extension E88 formed by the impact-resistant panel 47 in face-to-face contact with a portion of the end flap 83, with the fifth extension E85 and the sixth extension E86 intersecting at a fifth corner C85, the sixth extension E86 and the seventh extension E87 intersecting at a sixth corner C86, the seventh extension E87 and the eighth extension E88 intersecting at a seventh corner C87, and the eighth extension E88 and the fifth extension E85 intersecting at an eighth corner C88. Such extensions and corners E81, E82, E83, E84, E85, E86, E87, E88 and C81, C82, C83, C84, C85, C86, C87, and C88 and/or other portions of impact-resistant features 807 provide resistance to impacts as described above with respect to the cartons 5, 105, 205, 305, 505, 605, 705 (FIG. 7, 10, 13, 16, 19, 24, 27).

Figure 32:
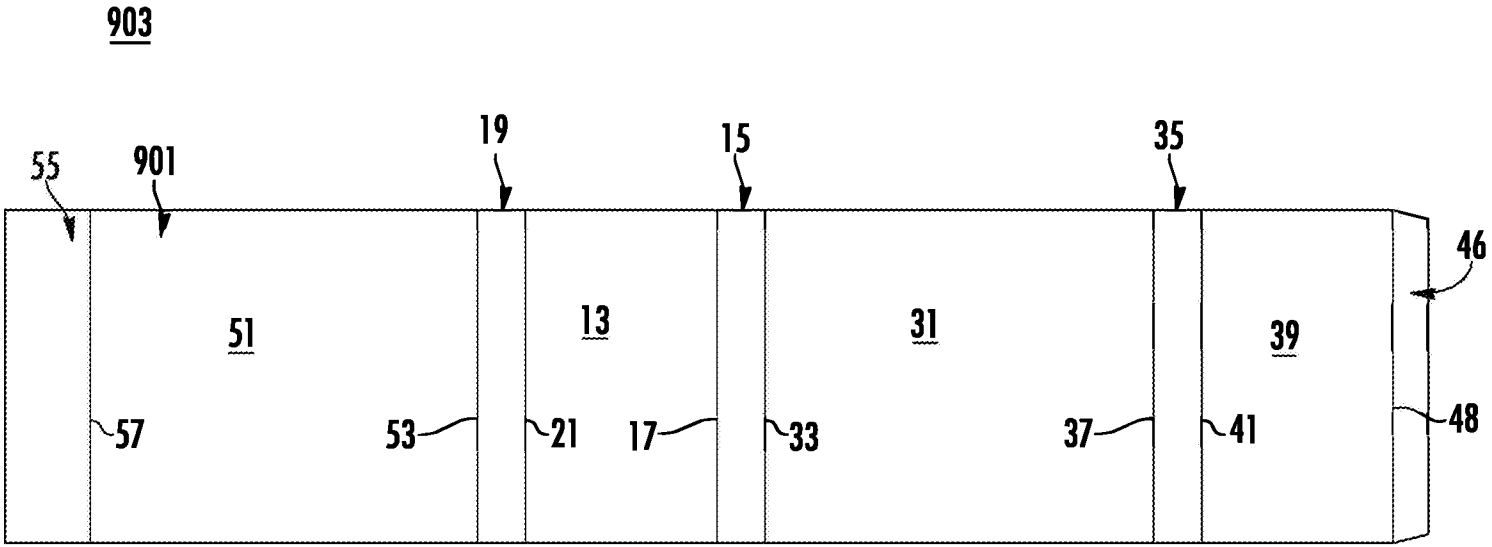
FIG. 32 is a plan view of an interior surface of a blank for forming a carton according to a ninth exemplary embodiment of the disclosure.
Figure 33:
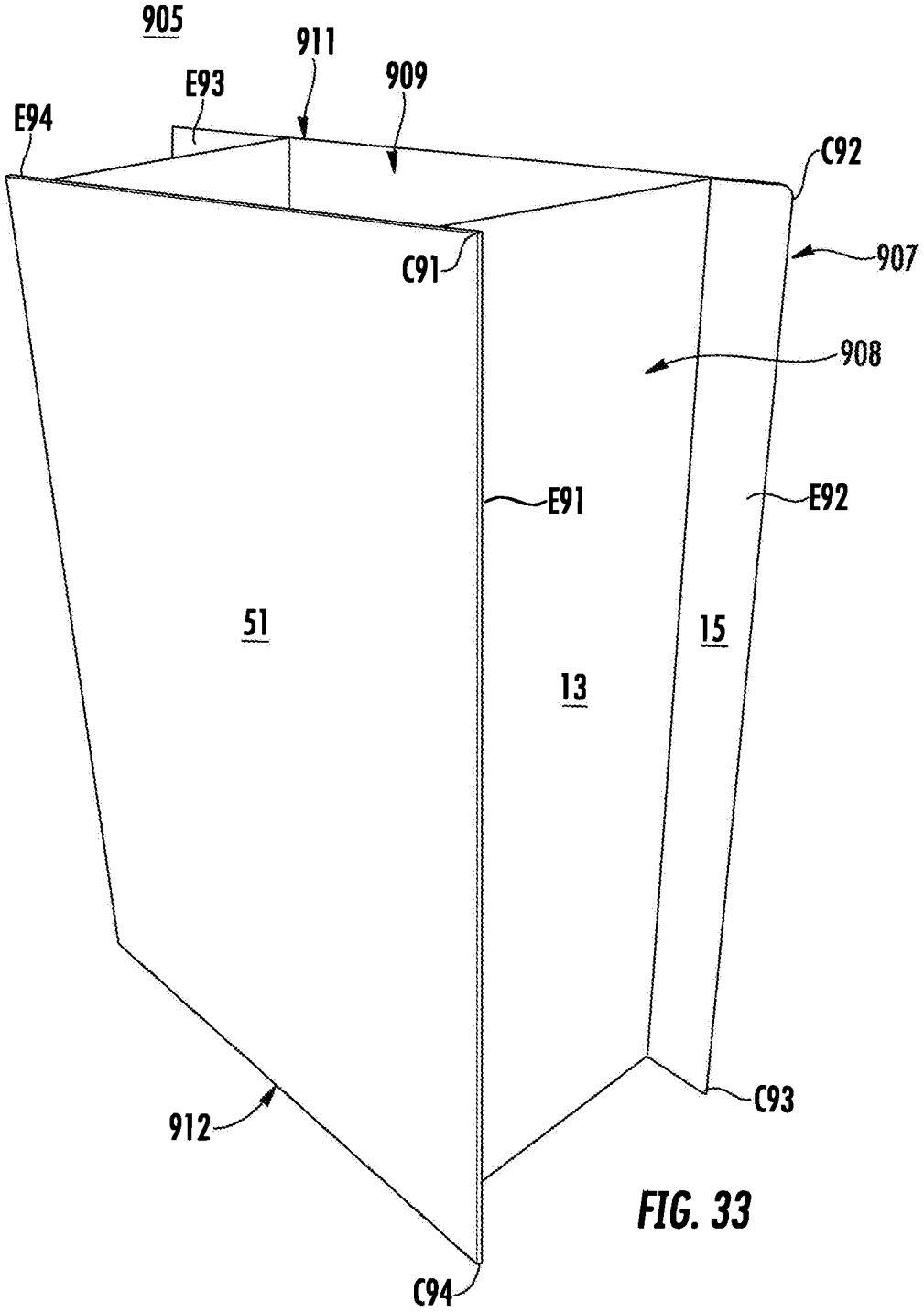
FIG. 33 is a perspective view of a carton formed from the blank of FIG. 32 according to an exemplary embodiment of the disclosure.
Figure 34:
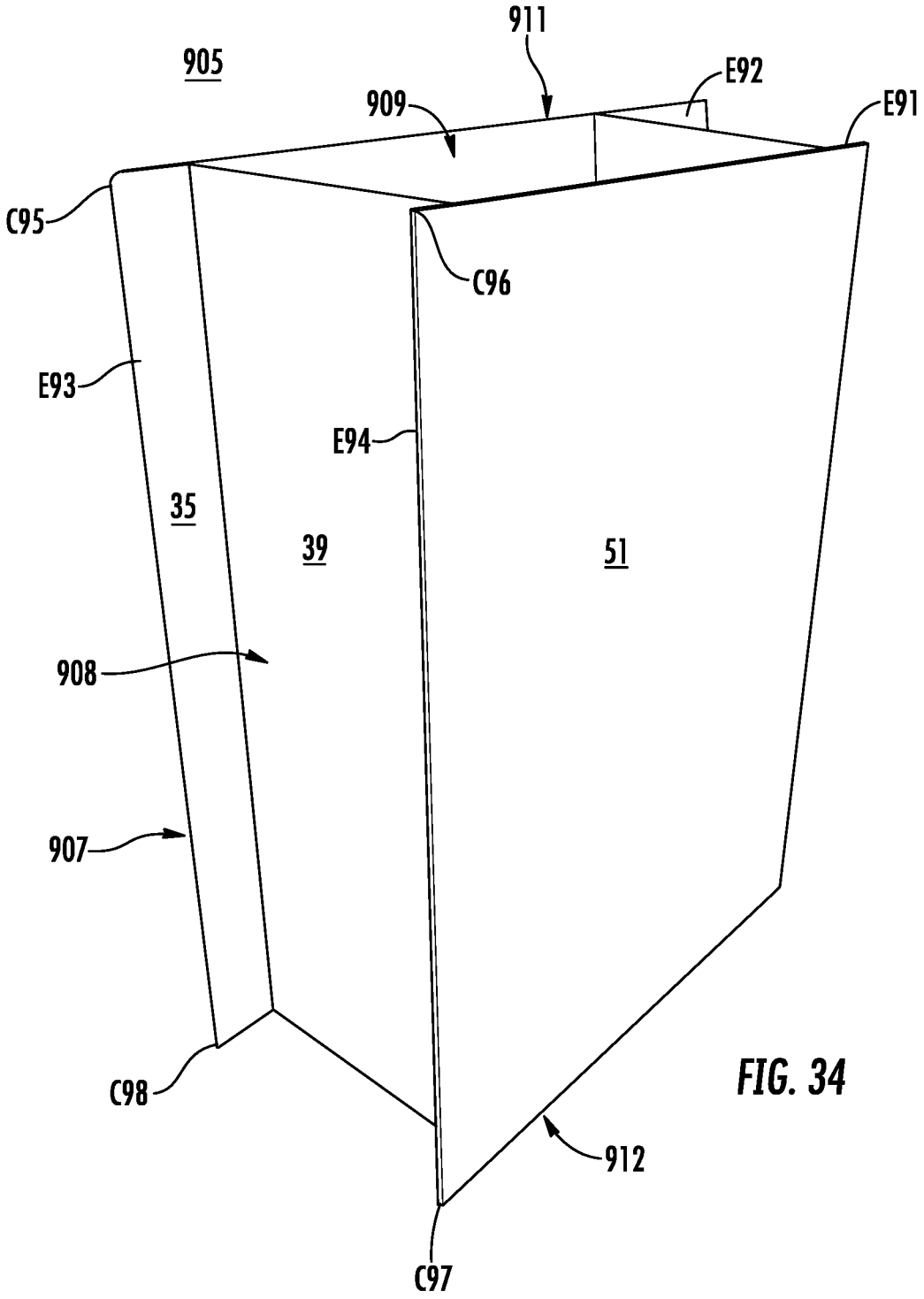
FIG. 34 is another perspective view of a carton formed from the blank of FIG. 32 according to an exemplary embodiment of the disclosure.

Turning to FIGS. 32-34, a blank 903 and a carton 905 formed therefrom are illustrated according to a ninth exemplary embodiment of the disclosure. The blank 903 and the carton 905 can have one or more substantially similar features to the blanks 3, 103, 203, 303, 503, 603, 703, 803 (FIGS. 1, 9, 12, 15, 18, 23, 26, 29) and the cartons 5, 105, 205, 305, 505, 605, 705, 805 (FIGS. 7, 10, 13, 16, 19, 24, 27, 30) of the first, second, third, fourth, fifth, sixth, seventh, and eighth exemplary embodiments of the disclosure, and like or similar components are referenced with like or similar reference numbers. As shown, the blank 903 is similar to the blank 3 (FIG. 1) of the first exemplary embodiment of the disclosure, however, no end flaps are foldably connected to the side panels 13, 31, 39, 51. It will be understood that the blank 903 can be differently-arranged without departing from the disclosure.

Still referring to FIGS. 32-34, the blank 903 is folded such that the respective impact-resistant panels 15, 35 are folded at respective fold lines 33, 37 into at least partial face-to-face contact with the side panel 31 and the respective side panels 13, 39 are folded at the respective fold lines 17, 41 to be substantially upright, e.g., perpendicular, relative to the side panel 31 and to be in spaced planar parallel relation with one another. The impact-resistant panel 19 can be folded outwardly at the fold line 21 and the side panel 51 can be folded inwardly at the fold line 53 into at least partial face-to-face contact with the impact-resistant panel 19 to extend in spaced parallel relation with the side panel 31. The impact-resistant panel 55 can be folded at the fold line 57 into at least partial face-to-face contact with the side panel 51, and the attachment flap 46 can be folded at the fold line 48 into at least partial face-to-face contact with the impact-resistant panel 55 and secured thereto, for example, with an adhesive such as glue. In this regard, the carton 905 is formed in a sleeve-like configuration having open ends 911, 912 through which an interior 909 of the carton 905 is accessible. In one embodiment, the carton 905 is configured such that an article can be placed in the interior 909 of the carton 905, with the carton 905 disposed in an outer container, for example, a larger carton or other package.

As shown, the blank 903 is folded into the carton 905 such that the body portion 908 is formed at least partially by the panels 13, 31, 39, 51, and with the impact-resistant features 907 extending away from the body portion 908 of the carton 905. The impact-resistant features 907 include the impact-resistant panels 15, 35 in face-to-face contact with portions of the side panel 31 in a two-ply configuration and the impact-resistant panels 19, 55 in face-to-face contact with portions of the side panel 51 in a two-ply configuration.

The impact-resistant features 907 proximate the panel 13, as shown, include a first extension E91 formed by the impact-resistant panel 19 in face-to-face contact with a portion of the panel 51 and a second extension E92 formed by the impact-resistant panel 15 in face-to-face contact with a portion of the panel 31, with the first extension E91 forming a first corner C91 and a fourth corner C94 and the second extension E92 forming a second corner C92 and a third corner C93. As also shown, the impact-resistant features 907 proximate the panel 39 include a third extension E93 formed by the impact-resistant panel 35 in face-to-face contact with a portion of the panel 31 and a fourth extension E94 formed by the impact-resistant panel 55 in face-to-face contact with a portion of the panel 51, with the third extension E93 forming a fifth corner C95 and an eighth corner C98 and the fourth extension E94 forming a sixth corner C96 and a seventh corner C97, as shown. Such extensions and corners E91, E92, E93, E94, and C91, C92, C93, C94, C95, C96, C97, and C98 and/or other portions of impact-resistant features 907 provide resistance to impacts as described above with respect to the cartons 5, 105, 205, 305, 505, 605, 705, 805 (FIG. 7, 10, 13, 16, 19, 24, 27, 30).

Figure 35:
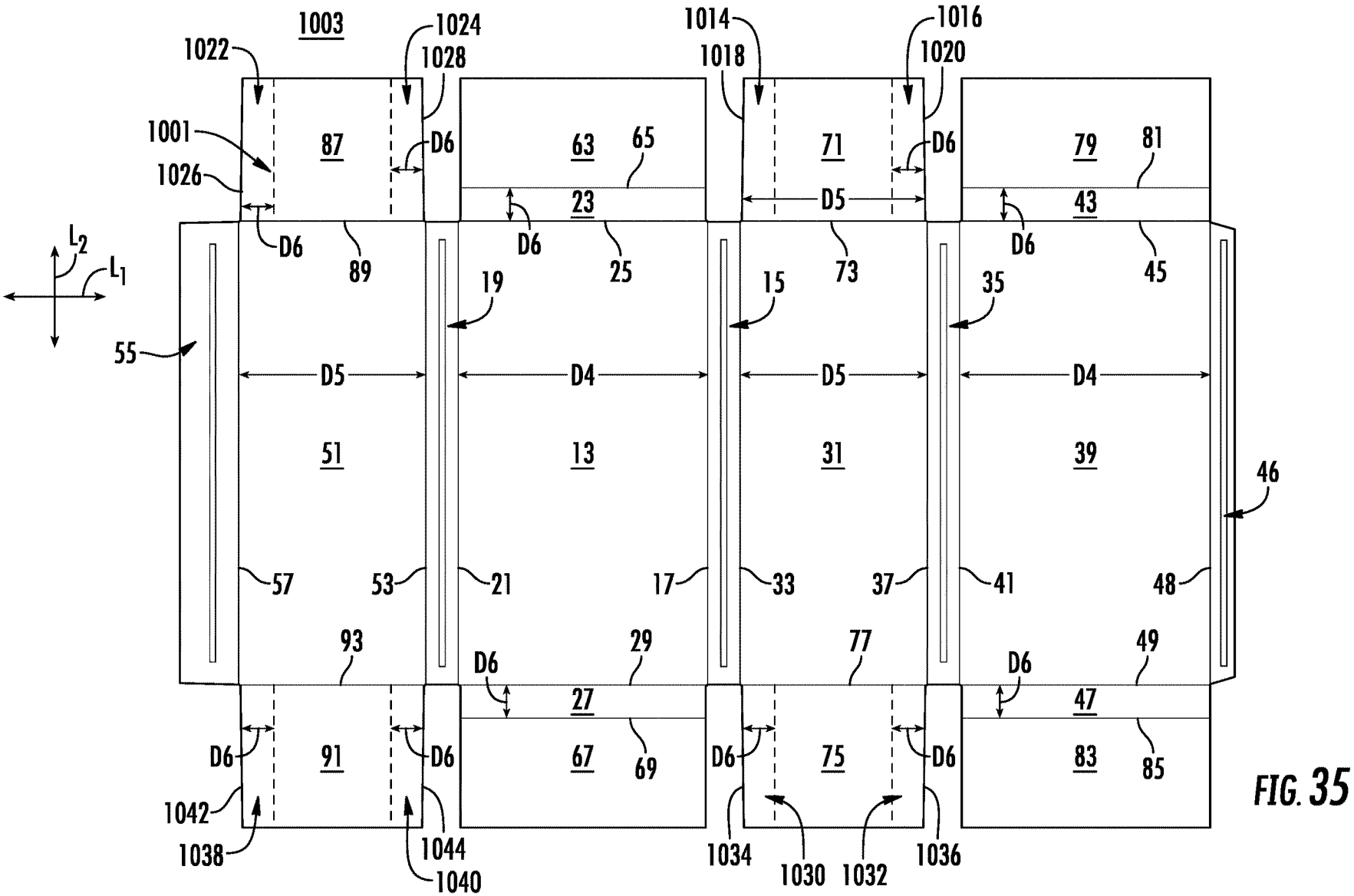
FIG. 35 is a plan view of an interior surface of a blank for forming a carton according to a tenth exemplary embodiment of the disclosure.

FIG. 35 is a plan view of the exterior side 1001 of a blank, generally indicated at 1003, used to form a carton 1005 (FIG. 40) for containing one or more articles according to a tenth exemplary embodiment of the disclosure. The blank 1003 and the carton 1005 can have one or more features that are substantially similar to one or more of the blanks 3, 103, 203, 303, 503, 603, 703, 803, 903 (FIGS. 1, 9, 12, 15, 18, 23, 26, 29, 32) and the respective cartons 5, 105, 205, 305, 505, 605, 705, 805, 905 (FIGS. 7, 10, 13, 16, 19, 24, 27, 30, 33) of the first, second, third, fourth, fifth, sixth, seventh, eighth, and ninth exemplary embodiments of the disclosure, and like or similar components are referenced with like or similar reference numbers.

As shown, the blank 1003 has some features that are similar to the blank 3 (FIG. 1) of the first exemplary embodiment of the disclosure, however, both of the front or first side panel 13 and the back or third side panel 39 have a longitudinal distance or width D4 that is greater than a longitudinal distance or width D5 of both of the second and fourth side panels 31, 51. The impact-resistant panels 23, 43, 27, 47 have a lateral distance or height D6. The top end flaps 71, 87 and the bottom end flaps 75, 91 have the longitudinal width D5 at least proximate the respective fold lines 73, 89, 75, 91, though it will be understood that one or more of the end flaps 71, 87, 75, 91 can have a tapered configuration such that one or more portions thereof can have a longitudinal width less than D5.

As shown, the end flaps 63, 79, 67, 83 are configured as a second plurality of end flaps, and the end flaps 71, 87, 75, 91 are configured as a first plurality of end flaps, with the end flap 71 having lateral outer edge margins 1014, 1016 that extend to respective lateral outer edges 1018, 1020 of the end flap 71, the end flap 87 having lateral outer edge margins 1022, 1024 that extend to respective lateral outer edges 1026, 1028 of the end flap 87, the end flap 75 having lateral outer edge margins 1030, 1032 that extend to respective lateral outer edges 1034, 1036 of the end flap 75, and the end flap 91 having lateral outer edge margins 1038, 1040 that extend to respective lateral outer edges 1042, 1044 of the end flap 91. It will be understood that the blank 1003 can be differently-arranged without departing from the disclosure.

In one exemplary embodiment, the carton 1005 can be assembled by positioning the blank 1003 with the interior side facing up and folding the impact-resistant panel 55 at the fold line 57 into at least partial face-to-face contact with the fourth side panel 51 and thereafter folding the second side panel 31 at the fold line 33 into at least partial face-to-face contact with respective portions of the impact-resistant panel 15 and the first side panel 13. The impact-resistant panel 15 can thereafter be folded at the fold line 17 into at least partial face-to-face contact with the exterior side 1001 of the first side panel 13 (i.e., the impact-resistant panel 15 is backfolded relative to the aforementioned folding).

Thereafter, the impact-resistant panel 35 can be folded at the fold line 37 into at least partial face-to-face contact with the second side panel 31 and such that the third side panel 39 and the attachment flap 46 are carried into at least partial face-to-face contact with respective portions of the second side panel 31 and the first side panel 13. The fourth side panel 51 can then be folded at the fold line 53 into at least partial face-to-face contact with respective portions of the impact-resistant panel 19 and the first side panel 13, and such that the impact-resistant panel 55 (which was previously folded into at least partial face-to-face contact with the fourth side panel 51) is folded into at least partial face-to-face contact with the attachment flap 46.

Thereafter, the carton 1005 can be arranged in an open sleeve configuration that extends around the interior 1009 of the carton 1005 and such that the first side panel 13 is in parallel spaced relation with the third side panel 39, and such that the second side panel 31, the impact-resistant panel 15, and the impact-resistant panel 35 are in parallel spaced relation with the fourth side panel 51, the impact-resistant panel 55, the impact-resistant panel 19, and the attachment flap 46.

Figure 36:
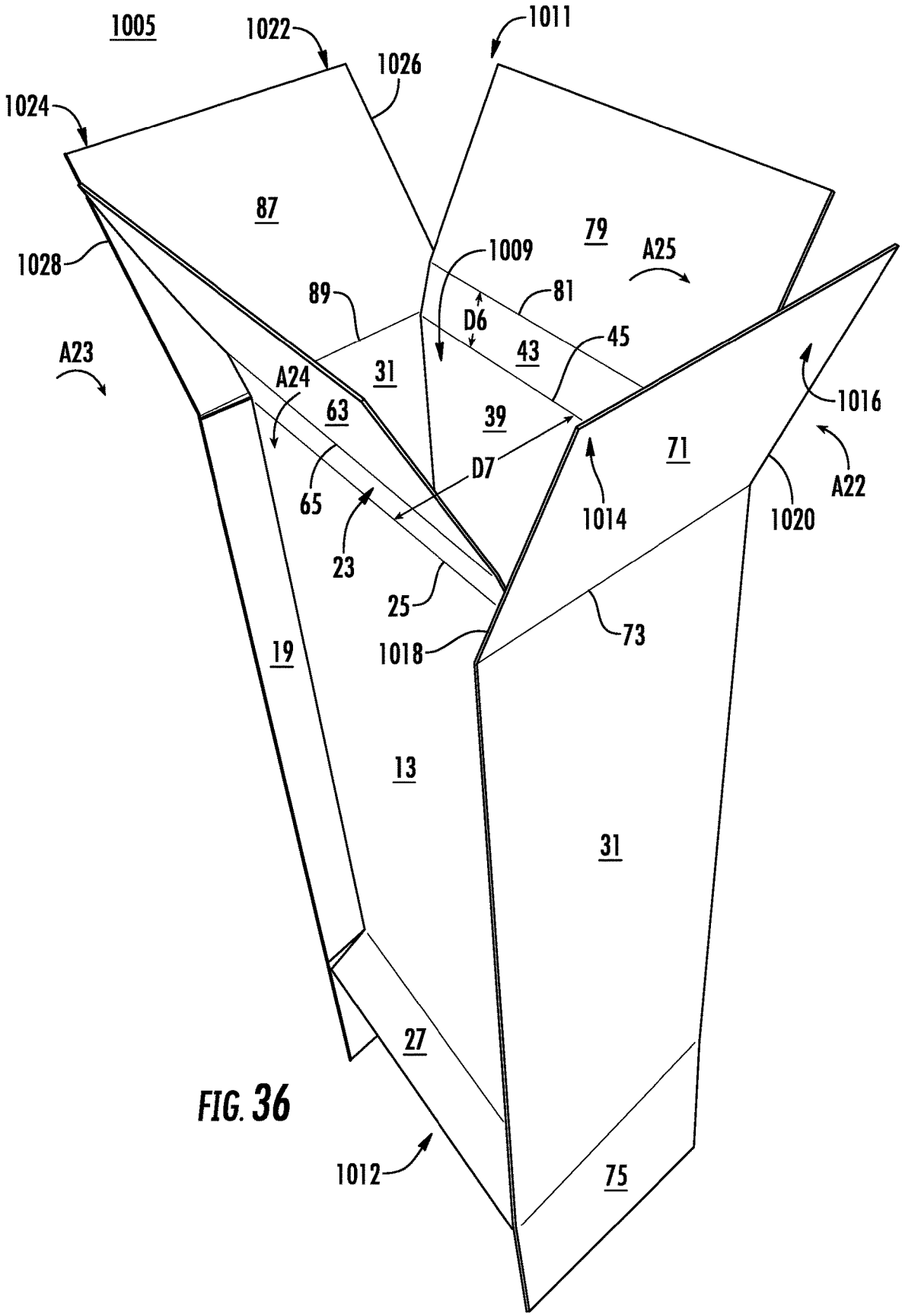
FIGS. 36-39 are sequential perspective views of a folding of the blank of FIG. 35 according to an exemplary embodiment of the disclosure.

In such an arrangement, the impact-resistant panels 15, 35 are in at least partial face-to-face contact with respective portions of the second side panel 31 such that the impact-resistant panel 15 and a portion of the second side panel 31, and the impact-resistant panel 35 and a portion of the second side panel 31, extend outwardly, e.g., away from the interior 1009, from the carton 1005 in a two-ply configuration. Similarly, the impact-resistant panels 55, 19 are each in at least partial face-to-face contact with respective portions of the fourth side panel 51 such that the impact-resistant panel 55 and a portion of the fourth side panel 51, and the impact-resistant panel 19 and a portion of the fourth side panel 51 extend outwardly from the carton 1005 in a two-ply configuration. The partially assembled carton 1005 illustrated in FIG. 36 has generally open ends 1011, 1012.

Still referring to FIG. 35, and referring additionally to FIGS. 36-39, the end 1011 of the carton 1005 can be closed by folding the end flaps 71, 87 at the respective fold lines 73, 89 in the direction of the respective arrows A22, A23 inwardly, e.g., toward the interior 1009 of the carton 1005. The end flaps 71, 87 are sized so that as the end flaps 71, 87 are folded downwardly toward the interior 1009 of the carton 1005, the lateral outer edge margins 1014, 1024 and 1016, 1022 of the end flaps 71, 87 urge the respective impact-resistant panels 23, 43 to fold at the respective fold lines 45, 25 in the direction of the respective arrows A24, A25, outwardly, e.g., away from the interior 1009 of the carton 1005, such that the lateral outer edge margins 1014, 1024 are in at least partial face-to-face contact with the impact-resistant panel 23 and the lateral outer edge margins 1016, 1022 are in at least partial face-to-face contact with the impact resistant panel 43. In such an arrangement, the impact-resistant panels 23, 43 are disposed in a generally perpendicular arrangement relative to the respective panels 13, 31, 39, 51 and impact-resistant panels 19, 15, 35, 55. Overlapping portions of the end flaps 71, 87 can also be in at least partial face-to-face contact in this configuration. In this regard, at least a portion of one or more of the end flaps 71, 87 has the length D5 that is substantially equal to the distance D7 across the interior 1009 of the carton 1005 in addition to the distances D6 along respective impact resistant panels 23, 43, e.g., D5=D7+2×D6.

Figure 37:
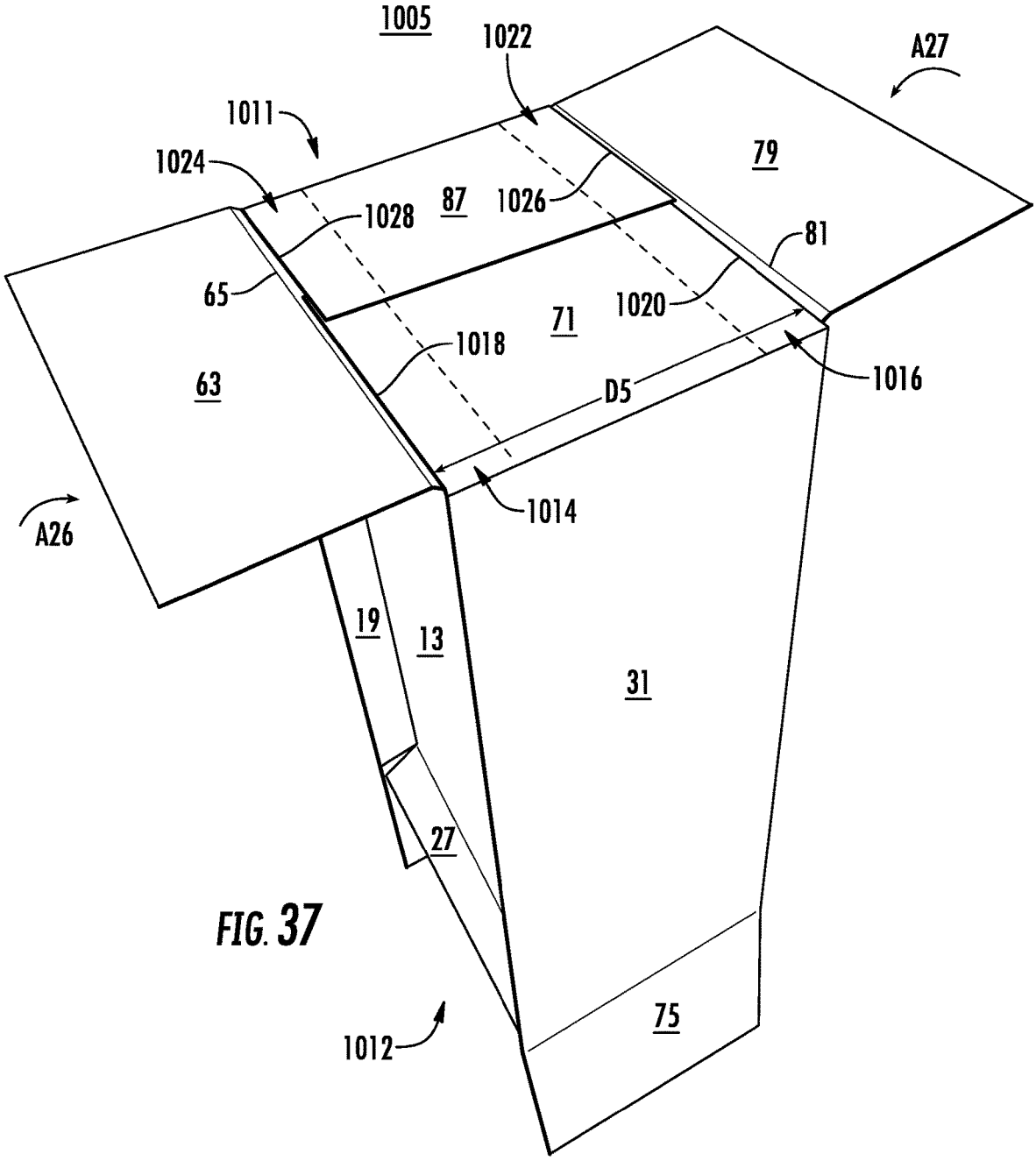
Figure 38:
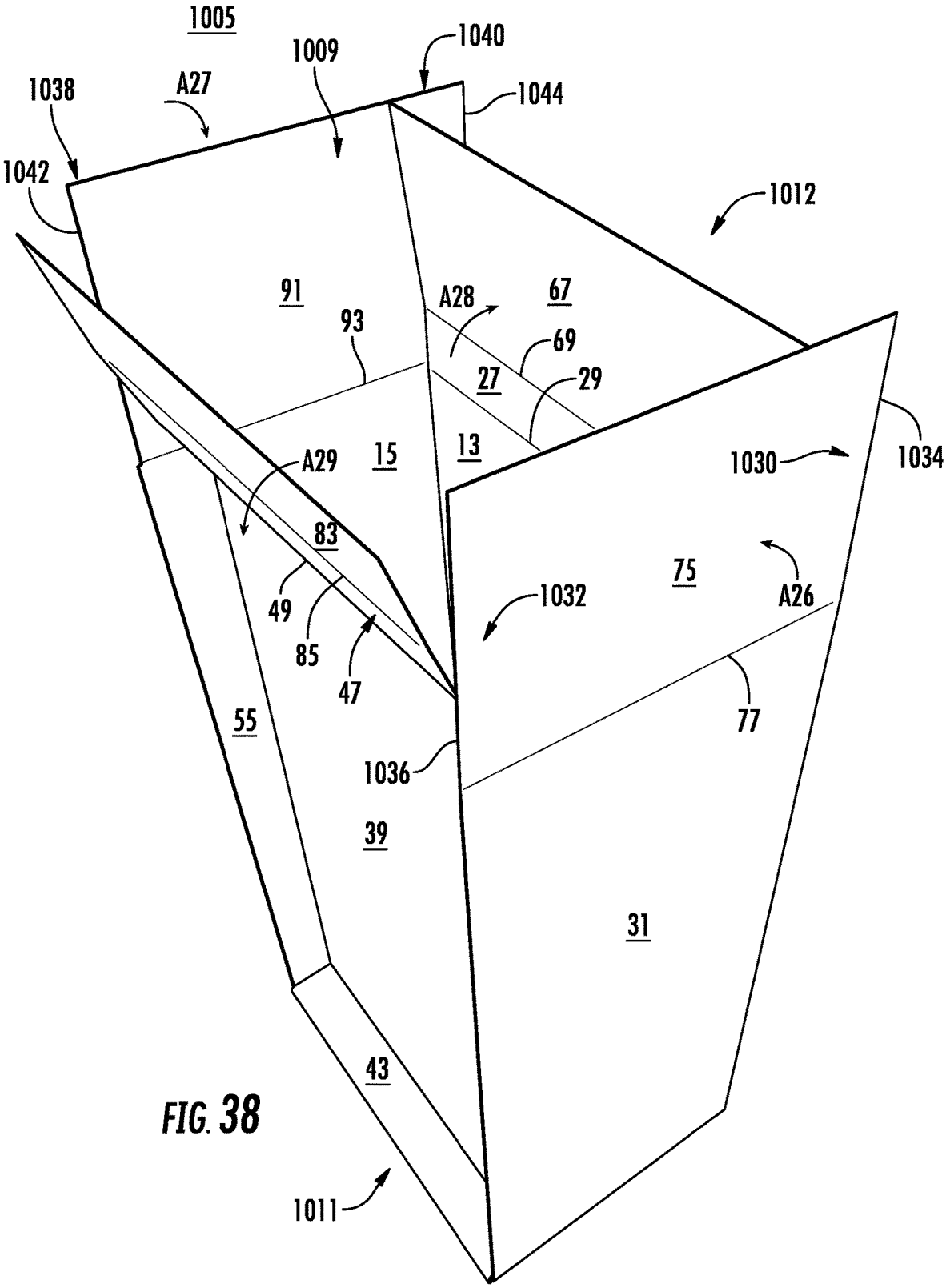
Figure 39:
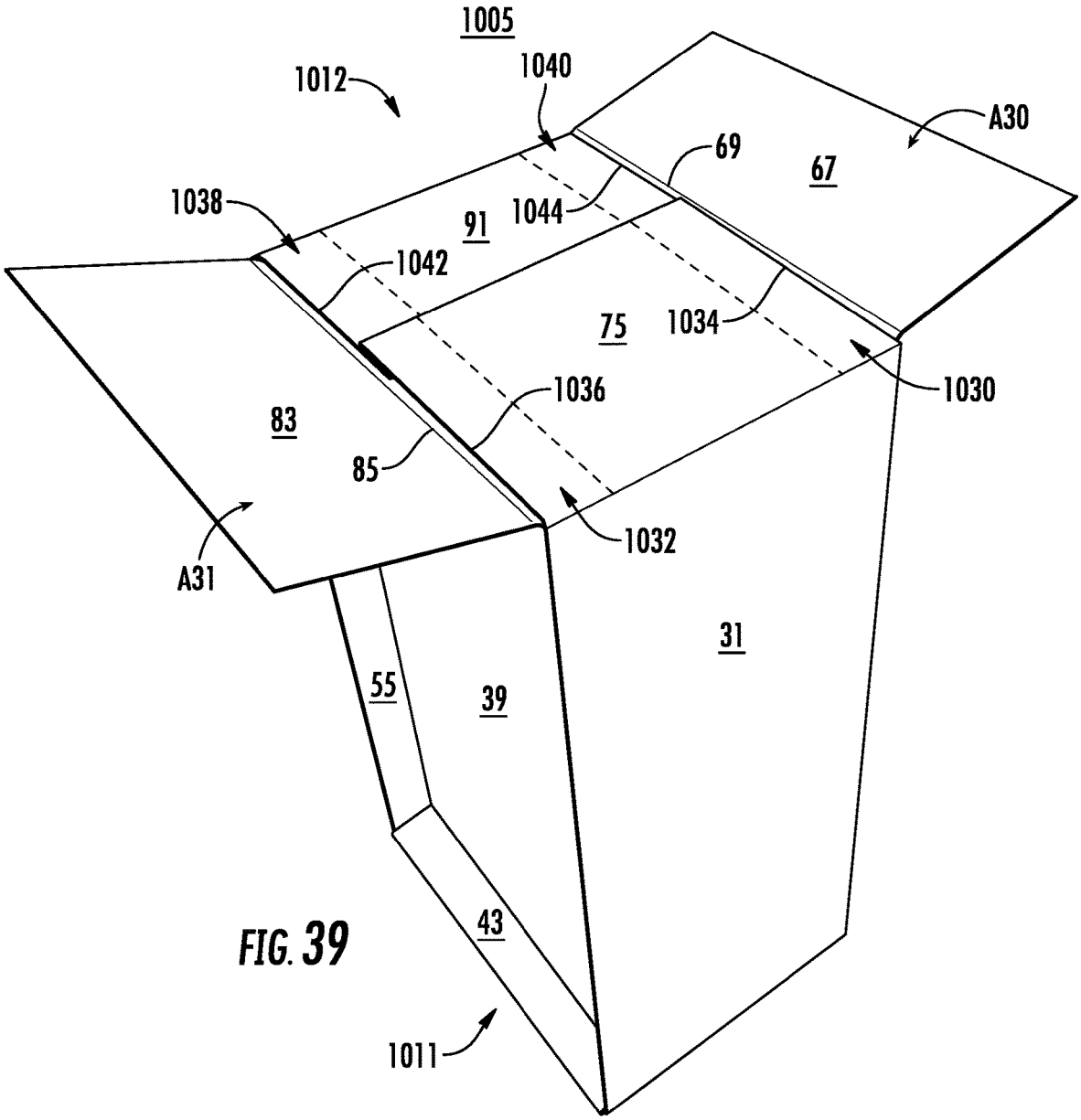

As shown in FIG. 37, the end flaps 71, 87 are folded into at least partial face-to-face contact so that the lateral edges 1018, 1028 of the respective end flaps 71, 87 are positioned to be generally aligned with the fold line 65, and the lateral edges 1020, 1026 of the respective end flaps 71, 87 are positioned to be generally aligned with the fold line 81. In the partially closed position of FIG. 37, the lateral edges 1018, 1028 of the respective end flaps 71, 87 present a folding edge or folding structure about which the end flap 63 can be folded at the fold line 65 in the direction of the arrow A26 and the lateral edges 1020, 1026 of the respective end flaps 71, 87 are positioned as a folding edge or folding structure about which the end flap 79 can be folded at the fold line 81 in the direction of the arrow A27. Upon folding the end flaps 63, 79 at the respective fold lines 65, 81, each end flap 63, 79 is in at least partial face-to-face contact with the end flaps 71, 87 and/or each other, and such that the first closed end 1011 of the carton 1005 is formed. In such an arrangement, respective portions of the end flaps 63, 79 are also positioned in overlapping relation with the respective impact-resistant panels 23, 43. Furthermore, the respective lateral outer edge margins 1014, 1024 and 1016, 1022 of the end flaps 71, 87 maintain the respective impact-resistant panels 23, 43 in a substantially planar or otherwise generally stationary position to facilitate folding of the respective end flaps 63, 79.

The second end 1012 of the carton 1005 can be closed in a similar folding sequence as that described above with respect to the first end 1011 of the carton 1005. For example, the end flaps 75, 91 can be folded at the respective fold lines 77, 93 in the direction of the respective arrows A26, A27 inwardly toward the interior 1009 of the carton 1005. As the end flaps 75, 91 are folded downwardly, the lateral outer edge margins 1030, 1040 and 1032, 1038 of the end flaps 75, 91 urge the respective impact-resistant panels 27, 47 to fold at the respective fold lines 29, 49 in the direction of the respective arrows A28, A29, outwardly away from the interior 1009 of the carton 1005 such that the lateral outer edge margins 1030, 1040 are in at least partial face-to-face contact with the impact-resistant panel 27 and the lateral outer edge margins 1032, 1038 are in at least partial face-to-face contact with the impact resistant panel 47. The end flaps 75, 91 can also be in at least partial face-to-face contact in this configuration, and the impact-resistant panels 27, 48 can be positioned in generally perpendicular relation relative to the respective panels 13, 39. In such an arrangement, the lateral edges 1034, 1044 of the respective end flaps 75, 91 are positioned to be generally aligned with the fold line 69, and the lateral edges 1036, 1042 of the respective end flaps 75, 91 are positioned to be generally aligned with the fold line 85.

Accordingly, the lateral edges 1034, 1044 of the respective end flaps 75, 91 are also positioned as a folding structure or folding edge about which the end flap 67 can be folded at the fold line 69 in the direction of the arrow A30 and the lateral edges 1036, 1042 of the respective end flaps 75, 91 are positioned as a folding structure or folding edge about which the end flap 83 can be folded at the fold line 85 in the direction of the arrow A31 to provide the end flaps 83, 67 in at least partial face-to-face contact with the end flaps 75, 91 and/or each other, and such that a second closed end 1012 of the carton 1005 is formed. In such an arrangement, respective portions of the end flaps 67, 83 are also positioned in overlapping relation with the respective impact-resistant panels 27, 47. The respective lateral outer edge margins 1032, 1038 and 1030, 1040 of the end flaps 75, 91 maintain the respective impact-resistant panels 47, 27 in a substantially planar or otherwise generally stationary position to facilitate folding of the respective end flaps 83, 67.

Figure 40:
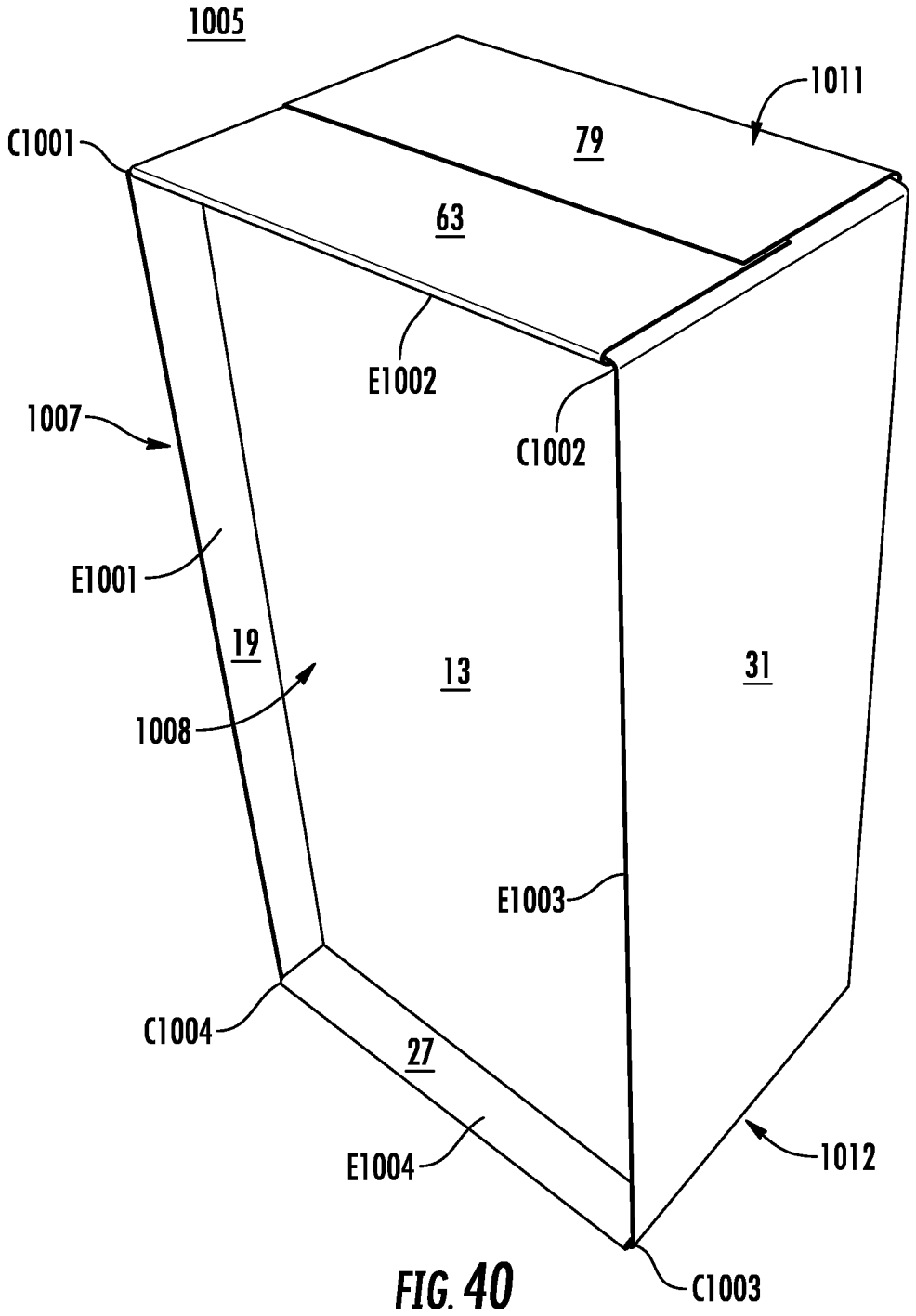
FIG. 40 is a perspective view of a carton formed from the blank of FIG. 35 according to an exemplary embodiment of the disclosure.
Figure 41:
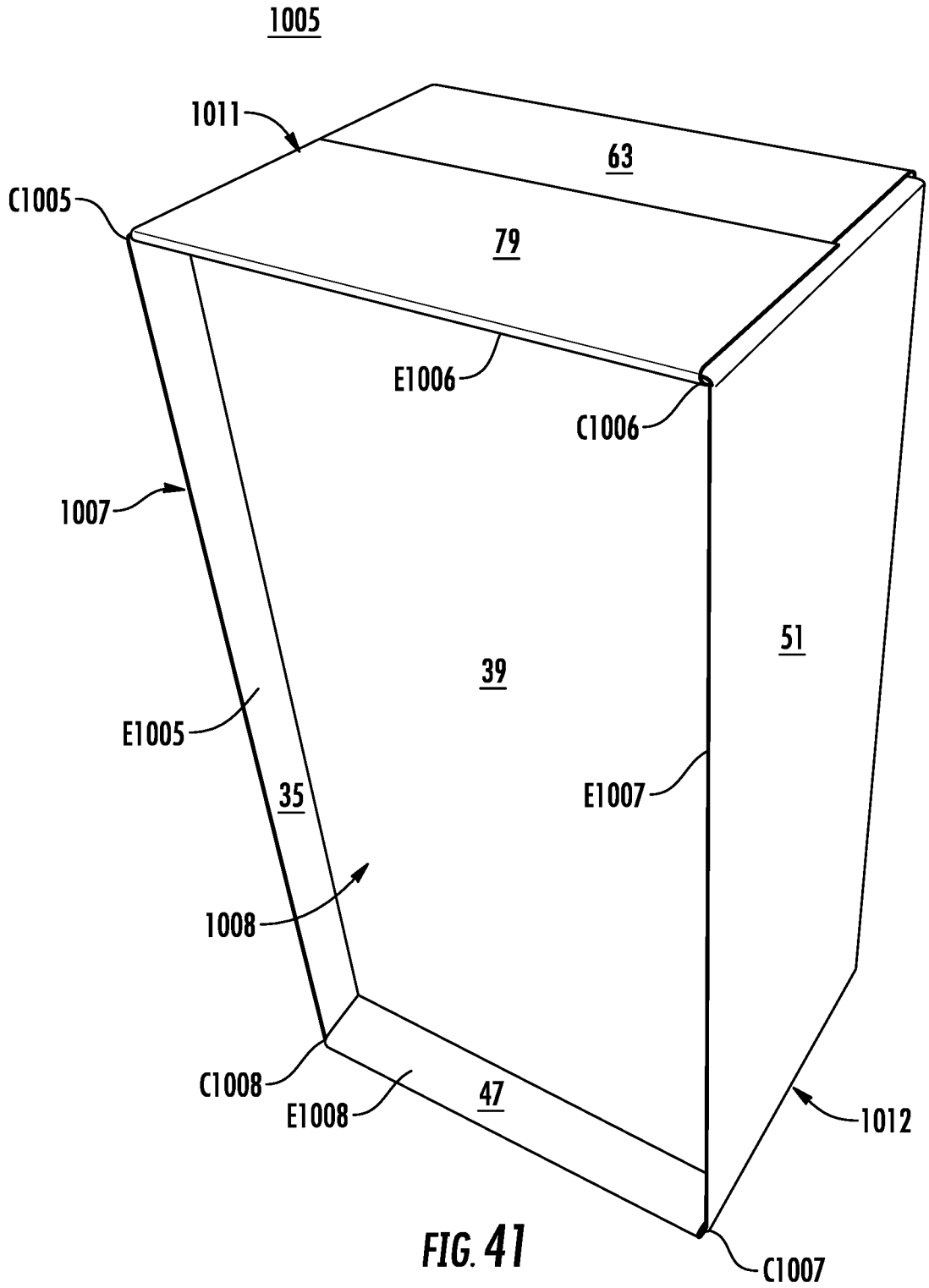
FIG. 41 is another perspective view of a carton formed from the blank of FIG. 35 according to an exemplary embodiment of the disclosure.

The fully formed and closed carton 1005 is shown in FIGS. 40 and 41. The carton 1005 is provided with the respective impact-resistant panels 55, 19 and respective portions of the side panel 51, the respective impact-resistant panels 15, 35 and respective portions of the side panel 31, the impact-resistant panels 43, 47 and respective portions of the end flaps 79, 83, and the impact-resistant panels 23, 27 and respective portions of the end flaps 63, 67 each in a two-ply configuration and forming impact-resistant features 1007 extending away from the body portion 1008 of the carton 1005 that is formed at least by portions of the side panels 13, 31, 39, 51 and which, in one embodiment, can also include portions of the end flaps 63, 67, 79, 83, 71, 75, 87, and 91. In the illustrated embodiment, the body portion 1008 of the carton 1005 may exclude those portions of the side panels 31, 51 that are overlapped with the respective impact-resistant panels 15, 35 and impact-resistant panels 19, 55.

As shown in FIG. 40, the impact-resistant features 1007 proximate the panel 13, as shown, include a first extension E1001 (broadly, "third extension") formed by the impact-resistant panel 19 in face-to-face contact with a portion of the panel 51, a second extension E1002 formed by the impact-resistant panel 23 in face-to-face contact with a portion of the end flap 63 and portions of the end flaps 71, 87, a third extension E1003 (broadly, "first extension") formed by the impact-resistant panel 15 in face-to-face contact with a portion of the panel 31, and a fourth extension E1004 formed by the impact-resistant panel 27 in face-to-face contact with a portion of the end flap 67 and portions of the end flaps 75, 91. The first extension E1001 and the second extension E1002 intersect at a first corner C1001 (broadly, "second corner"), the second extension E1002 and the third extension E1003 intersect at a second corner C1002 (broadly, "first corner"), the third extension E1003 and the fourth extension E1004 intersect at a third corner C1003 (broadly, "fourth corner"), and the fourth extension E1004 and the first extension E1001 intersect at a fourth corner C1004 (broadly, "third corner"), as shown.

As shown in FIG. 41, the impact-resistant features 1007 proximate the panel 39 include a fifth extension E1005 formed by the impact-resistant panel 35 in face-to-face contact with a portion of the panel 31, a sixth extension E1006 formed by the impact-resistant panel 43 in face-to-face contact with a portion of the end flap 79 and portions of the end flaps 71, 87, a seventh extension E1007 formed by the impact-resistant panel 55 in face-to-face contact with a portion of the panel 51, and an eighth extension E1008 formed by the impact-resistant panel 47 in face-to-face contact with a portion of the end flap 83 and portions of the end flaps 75, 91. The fifth extension E1005 and the sixth extension E1006 intersect at a fifth corner C1005, the sixth extension E1006 and the seventh extension E1007 intersect at a sixth corner C1006, the seventh extension E1007 and the eighth extension E1008 intersect at a seventh corner C1007, and the eighth extension E1008 and the fifth extension E1005 intersect at an eighth corner C1008, as shown.

Such extensions E1001, E1002, E1003, E1004, E1005, E1006, E1007, and E1008 and corners C1001, C1002, C1003, C1004, C1005, C1006, C1007, and C1008 extending from the body portion 1008 of the carton 1005, and/or other portions of the impact-resistant features 1007, provide resistance to impacts as described above with respect to the cartons 5, 105, 205, 305, 505, 605, 705, 805, 905 (FIG. 7, 10, 13, 16, 19, 24, 27, 30, 33).

Additionally, at the first end 1011 of the carton 1005, the edges 1018, 1028 of the respective end flaps 71, 87 are sandwiched or disposed between the end flap 63 and the impact-resistant panel 23, with the edges 1018, 1028 spaced away from the fold line 65 toward the interior 1009 of the carton 1005, and the edges 1020, 1026 of the respective end flaps 71, 87 are sandwiched or disposed between the end flap 79 and the impact-resistant panel 43, with the edges 1020, 1026 spaced away from the fold line 81 toward the interior 1009 of the carton 1005. In one embodiment, the edges 1018, 1028 and the edges 1020, 1026 can be generally aligned with or abutting the respective fold lines 65, 81.

At the second end 1012 of the carton 1005, the edges 1036, 1042 of the respective end flaps 75, 91 are sandwiched or disposed between the end flap 83 and the impact-resistant panel 47, with the edges 1036, 1042 spaced away from the fold line 85 toward the interior 1009 of the carton 1005, and the edges 1034, 1044 of the respective end flaps 75, 91 are sandwiched or disposed between the end flap 67 and the impact-resistant panel 27, with the edges 1034, 1044 spaced away from the fold line 69. In one embodiment, the edges 1036, 1042 and the edges 1034, 1044 can be generally aligned with or abutting the respective fold lines 85, 69.

Accordingly, the respective extensions E1002, E1006, E1004, and E1008 present rounded outer edges formed by the respective fold lines 65, 81, 69, 85 so as to provide a more robust structure, for example, as compared to an arrangement that presents multiple outward-facing edges. Furthermore, the positioning of portions of the end flaps 71, 87 between the end flap 63 and the impact-resistant panel 23, portions of the end flaps 71, 87 between the end flap 79 and the impact-resistant panel 43, portions of the respective end flaps 75, 91 between the end flap 67 and the impact-resistant panel 27, and portions of the respective end flaps 75, 91 between the end flap 83 and the impact-resistant panel 47 provides additional strength to the respective extensions E1002, E1006, E1004, and E1008.

It will be understood that the cartons disclosed herein can be differently-arranged without departing from the disclosure. For example, as described above with regard to the carton 905, one or more of the cartons 5, 105, 205, 305, 505, 605, 705, 805, 1005 can be devoid of one or more end flaps such that the cartons 5, 105, 205, 305, 505, 605, 705, 805, 1005 can be provided with at least one open end, e.g., in a sleeve-like arrangement. In such a configuration, a respective carton 5, 105, 205, 305, 505, 605, 705, 805, 1005 can then be placed into an outer container, for example, a larger carton or other package.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding one or more articles, the carton comprising:

a plurality of panels extending at least partially around an interior of the carton and at least partially forming a body portion of the carton;

a plurality of impact-resistant panels foldably connected to a respective panel of the plurality of panels, the plurality of impact-resistant panels comprising a first impact-resistant panel and a second impact-resistant panel; and a plurality of end flaps for forming a closed end of the carton, the plurality of end flaps comprises a first end flap foldably connected to the first impact-resistant panel of the plurality of impact-resistant panels, a second end flap and a third end flap each foldably connected to a respective panel of the plurality of panels, and a fourth end flap foldably connected to the second impact-resistant panel of the plurality of impact-resistant panels, a lateral edge of the second end flap is a folding edge about which the first end flap is folded to at least partially form the closed end such that the second end flap is positioned between the first end flap and the first impact-resistant panel that is foldably connected to the first end flap, each of the first end flap, the second end flap, the third end flap, and the fourth end flap overlaps each respective other of the first end flap, the second end flap, the third end flap, and the fourth end flap to form the closed end of the carton.

2. The carton of claim 1, wherein the first end flap is foldably connected to the first impact-resistant panel at a fold line, the fold line is generally aligned with the lateral edge of the second end flap.

3. The carton of claim 2, wherein an outer edge margin of the second end flap is in at least partial face-to-face contact with the first impact-resistant panel, each of the outer edge margin of the second end flap and the first impact-resistant panel extends away from the body portion.

4. The carton of claim 3, wherein a portion of the first end flap is in at least partial face-to-face contact with the outer edge margin of the second end flap such that the outer edge margin of the second end flap is positioned between the first impact-resistant panel and the portion of the first end flap.

5. The carton of claim 2, wherein the first impact-resistant panel is generally perpendicular to the respective panel of the plurality of panels.

6. The carton of claim 1, wherein the first impact-resistant panel extends away from the body portion and is positioned in overlapping relation with a portion of the second end flap, the respective panel of the plurality of panels is a respective second side panel and third side panel, the plurality of panels further comprises a first side panel to which the first impact-resistant panel is foldably connected, and the plurality of impact-resistant panels further comprises a third impact-resistant panel extending away from the body portion and in at least partial face-to-face contact with a portion of the second side panel.

7. The carton of claim 6, wherein the third impact-resistant panel of the plurality of panels extends away from the body portion and is generally perpendicular to the first impact-resistant panel.

8. The carton of claim 7, wherein the plurality of panels further comprises a fourth side panel, the second impact-resistant panel is foldably connected to the fourth side panel, a lateral edge of the third end flap is a folding edge about which the fourth end flap is folded to at least partially form the closed end.

9. The carton of claim 7, wherein the plurality of impact-resistant panels further comprises a fourth impact-resistant panel foldably connected to the first side panel, the closed end is a first closed end of the carton, the first end flap and the second end flap are a respective first top end flap and second top end flap at least partially closing the first end of the carton, and the plurality of end flaps further comprises a first bottom end flap foldably connected to the fourth impact-resistant panel and a second bottom end flap foldably connected to the second side panel, a lateral edge of the second bottom end flap is a folding edge about which the first bottom end flap is folded to at least partially form the second closed end.

10. The carton of claim 9, wherein the plurality of impact-resistant panels further comprises a fifth impact-resistant panel foldably connected to the third side panel and in at least partial face-to-face contact with a portion of the third side panel, wherein the third impact-resistant panel and the portion of the second side panel form a first extension extending from the body portion, the first impact-resistant panel, a portion of the first end flap, and a portion of the second end flap form a second extension extending from the body portion, the fifth impact-resistant panel and the portion of the third side panel form a third extension extending away from the body portion, and the fourth impact-resistant panel, a portion of the first bottom end flap, and a portion of the second bottom end flap form a fourth extension extending away from the body portion.

11. The carton of claim 10, wherein the first extension and the second extension intersect at a first corner, the second extension and the third extension intersect at a second corner, the third extension and the fourth extension intersect at a third corner, and the fourth extension and the first extension intersect at a fourth corner.

12. The carton of claim 11, wherein the carton further comprises a fifth extension extending away from the body portion, a sixth extension extending away from the body portion, a seventh extension extending away from the body portion, and an eighth extension extending away from the body portion.

13. The carton of claim 12, wherein the fifth extension and the sixth extension intersect at a fifth corner, the sixth extension and the seventh extension intersect at a sixth corner, the seventh extension and the eighth extension intersect at a seventh corner, and the eighth extension and the fifth extension intersect at an eighth corner.

14. The carton of claim 1, wherein the closed end is a first closed end and the plurality of end flaps further form a second closed end of the carton, the plurality of panels extends from the first closed end to the second closed end.

15. The carton of claim 1, wherein the first end flap is in at least partial face-to-face contact with the fourth end flap.

16. A blank for forming a carton for holding one or more articles, the blank comprising:

a plurality of panels for extending at least partially around an interior of the carton formed from the blank and the plurality of panels being for at least partially forming a body portion of the carton;

a plurality of impact-resistant panels foldably connected to a respective panel of the plurality of panels, the plurality of impact-resistant panels comprising a first impact-resistant panel and a second impact-resistant panel; and a plurality of end flaps for forming a closed end of the carton formed form the blank, the plurality of end flaps comprises a first end flap foldably connected to the first impact-resistant panel of the plurality of impact-resistant panels, a second end flap and a third end flap each foldably connected to a respective panel of the plurality of panels, and a fourth end flap foldably connected to the second impact-resistant panel of the plurality of impact-resistant panels, a lateral edge of the second end flap is a folding edge about which the first end flap is for being folded to at least partially form the closed end of the carton formed from the blank such that the second end flap is positioned between the first end flap and the first impact-resistant panel that is foldably connected to the first end flap when the carton is formed from the blank, each of the first end flap, the second end flap, the third end flap, and the fourth end flap being for overlapping each respective other of the first end flap, the second end flap, the third end flap, and the fourth end flap to form the closed end of the carton formed from the blank.

17. The blank of claim 16, wherein the first end flap is foldably connected to the first impact-resistant panel at a fold line, the fold line is for being generally aligned with the lateral edge of the second end flap when the carton is formed from the blank.

18. The blank of claim 16, the first impact-resistant panel for being in overlapping relation with a portion of the first end flap when the carton is formed from the blank, the respective panel of the plurality of panels is a respective second side panel and third side panel, the plurality of panels further comprises a first side panel to which the first impact-resistant panel is foldably connected, and the plurality of impact-resistant panels further comprises a third impact-resistant panel for being in at least partial face-to-face contact with a portion of the second side panel when the carton is formed from the blank.

19. The blank of claim 18, wherein the plurality of panels further comprises a fourth side panel, the second impact-resistant panel is foldably connected to the fourth side panel, a lateral edge of the third end flap is a folding edge about which the fourth end flap is for being folded to at least partially form the closed end of the carton formed from the blank.

20. The blank of claim 18, wherein the plurality of impact-resistant panels further comprises a fourth impact-resistant panel foldably connected to the first side panel, the first end flap and the second end flap are a respective first top end flap and second top end flap, and the plurality of end flaps further comprises a first bottom end flap foldably connected to the fourth impact-resistant panel and a second bottom end flap foldably connected to the second side panel, a lateral edge of the second bottom end flap is a folding edge about which the first bottom end flap is folded.

21. The blank of claim 20, wherein the plurality of impact-resistant panels further comprises a fifth impact-resistant panel foldably connected to the third side panel and for being positioned in at least partial face-to-face contact with a portion of the third side panel when the carton is formed from the blank, wherein the third impact-resistant panel and the portion of the second side panel are for forming a first extension extending from the body portion of the carton formed from the blank, the first impact-resistant panel, a portion of the first end flap, and a portion of the second end flap are for forming a second extension extending from the body portion of the carton formed from the blank, the fifth impact-resistant panel and the portion of the third side panel are for forming a third extension extending away from the body portion of the carton formed from the blank, and the fourth impact-resistant panel, a portion of the first bottom end flap, and a portion of the second bottom end flap are for forming a fourth extension extending away from the body portion of the carton formed from the blank.

22. The blank of claim 16, wherein the first end flap is for being positioned in at least partial face-to-face contact with the fourth end flap when the carton is formed from the blank.

23. A method of forming a carton for holding one or more articles, the method comprising:

obtaining a blank comprising a plurality of panels, a plurality of impact-resistant panels foldably connected to a respective panel of the plurality of panels and comprising a first impact-resistant panel and a second impact-resistant panel, and a plurality of end flaps comprising a first end flap foldably connected to the first impact-resistant panel of the plurality of impact-resistant panels, a second end flap and a third end flap each foldably connected to a respective panel of the plurality of panels, and a fourth end flap foldably connected to the second impact-resistant panel of the plurality of impact-resistant panels;

folding the plurality of panels at least partially around an interior of the carton such that the plurality of panels at least partially forms a body portion of the carton; and folding the plurality of end flaps to at least partially form a closed end of the carton, a lateral edge of the second end flap is a folding edge about which the first end flap is folded to at least partially form the closed end such that the second end flap is positioned between the first end flap and the first impact-resistant panel that is foldably connected to the first end flap, each of the first end flap, the second end flap, the third end flap, and the fourth end flap overlaps each respective other of the first end flap, the second end flap, the third end flap, and the fourth end flap to form the closed end of the carton.

24. The method of claim 23, wherein the first end flap is foldably connected to the first impact-resistant panel at a fold line, the fold line is generally aligned with the lateral edge of the second end flap.

25. The method of claim 24, wherein an outer edge margin of the second end flap is in at least partial face-to-face contact with the first impact-resistant panel, each of the outer edge margin of the second end flap and the first impact-resistant panel extends away from the body portion.

26. The method of claim 25, wherein a portion of the first end flap is in at least partial face-to-face contact with the outer edge margin of the second end flap such that the outer edge margin of the second end flap is positioned between the first impact-resistant panel and the portion of the first end flap.

27. The method of claim 24, wherein the first impact-resistant panel is generally perpendicular to the respective panel of the plurality of panels.

28. The method of claim 24, wherein the first impact-resistant panel extends away from the body portion and is positioned in overlapping relation with a portion of the second end flap, the respective panel of the plurality of panels is a respective second side panel and third side panel, the plurality of panels further comprises a first side panel to which the first impact-resistant panel is foldably connected, and the plurality of impact-resistant panels further comprises a third impact-resistant panel extending away from the body portion and in at least partial face-to-face contact with a portion of the second side panel.

29. The method of claim 28, wherein the third impact-resistant panel of the plurality of panels extends away from the body portion and is generally perpendicular to the first impact-resistant panel.

30. The method of claim 29, wherein the plurality of panels further comprises a fourth side panel, the second impact-resistant panel foldably connected to the fourth side panel, a lateral edge of the third end flap is a folding edge about which the fourth end flap is folded to at least partially form the closed end.

31. The method of claim 28, wherein the plurality of impact-resistant panels further comprises a fourth impact-resistant panel foldably connected to the first side panel, the closed end is a first closed end of the carton, the first end flap and the second end flap are a respective first top end flap and second top end flap at least partially closing the first end of the carton, and the plurality of end flaps further comprises a first bottom end flap foldably connected to the fourth impact-resistant panel and a second bottom end flap foldably connected to the second side panel, a lateral edge of the second bottom end flap is a folding edge about which the first bottom end flap is folded to at least partially form the second closed end.

32. The method of claim 31, wherein the plurality of impact-resistant panels further comprises a fifth impact-resistant panel foldably connected to the third side panel and in at least partial face-to-face contact with a portion of the third side panel, wherein the third impact-resistant panel and the portion of the second side panel form a first extension extending from the body portion, the first impact-resistant panel, a portion of the first end flap, and a portion of the second end flap form a second extension extending from the body portion, the fifth impact-resistant panel and the portion of the third side panel form a third extension extending away from the body portion, and the fourth impact-resistant panel, a portion of the first bottom end flap, and a portion of the second bottom end flap form a fourth extension extending away from the body portion.

33. The method of claim 32, wherein the first extension and the second extension intersect at a first corner, the second extension and the third extension intersect at a second corner, the third extension and the fourth extension intersect at a third corner, and the fourth extension and the first extension intersect at a fourth corner.

34. The method of claim 33, wherein the carton further comprises a fifth extension extending away from the body portion, a sixth extension extending away from the body portion, a seventh extension extending away from the body portion, and an eighth extension extending away from the body portion.

35. The method of claim 34, wherein the fifth extension and the sixth extension intersect at a fifth corner, the sixth extension and the seventh extension intersect at a sixth corner, the seventh extension and the eighth extension intersect at a seventh corner, and the eighth extension and the fifth extension intersect at an eighth corner.

36. The method of claim 24, wherein the first end flap is in at least partial face-to-face contact with the fourth end flap.

37. The method of claim 23, wherein the closed end is a first closed end and the plurality of end flaps further form a second closed end of the carton, the plurality of panels extends from the first closed end to the second closed end.

* * * * *